US008215409B2

(12) United States Patent
Adam et al.

(10) Patent No.: US 8,215,409 B2
(45) Date of Patent: Jul. 10, 2012

(54) METHOD AND APPARATUS FOR EXPANDED LINER EXTENSION USING UPHOLE EXPANSION

(75) Inventors: Mark K. Adam, Houston, TX (US); Dennis G. Jiral, Katy, TX (US); Lance M. Rayne, Spring, TX (US); Michael E. McMahan, Humble, TX (US)

(73) Assignee: Baker Hughes Incorporated, Houston, TX (US)

( * ) Notice: Subject to any disclaimer, the term of this patent is extended or adjusted under 35 U.S.C. 154(b) by 380 days.

(21) Appl. No.: 12/534,428

(22) Filed: Aug. 3, 2009

(65) Prior Publication Data

US 2010/0032169 A1 Feb. 11, 2010

Related U.S. Application Data

(60) Provisional application No. 61/087,269, filed on Aug. 8, 2008.

(51) Int. Cl.
*E21B 43/10* (2006.01)

(52) U.S. Cl. ..... 166/384; 166/207

(58) Field of Classification Search ..... 166/384, 166/380, 207, 212

See application file for complete search history.

(56) References Cited

U.S. PATENT DOCUMENTS 5,901,789 A 5/1999 Donnelly et al.
6,050,341 A 4/2000 Metcalf
6,112,818 A 9/2000 Campbell
6,135,208 A * 10/2000 Gano et al. ..... 166/313
6,138,761 A 10/2000 Freeman et al.
6,142,230 A 11/2000 Smalley et al.
6,253,846 B1 7/2001 Nazzai et al.
6,263,966 B1 7/2001 Haut et al.
6,263,968 B1 7/2001 Freeman et al.
6,322,109 B1 11/2001 Campbell et al.
6,390,201 B1 5/2002 Coon et al.
6,409,175 B1 6/2002 Evans et al.
6,415,509 B1 7/2002 Echols et al.
6,419,025 B1 7/2002 Lohbeck et al.
6,425,444 B1 7/2002 Metcalfe et al.
6,446,323 B1 9/2002 Metcalfe et al.
6,470,966 B2 10/2002 Cook et al.
6,478,518 B1 11/2002 Hwang
6,510,896 B2 1/2003 Bode et al.
6,543,545 B1 4/2003 Chatterji et al.
6,564,870 B1 5/2003 Grigsby et al.

(Continued)

OTHER PUBLICATIONS

Stockmeyer, Carl F., et al., "Expandable Monobore Drilling Liner Extension Technology: Applications and Implementations Following the First Commercial Introduction and Deployment", SPE 113901, Jun. 1-13, 2008.

(Continued)

*Primary Examiner* — David Andrews
(74) *Attorney, Agent, or Firm* — Steve Rosenblatt

(57) ABSTRACT

An expansion assembly is run into the well as the expandable liner is made up. A work string is tagged into the expansion assembly and run to depth. Pressure drives the swage to initially expand and move uphole with the attached work string until the liner is expanded to set at least one external packer. The balance of the expansion in the uphole direction is continued until the string is expanded into sealing support of a higher string in the wellbore and the variable swage comes out of the hole with the work string. A shoe is milled out and the process can be repeated.

22 Claims, 54 Drawing Sheets

U.S. PATENT DOCUMENTS 6,571,871 B2 6/2003 Lauritzen et al.
6,585,053 B2 7/2003 Coon
6,598,678 B1 7/2003 Simpson et al.
6,604,763 B1 8/2003 Cook et al.
6,619,401 B2 9/2003 Echols et al.
6,631,760 B2 10/2003 Cook et al.
6,634,431 B2 10/2003 Cook et al.
6,640,903 B1 11/2003 Cook et al.
6,655,459 B2 12/2003 Makay
6,662,876 B2 12/2003 Lauritzen
6,668,930 B2 12/2003 Hoffman
6,681,862 B2 1/2004 Freeman
6,688,395 B2 2/2004 Maguire et al.
6,688,400 B2 2/2004 Metcalfe et al.
6,705,395 B2 3/2004 Cook et al.
6,712,142 B2 3/2004 Simpson et al.
6,722,427 B2 4/2004 Gano et al.
6,725,918 B2 4/2004 Gano
6,732,806 B2 5/2004 Mauldin et al.
6,745,845 B2 6/2004 Cook et al.
6,758,278 B2 7/2004 Cook et al.
6,766,862 B2 7/2004 Chatterji et al.
6,782,953 B2 8/2004 Maguire et al.
6,789,822 B1 9/2004 Metcalfe
6,808,022 B2 10/2004 Smith
6,823,937 B1 11/2004 Cook et al.
6,832,649 B2 12/2004 Bode et al.
6,832,725 B2 12/2004 Gardiner et al.
6,845,820 B1 1/2005 Hebert et al.
6,854,521 B2 2/2005 Echols et al.
6,857,473 B2 2/2005 Cook et al.
6,877,567 B2 4/2005 Hirth
6,907,937 B2 6/2005 Whanger et al.
6,915,855 B2 7/2005 Steele et al.
6,920,935 B2 7/2005 Metcalfe
6,923,261 B2 8/2005 Metcalfe et al.
6,938,694 B2 9/2005 Rudd
6,941,652 B2 9/2005 Echols et al.
6,966,369 B2 11/2005 Harrall et al.
6,971,450 B2 12/2005 Mackay
6,971,685 B2 12/2005 Hashem
6,976,539 B2 12/2005 Metcalfe et al.
6,976,541 B2 12/2005 Brisco et al.
7,000,695 B2 2/2006 Steele et al.
7,000,704 B2 2/2006 Smith
7,011,161 B2 3/2006 Ring et al.
7,021,390 B2 4/2006 Cook et al.
7,032,679 B2 4/2006 Maguire et al.
7,040,396 B2 5/2006 Cook et al.
7,040,404 B2 5/2006 Brothers et al.
7,048,048 B2 5/2006 Nguyen et al.
7,048,065 B2 5/2006 Badrak et al.
7,048,067 B1 5/2006 Cook et al.
7,066,259 B2 6/2006 Duggan et al.
7,066,271 B2 6/2006 Chen et al.
7,070,001 B2 7/2006 Whanger et al.
7,073,599 B2 7/2006 Smith
7,077,197 B2 7/2006 Harrall
7,077,210 B2 7/2006 MacKay et al.
7,086,478 B2 8/2006 Simpson et al.
7,100,685 B2 9/2006 Cook et al.
7,104,007 B2 9/2006 Weder et al.
7,108,062 B2 9/2006 Castano-Mears et al.
7,108,083 B2 9/2006 Simonds et al.
7,117,941 B1 10/2006 Gano et al.
7,117,957 B2 10/2006 Metcalfe et al.
7,121,352 B2 10/2006 Cook et al.
7,124,821 B2 10/2006 Metcalfe et al.
7,124,826 B2 10/2006 Simpson
7,124,830 B2 10/2006 Metcalfe
7,140,430 B2 11/2006 Wubben
7,146,702 B2 12/2006 Cook et al.
7,147,053 B2 12/2006 Cook et al.
7,152,687 B2 12/2006 Gano
7,159,665 B2 1/2007 Cook
7,172,019 B2 2/2007 Cook et al.
7,172,021 B2 2/2007 Brisco et al.
7,172,024 B2 2/2007 Cook et al.
7,174,964 B2 2/2007 Cook et al.
7,213,643 B2 5/2007 Chen et al.
7,213,647 B2 5/2007 Brothers et al.
7,225,523 B2 6/2007 Metcalfe
7,225,879 B2 6/2007 Wylie et al.
7,231,985 B2 6/2007 Cook et al.
7,234,526 B2 6/2007 Steele et al.
7,240,728 B2 7/2007 Cook et al.
7,243,731 B2 7/2007 Watson et al.
7,246,667 B2 7/2007 Cook et al.
7,255,171 B2 8/2007 Rudd
7,255,176 B2 8/2007 Adam et al.
7,255,177 B2 8/2007 Duggan et al.
7,270,188 B2 9/2007 Cook et al.
7,275,602 B2 10/2007 Green et al.
7,303,023 B2 12/2007 Harrall et al.
7,322,420 B2 1/2008 Trinder et al.
7,325,602 B2 2/2008 Cook et al.
7,341,117 B2 3/2008 Wylie et al.
7,357,188 B1 4/2008 Cook et al.
7,370,699 B2 5/2008 Adam et al.
7,380,604 B2 6/2008 Adam et al.
7,434,618 B2 10/2008 Cook et al.
7,438,132 B2 10/2008 Cook et al.
7,458,422 B2 12/2008 Adam et al.
7,585,002 B2 9/2009 Curley et al.
7,708,060 B2 5/2010 Adam et al.
7,987,905 B2 8/2011 Adam et al.
2006/0054330 A1* 3/2006 Ring et al. ..... 166/380
2006/0225892 A1 10/2006 Watson et al.
2006/0272827 A1* 12/2006 Adam et al. ..... 166/380
2006/0283603 A1 12/2006 Shuster et al.
2008/0006403 A1 1/2008 Benzie et al.

OTHER PUBLICATIONS

Jabs, Matthew, "World's First Expandable Monobore Well System: Development, Implementation, and Significance", IPTC 11587, Dec. 1-6, 2007.

Stockmeyer, Carl F., et al., "Expandable-Drilling-Liner Technology: First Commercial Deployment of a Monobore Liner Extension", SPE 108331, Sep. 1-10, 2007.

* cited by examiner

METHOD AND APPARATUS FOR EXPANDED LINER EXTENSION USING UPHOLE EXPANSION

FIELD OF THE INVENTION

The field of the invention relates to techniques for tubular expansion and sealing in open hole with attachment techniques to an existing tubular.

BACKGROUND OF THE INVENTION

Various techniques have been developed to expand liners and attach them to existing casing already in the wellbore. Some of these techniques involve running a liner with a wide bell at the bottom where the expansion equipment is located and then driving the swage up the liner and out the top and along the way setting external seals to the surrounding casing as the swage makes an exit. One such process is shown in U.S. Pat. No. 6,470,966. The extensive list of prior art included in that patent is representative of the state of the art in downhole tubular expansion techniques that include attachment to an existing tubular. Other patents show the use of swages that include a series of retractable rollers that can be radially extended downhole to initiate a tubular expansion such as of a casing patch as for example is illustrated in U.S. Pat. No. 6,668,930. Some devices swage in a top to bottom direction as illustrated in U.S. Pat. No. 6,705,395.

What is needed and addressed by the present invention are refinements to the previous techniques that improve performance, mitigate risk and save time to reduce the cost to the operator. Techniques involving expansion in stages coupled with cementing in between are envisioned. An adjustable swage to expand on location removes the need for oversized bells to house the expansion equipment as done in some techniques. Techniques using cement or just sealing externally in open hole are envisioned. Composite materials facilitate subsequent drill out while improved shoe configuration improves circulation when tripping into the hole. The shoe and/or liner can be rotationally locked to work the string for delivery downhole. These and other advantages will become more apparent to one skilled in the art from a review of the description of the preferred embodiments and the associated drawings, while recognizing that the full scope of the invention is given by the claims.

SUMMARY OF THE INVENTION

An expansion and cementing assembly is run into the well as the expandable liner is made up. A work string is tagged into the expansion assembly and run to depth. Pressure drives the swage to initially expand and move uphole with the attached work string until the liner is expanded above the location of the subsequent cement placement. The assembly is then lowered to engage the guide/float shoe to perform the cementing step. The swage assembly is then released from the guide/float shoe and the balance of the expansion is performed without further expansion against the recently placed cement. The expansion assembly can start at the guide/float shoe or higher, in which case expansion can occur initially in a downhole direction and later be completed in an uphole direction. Variations without cementing are also contemplated.

BRIEF DESCRIPTION OF THE DRAWINGS

FIG. 3 is the view of FIG. 2 with the swage assembly being run in;

FIG. 4 is the view of FIG. 3 with the circulation established through the swage assembly and the float shoe as the liner is run in;

DETAILED DESCRIPTION OF THE PREFERRED EMBODIMENT

Figure 1:
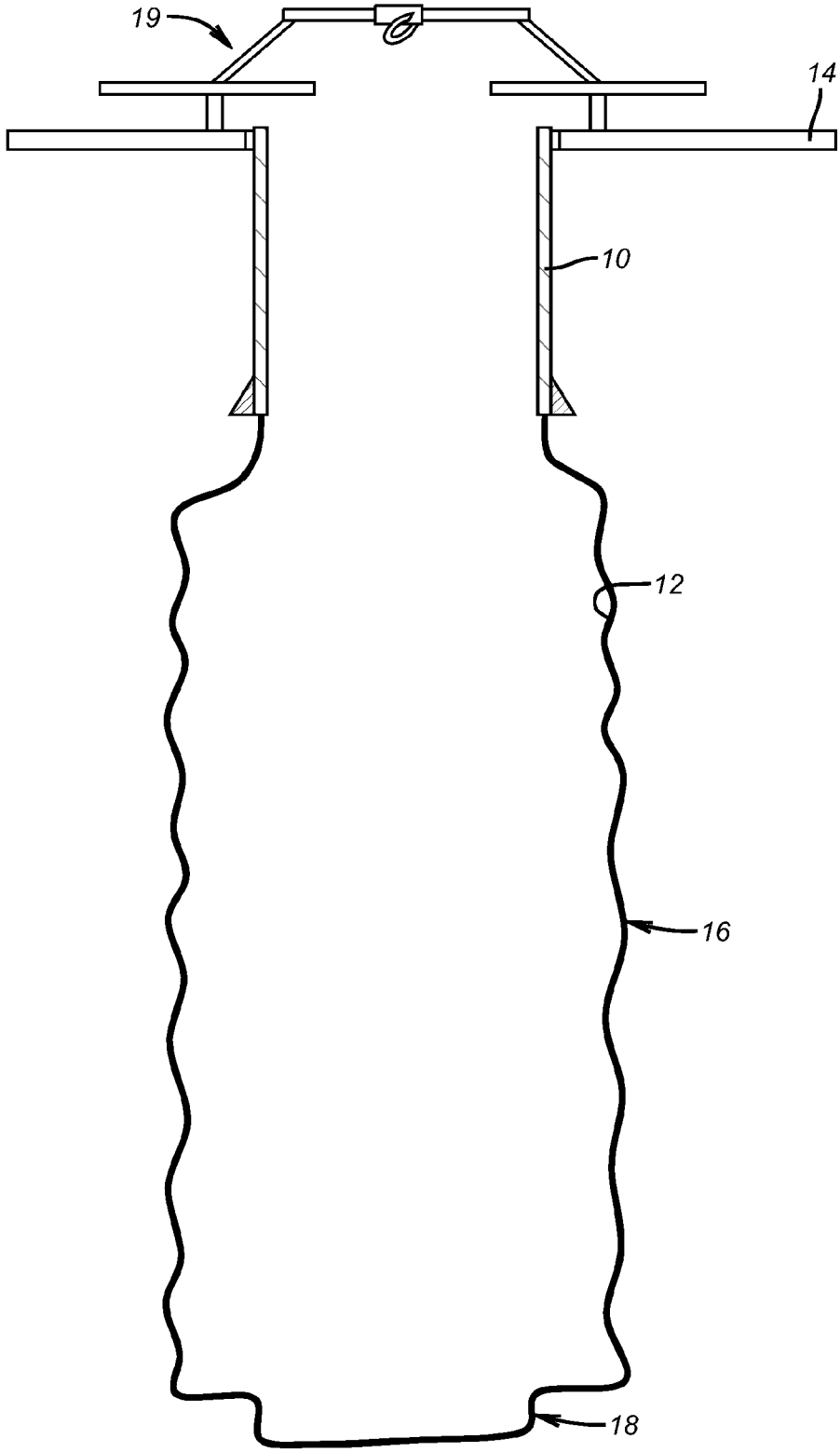
FIG. 1 is a view of a wellbore that has been cased with an open hole segment below.
Figure 2:
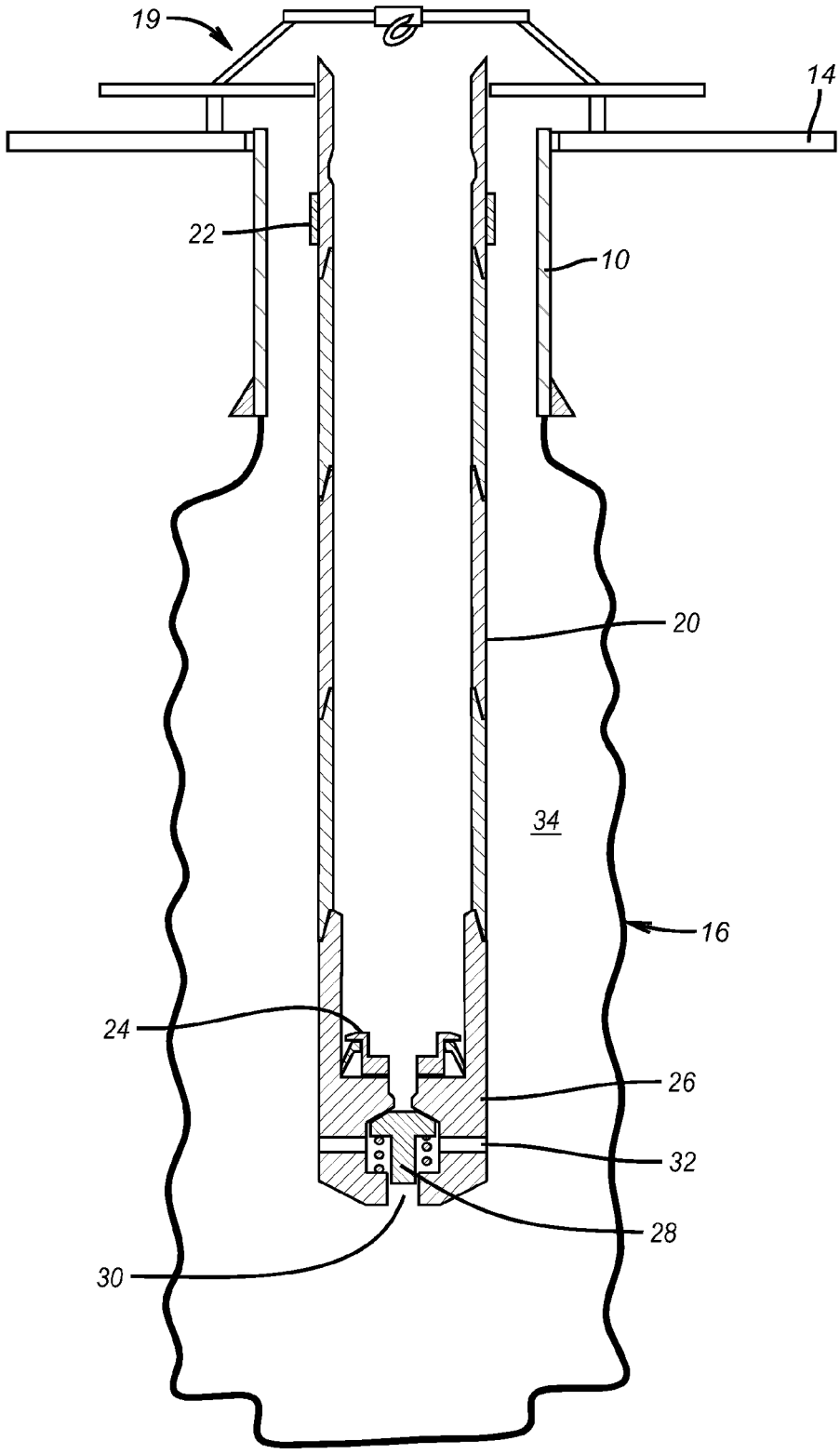
FIG. 2 is the view of FIG. 1 showing a liner with a float shoe inserted into the open hole segment through the casing.

FIG. 1 shows casing 10 in a wellbore 12 that extends from the surface 14. The open hole portion 16 has a pilot hole 18 at the lower end. A rig 19 is illustrated schematically at the surface 14. In FIG. 2 a liner 20 is supported from the rig 19 and extends into the open hole 16. Liner 20 has a hanger/packer 22 on the outside that will eventually support the liner 20 and seal it to the casing 10. A sealed latch assembly 24 is located inside the float shoe 26. Float shoe 26 has a spring loaded one way valve 28 as well as a bottom exit 30 as well as side exits 32. The side exits promote well conditioning during circulation when running in the liner 20. The float shoe 26 allows flow in the liner 20 to exit but prevents reverse flow such as cement later pumped through the liner 20 and into the surrounding annulus 34. The float shoe 26 can also be made of a soft composite material or other similar materials that promote rapid drill out after the cementing is completed.

Figure 3:
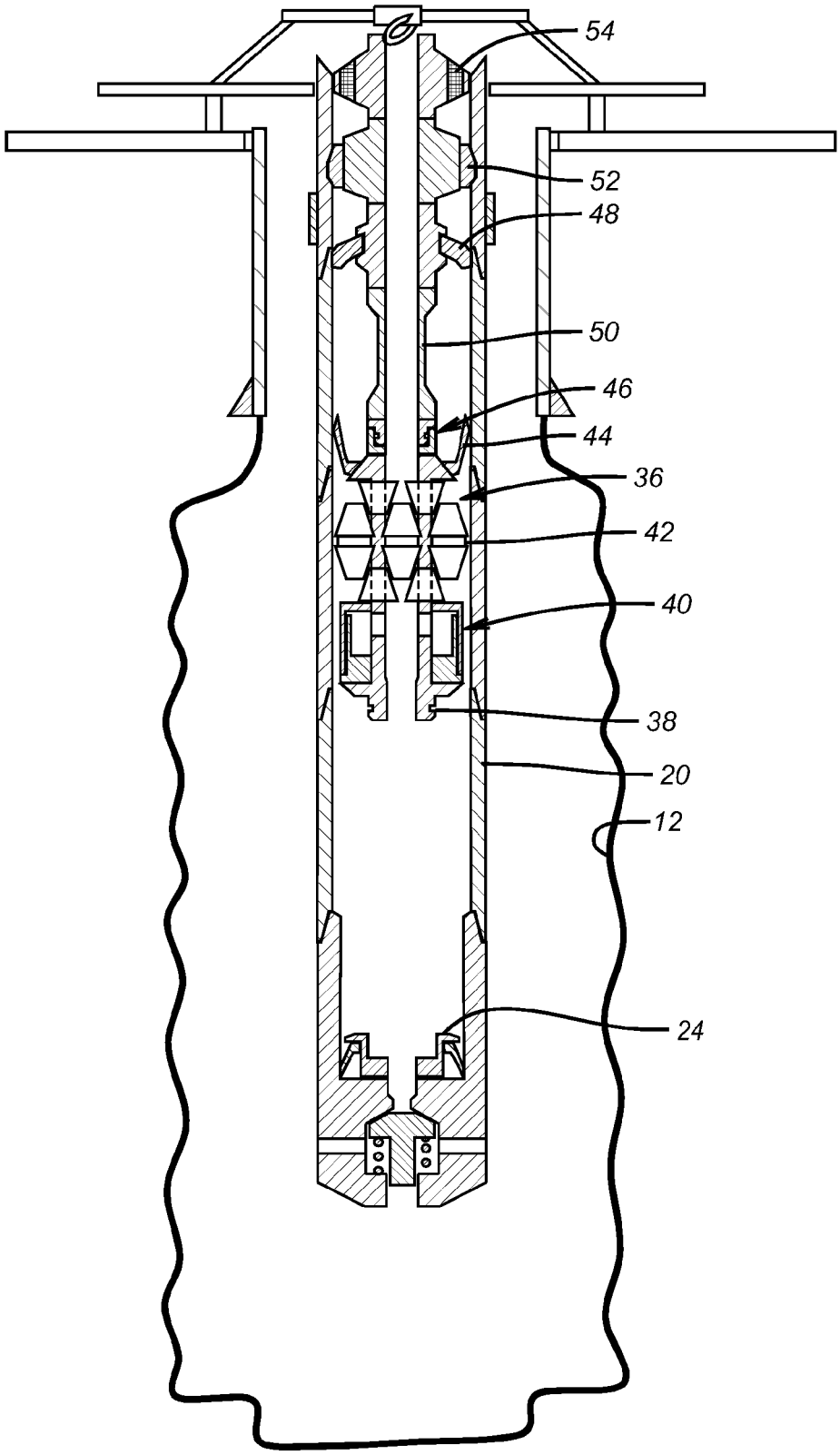

FIG. 3 shows the insertion of an assembly 36 that comprises from the bottom up a latch component 38 designed to seal and latch to component 24 when brought into contact with it. Further uphole is a piston assembly 40 designed to selectively change the size of the adjustable swage 42 such as is illustrated in U.S. Pat. No. 7,128,146, for example. Further up is an uphole oriented swab cup 44 and a disconnect 46. A section of pipe 50 spaces the lower swab cup 44 from an oppositely oriented upper swab cup 48. Further up is a running tool 52 shown gripping the interior of the liner 20 and finally an annular debris barrier 54 is designed to keep debris from getting into the liner 20 as it is circulated when being run into the well 12.

Figure 4:
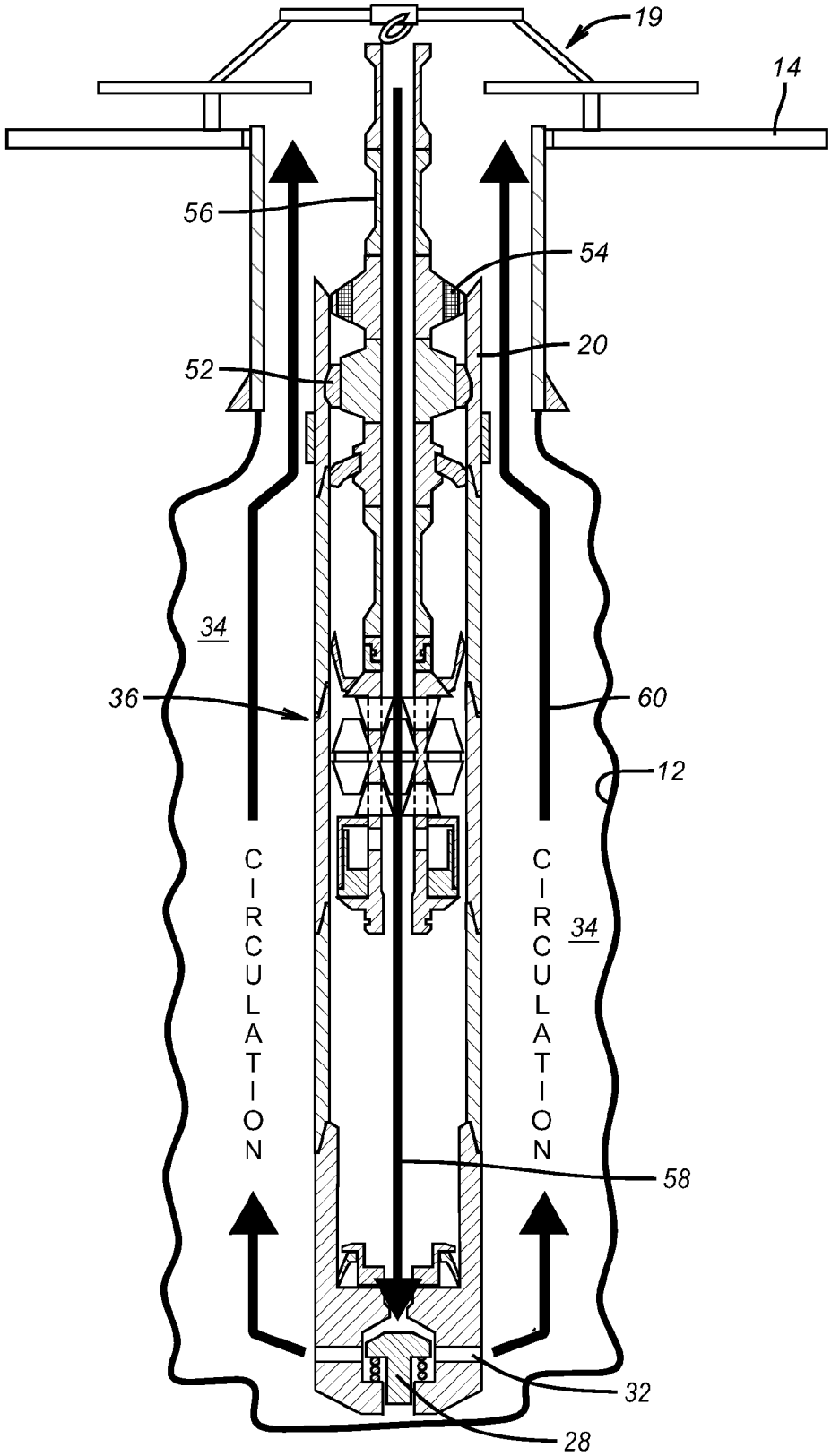

FIG. 4 shows a run in string 56 starting to be assembled above the debris barrier 54 and the liner 20 now supported through the string 56 off of rig 19 as it is delivered deeper into the wellbore with circulation through the assembly 36 represented by arrow 58 and return flow represented by arrow 60. In this view it is easy to see the function of the debris barrier 54. The valve 28 responds to delivered pressure from the surface 14 to open and let the flow out through the lateral shoe passages 32 to allow for a secondary flow path in case the bottom is plugged when resting on bottom.

Figure 5:
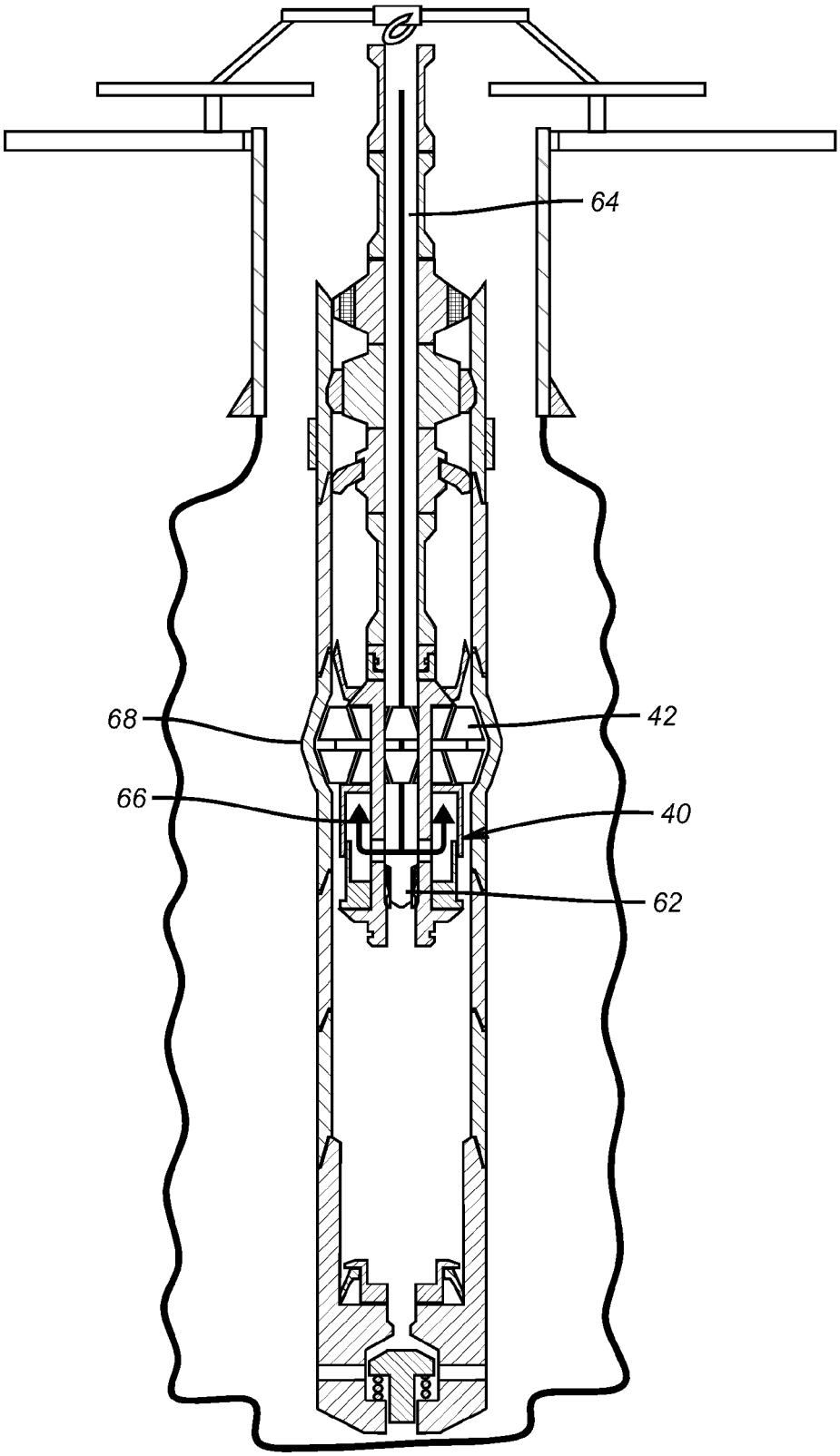
FIG. 5 is the view of FIG. 4 with the swage assembly expanded but not yet driven.

In FIG. 5 a plug or dart or some other obstructing device 62 is dropped or pumped until landed to seal off passage 64. Then with passage 64 closed at its lower end and pressurized the pressure 66 acts on piston assembly 40 as indicated by arrows 66. The swage assembly 42 grows in radial dimension to create an initial bump out 68 in the liner 20.

Figure 6:
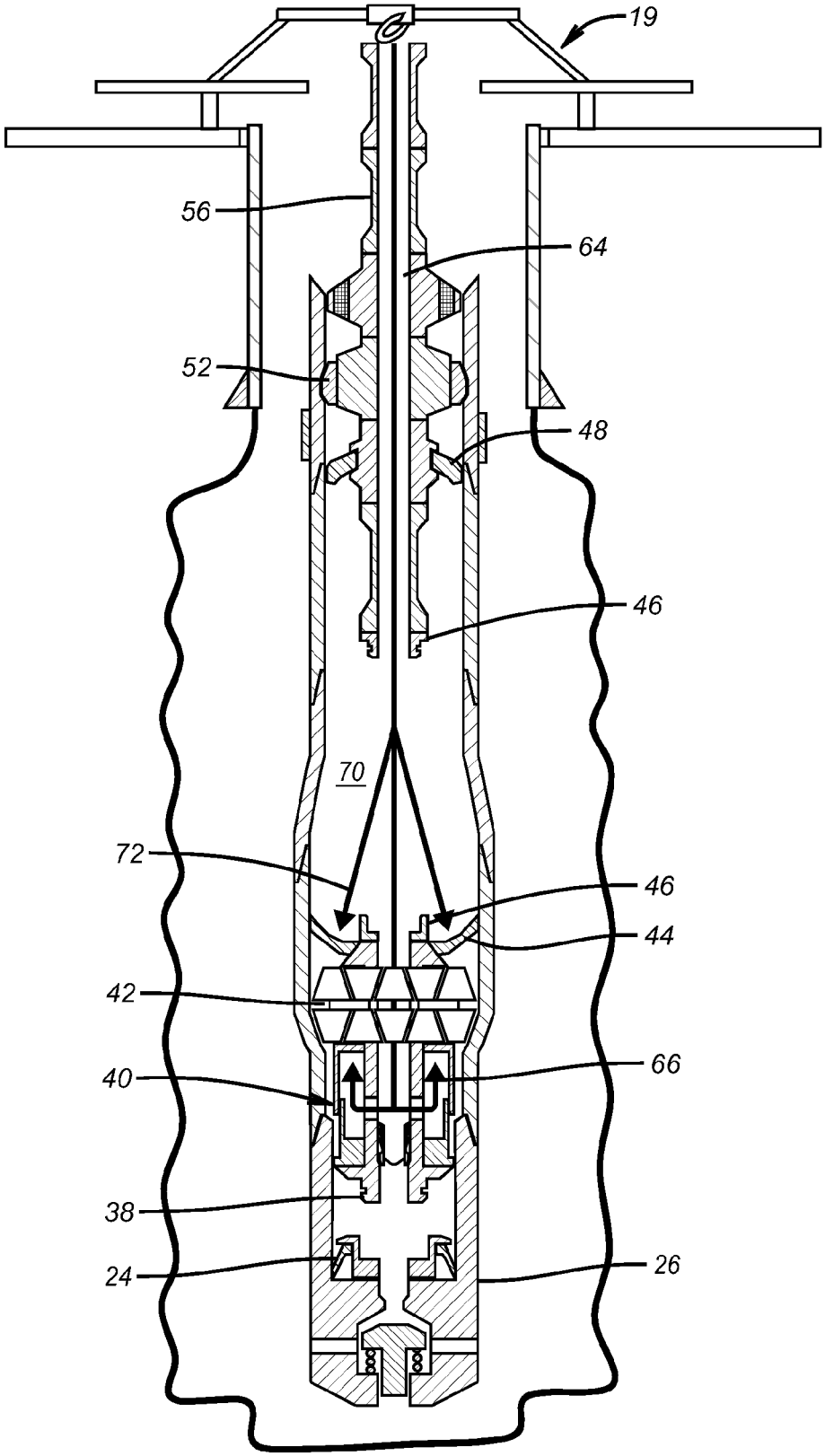
FIG. 6 is the view of FIG. 5 with the swage assembly released from the supporting string and being driven down to the float shoe.

In FIG. 6 the pressure in passage 64 has been further increased to cause a separation between components 46 so that the applied pressure in passage 64 now can enter space 70 as indicated by arrows 72. That pressure acts on lower swab cup 44 that looks uphole while the liner 20 which is gripped by running tool 52 and is supported off of string 56 from rig 19 remains immobile despite uphole pressure on upper swab cup 48 which is downhole oriented. Arrows 66 indicate that pressure on the piston assembly 40 continues to keep the swage assembly 42 at an enlarged dimension as it travels toward the float shoe 26 until components 38 and 24 re-latch and seal as shown in FIG. 7.

Figure 7:
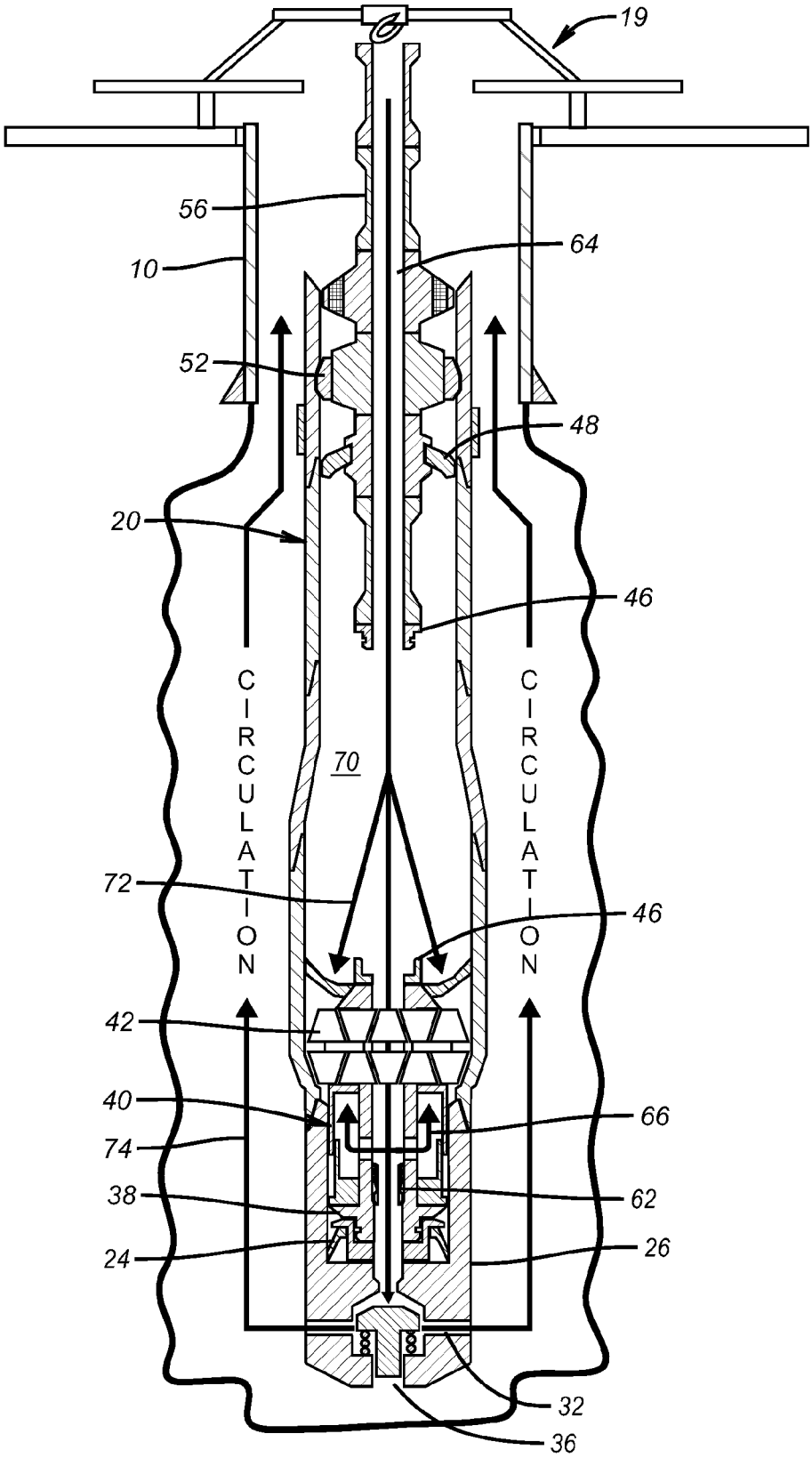
FIG. 7 is the view of FIG. 6 with the circulation re-established after the swage assembly engages the float shoe.

In FIG. 7 components 38 and 24 have latched and a pressure buildup has popped a disc internal to dart 62 so that circulation can be established with the bulk of the liner 20 below the casing 10 already expanded. Arrows 72 and 74 represent circulation flow through passages 32 and 36 in the float shoe 26.

Figure 8:
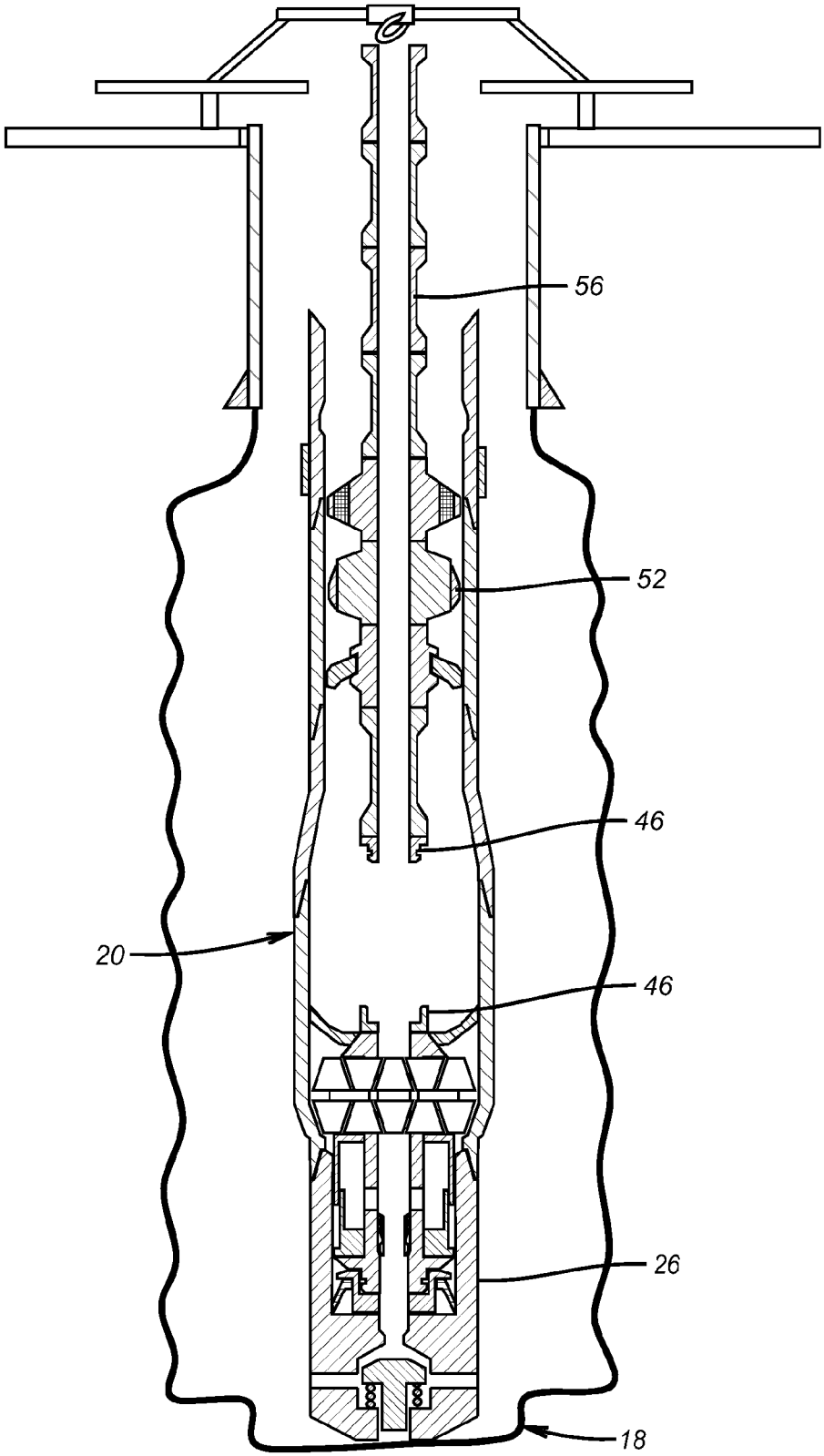
FIG. 8 is the view of FIG. 7 with the support string releasing the liner and being advanced further into the liner using additional stands added above.

FIG. 8 shows that circulation has stopped and the float shoe 28 is resting on bottom in the pilot hole 18. The string 56 is being added to at the surface 14 to again bring together the connection 46 so that cementing around the already expanded portion of the liner 20 can take place.

Figure 9:
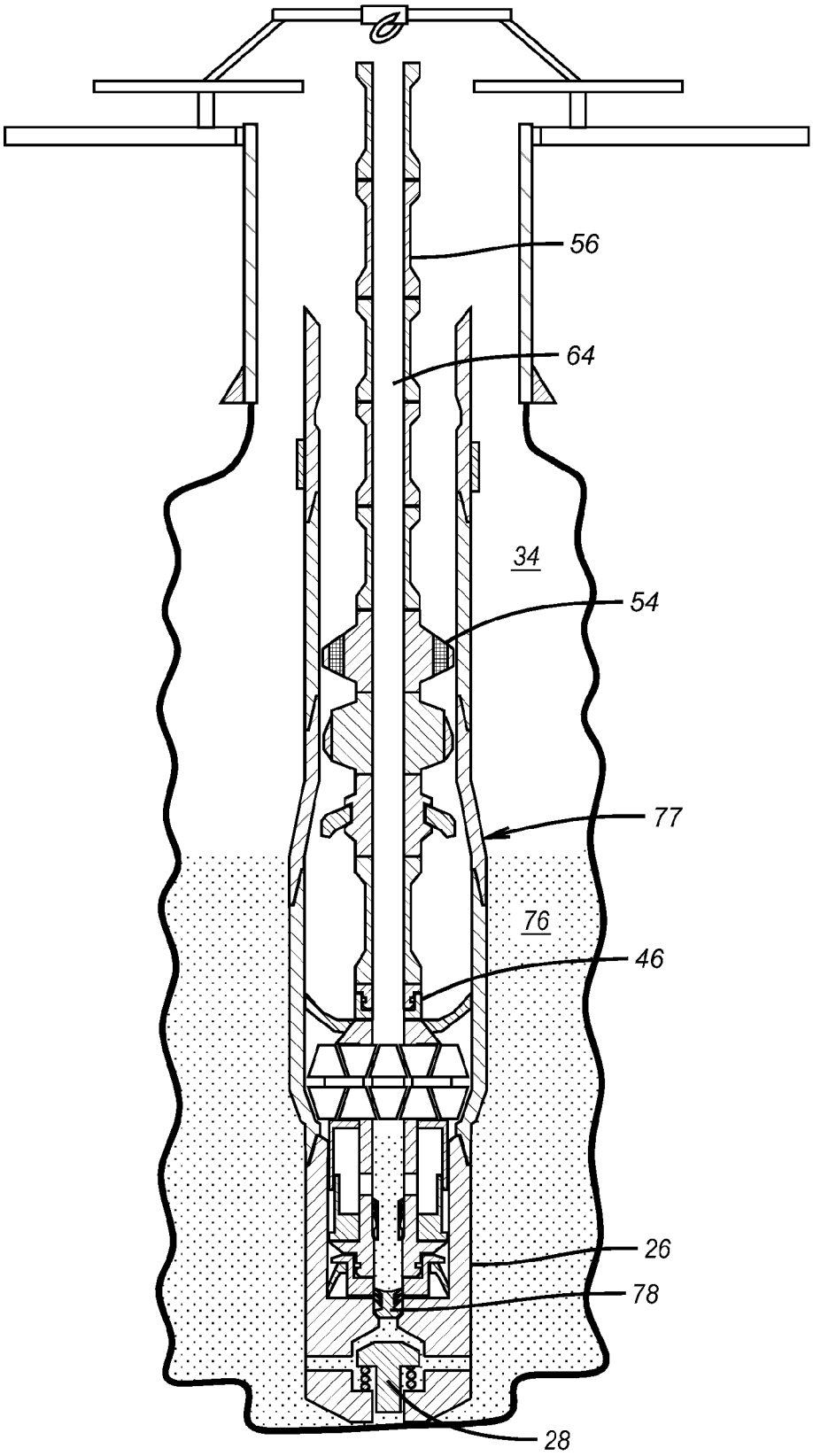
FIG. 9 is the view of FIG. 8 with the swage assembly again latched to the supporting string and cement pumped through the float shoe to fill the annulus around the already expanded liner.

In FIG. 9 the connection 46 is brought together in a sealing relationship and cement 76 is delivered into annulus 34 to the top 77 of the expanded portion of liner 20. The cement 76 goes down passage 64 and through the one way valve 28 in the float shoe 26 to the annulus 34. A wiper plug or dart 78 wipes passage 64 clear of the cement 76. Optionally some cement 76 can be pumped above plug 78 to ease subsequent drill out as shown in FIG. 10.

Figure 10:
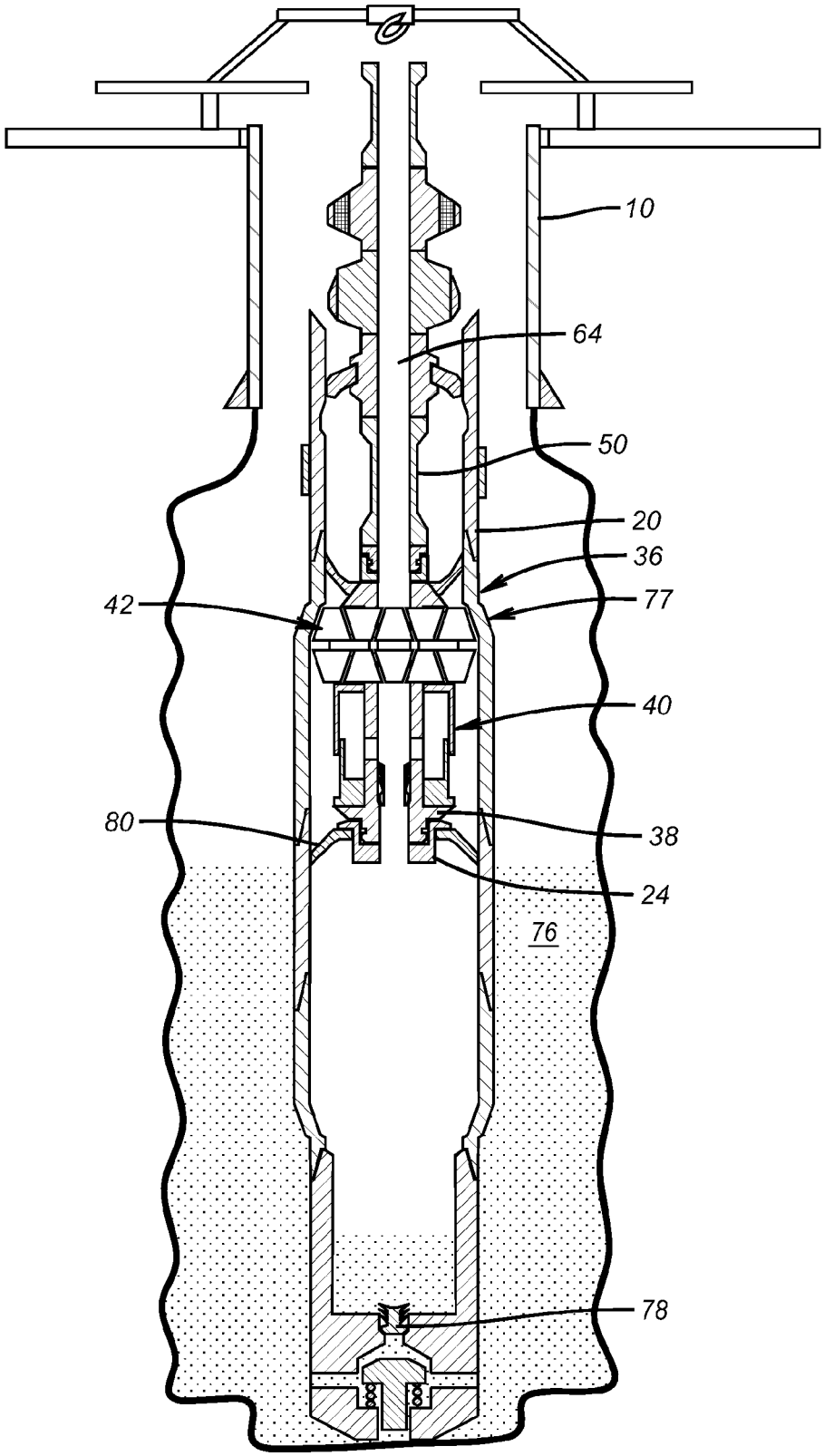
FIG. 10 is the view of FIG. 9 with the swage assembly now driven up to complete the expansion of the liner top into the casing.

In FIG. 10 with wiper plug 78 remaining landed a buildup of pressure in passage 64 builds an uphole pressure on sealed latch 24 which has a downhole oriented swab cup 80 whose presence results in an uphole force represented by arrow 82 to drive the assembly 36 uphole to finish the expansion of the liner 20 into a sealed relationship with the casing 10. The swage assembly 42 remains at maximum dimension because the piston assembly 40 is pressurized at this time as the movement uphole of the 36 continues.

Figure 11:
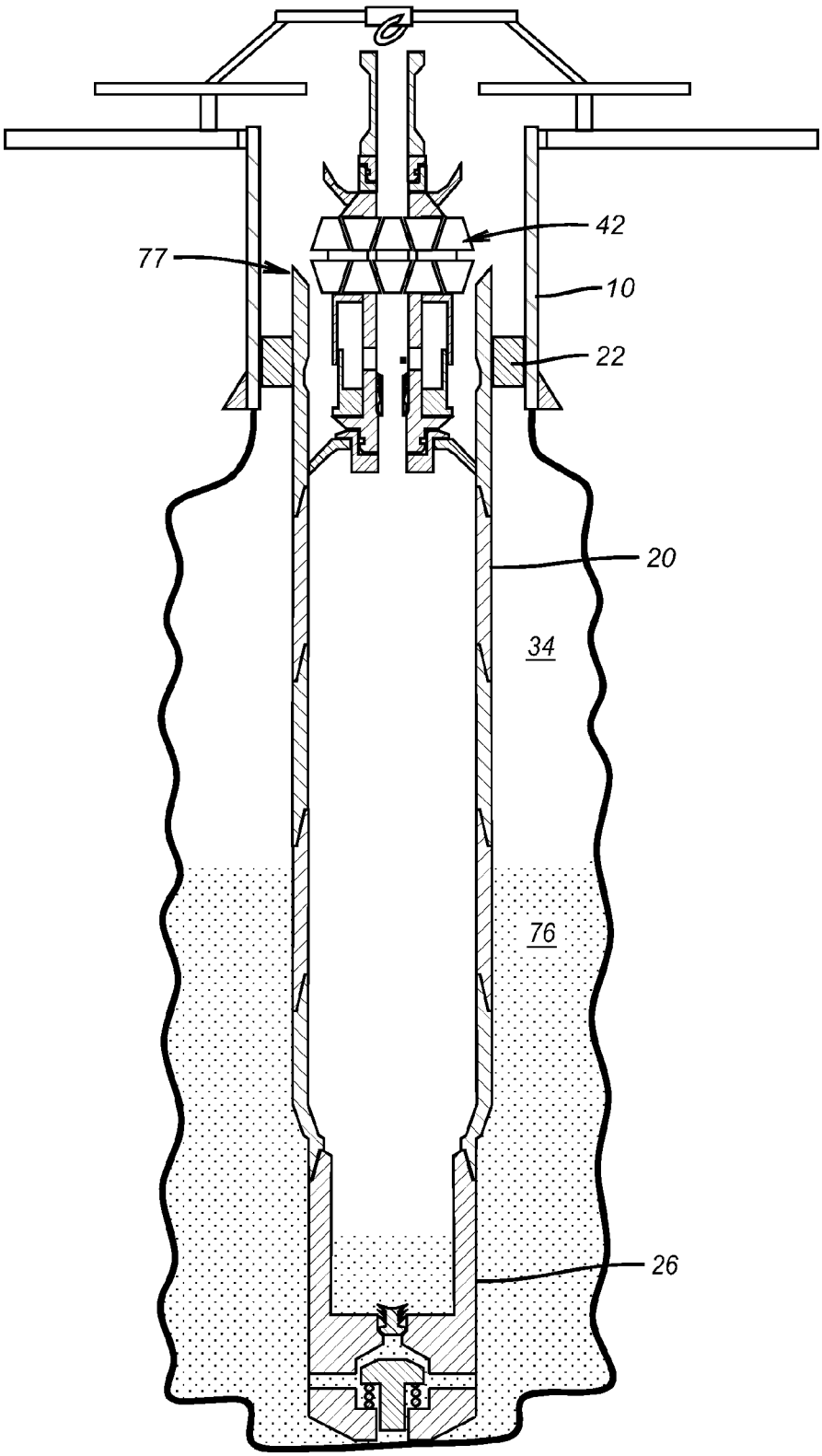
FIG. 11 is the view of FIG. 10 with the swage assembly out of the fully expanded liner and the liner hanger to the surrounding casing engaged.

FIG. 11 shows the expansion of the liner 20 to be complete and the hanger/packer 24 set to the casing 10 as a result of the conclusion of the expansion. It should be noted that the uphole oriented expansion of FIG. 10 does not occur against cement 76 already in annulus 34. Rather, expansion continues once the extended swage assembly 42 reaches the location 77 which marked the end of expansion. The assembly 36 can now come all the way out of the liner 20. The shoe 26 can now be drilled out and more hole can be drilled.

Figure 12:
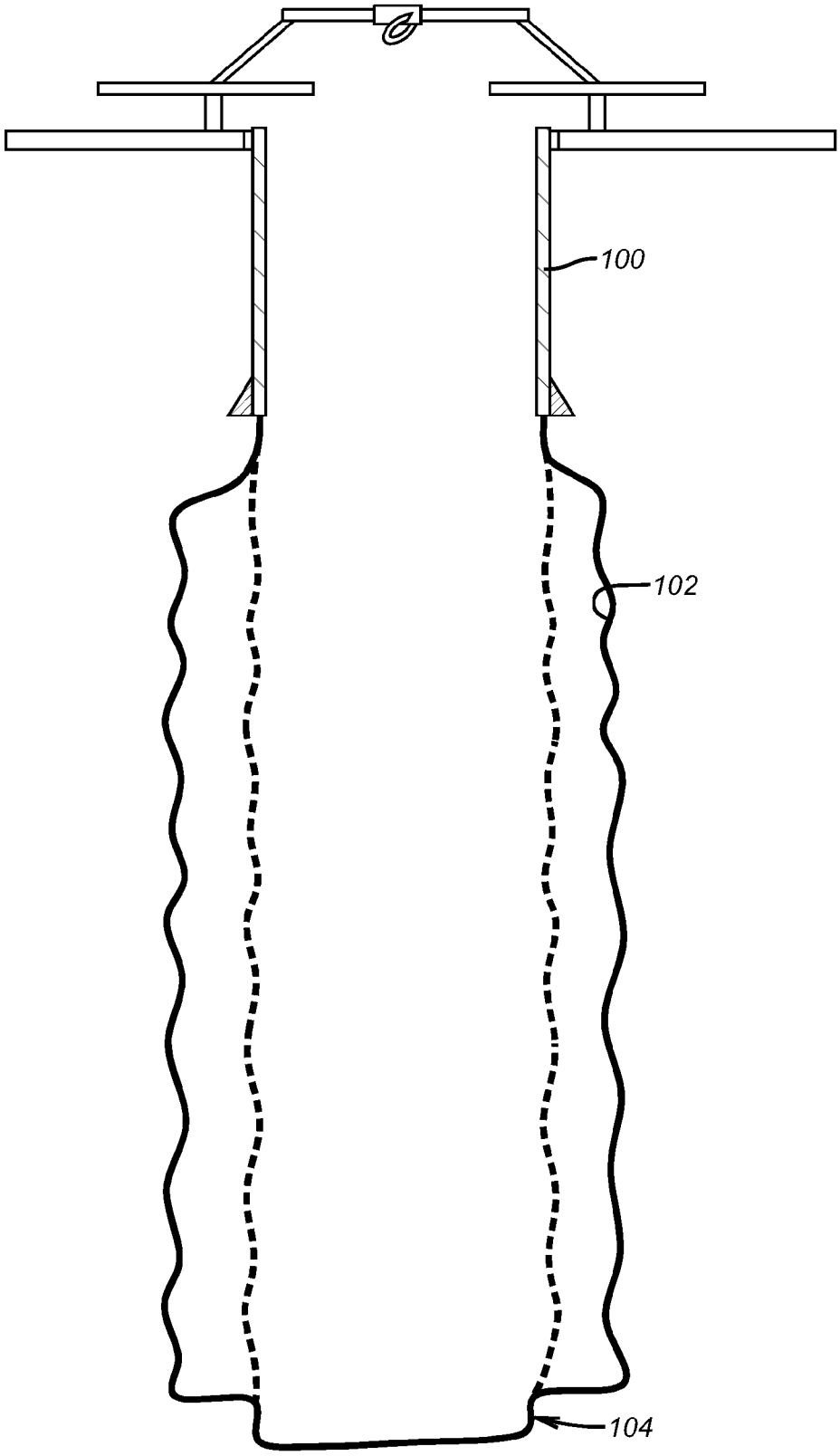
FIG. 12 is a view similar to FIG. 1 to illustrate an alternative method.
Figure 13:
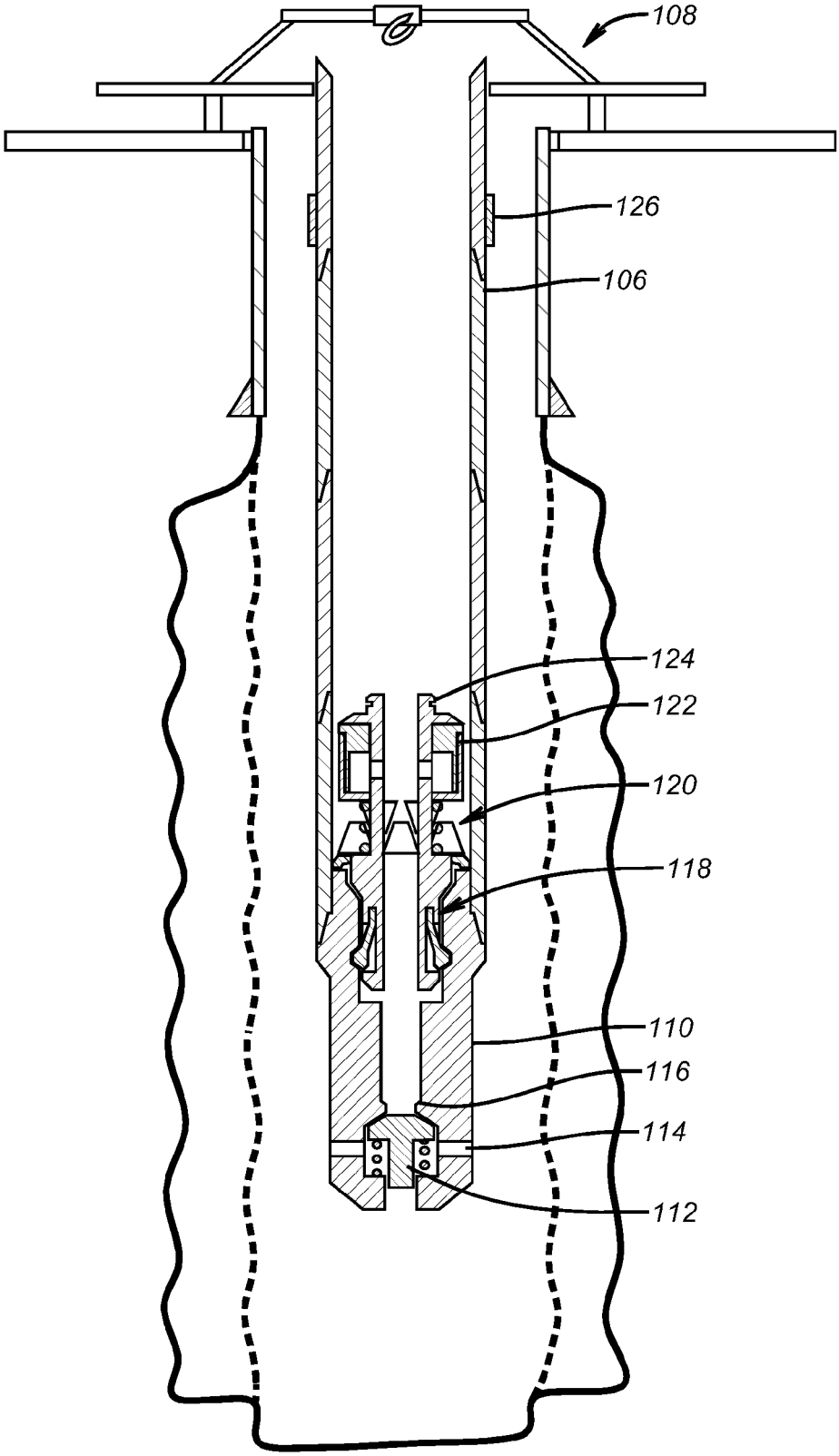
FIG. 13 is the view of FIG. 12 with the liner in the well showing a swage assembly connected to the float shoe.

FIG. 12 begins another embodiment for a well with casing 100 and an open hole portion 102 terminating in a pilot hole 104. In FIG. 13 a liner string 106 is supported from a rig 108. At the bottom of the liner 106 is a float shoe 110 with a one way valve 112 and lateral exits 114. The float shoe 110 has a seat 116 for landing a plug as will be later described. A latch assembly 118 releasably holds the swage assembly 120 and the piston assembly 122 that controls the dimension of the swage assembly 120 to the float shoe 110. Above the piston assembly 122 is one portion 124 of a latch assembly. Outside the liner 106 is a hanger/packer 126.

Figure 14:
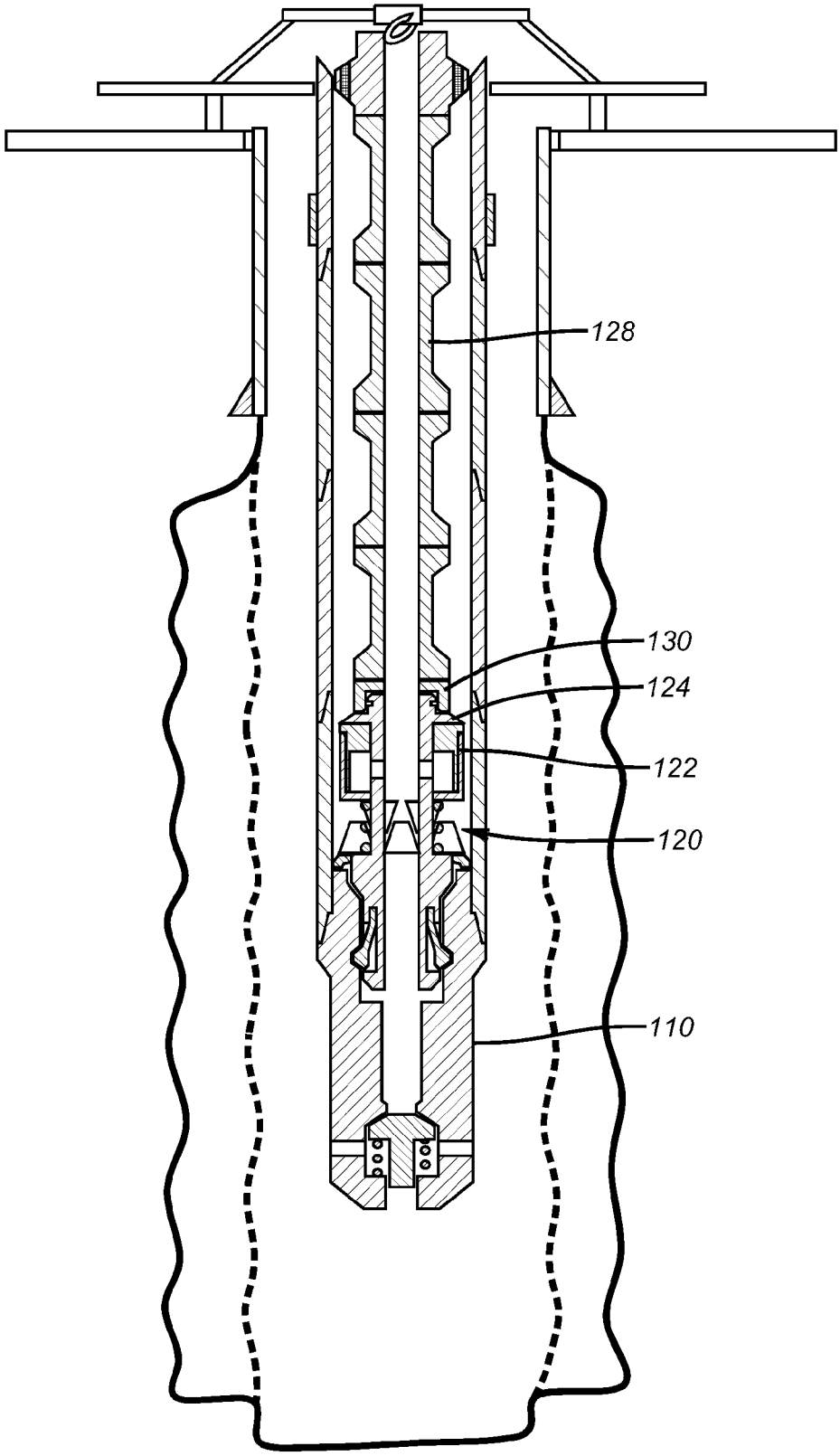
FIG. 14 is the view of FIG. 13 with the work string run in to engage the swage assembly.

FIG. 14 shows a string 128 with another portion 130 of a connection that will seal and connect to portion 124. Alternatively, the running string 128 could deliver the piston assembly 122 and the swage assembly 120 with a latch below that engages the float shoe 110. This engagement can be with a type HRD running tool sold by Baker Oil Tools or an equivalent.

Figure 15:
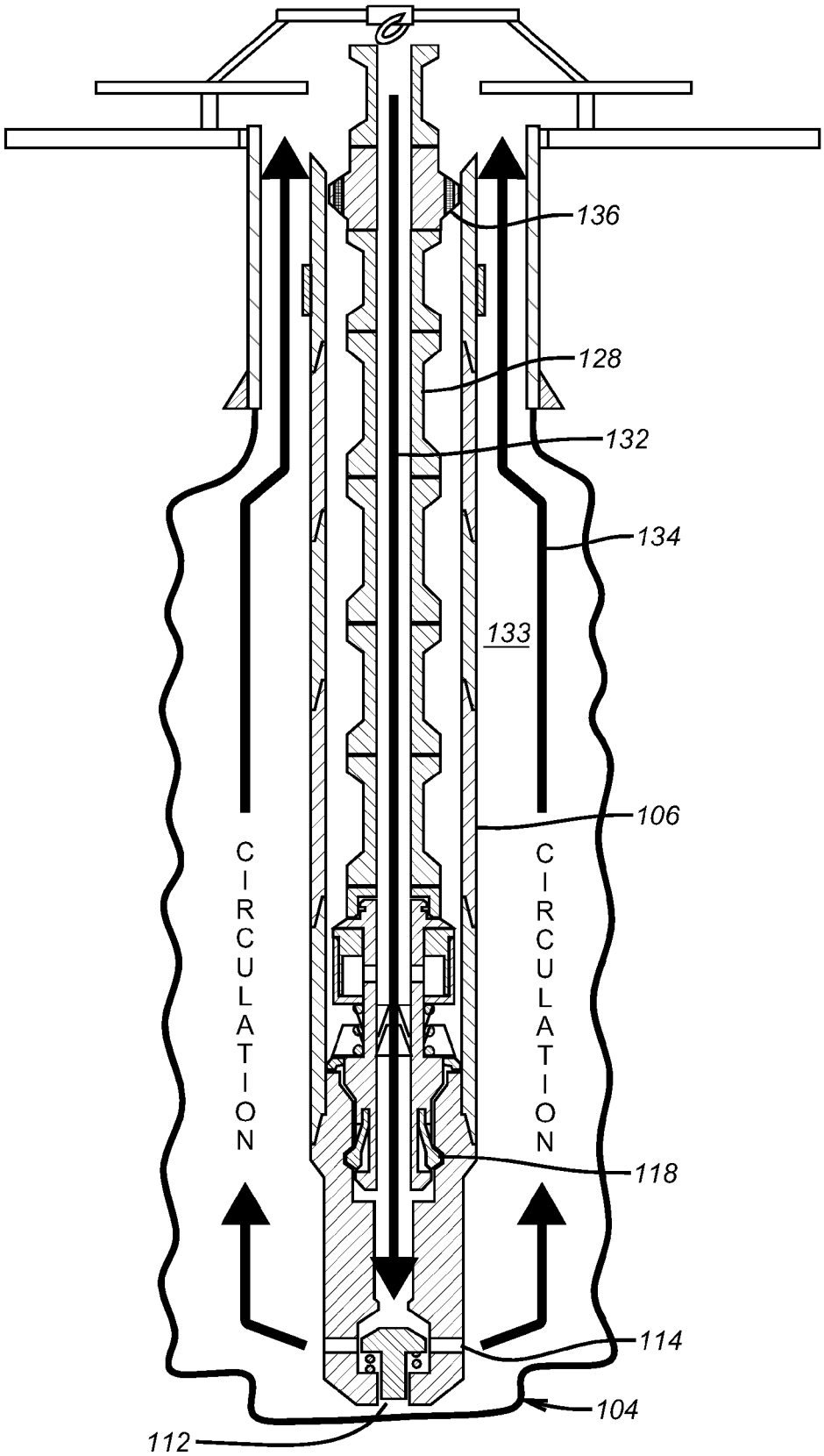
FIG. 15 is the view of FIG. 14 with the circulation established as the liner is run into the open hole.

FIG. 15 shows the liner 106 lowered to the pilot hole 104 and circulation through string 128 out ports 112 and 114 and up through the annulus 133 as represented by arrows 132 and 134 as such lowering is taking place. A debris barrier 136 is at the top of liner 106 for the reason explained before. String 128 supports the liner 106 near its lower end using latch assembly 118.

Figure 16:
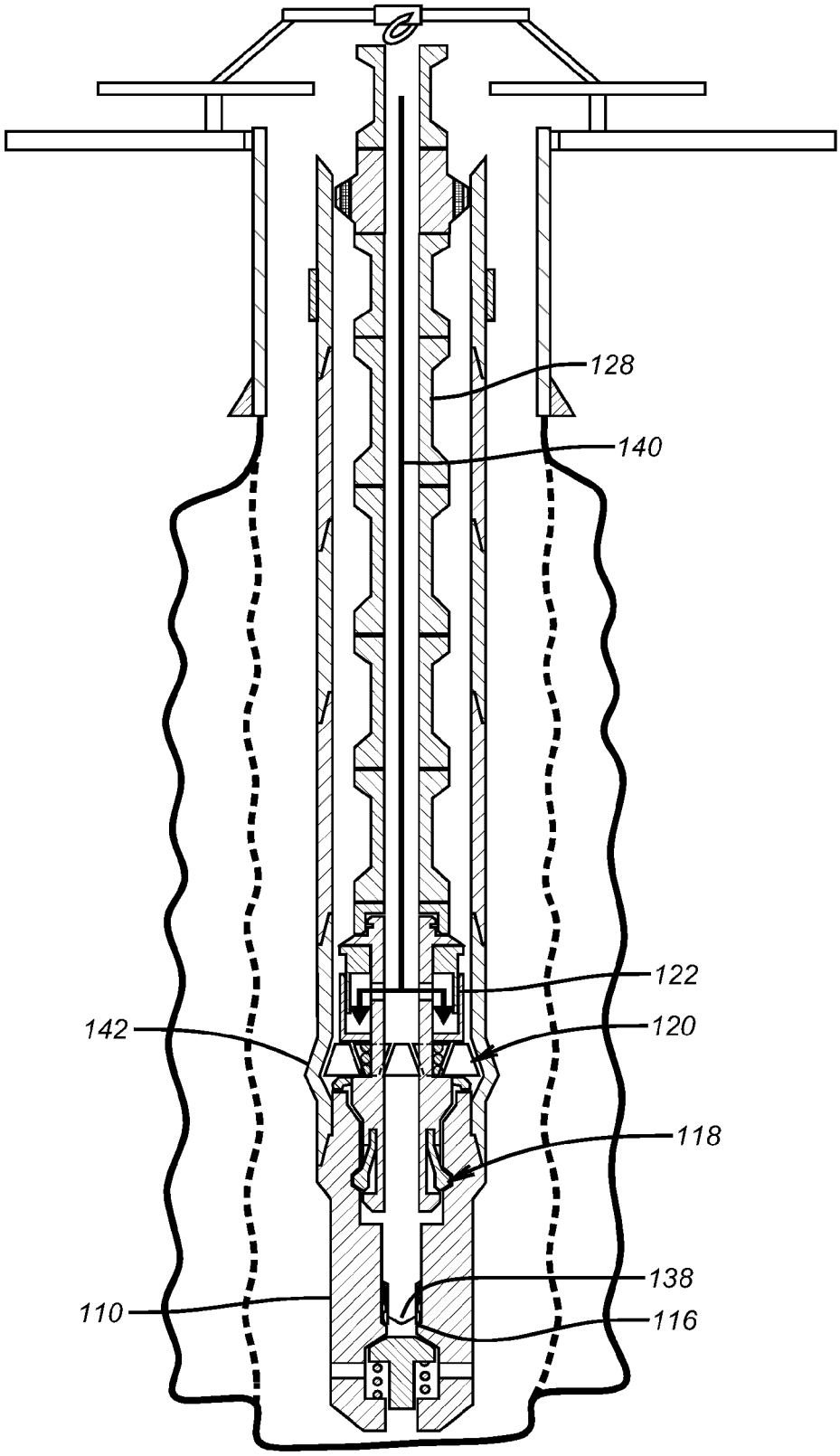
FIG. 16 is the view of FIG. 15 with the swage assembly extended in the liner.
Figure 17:
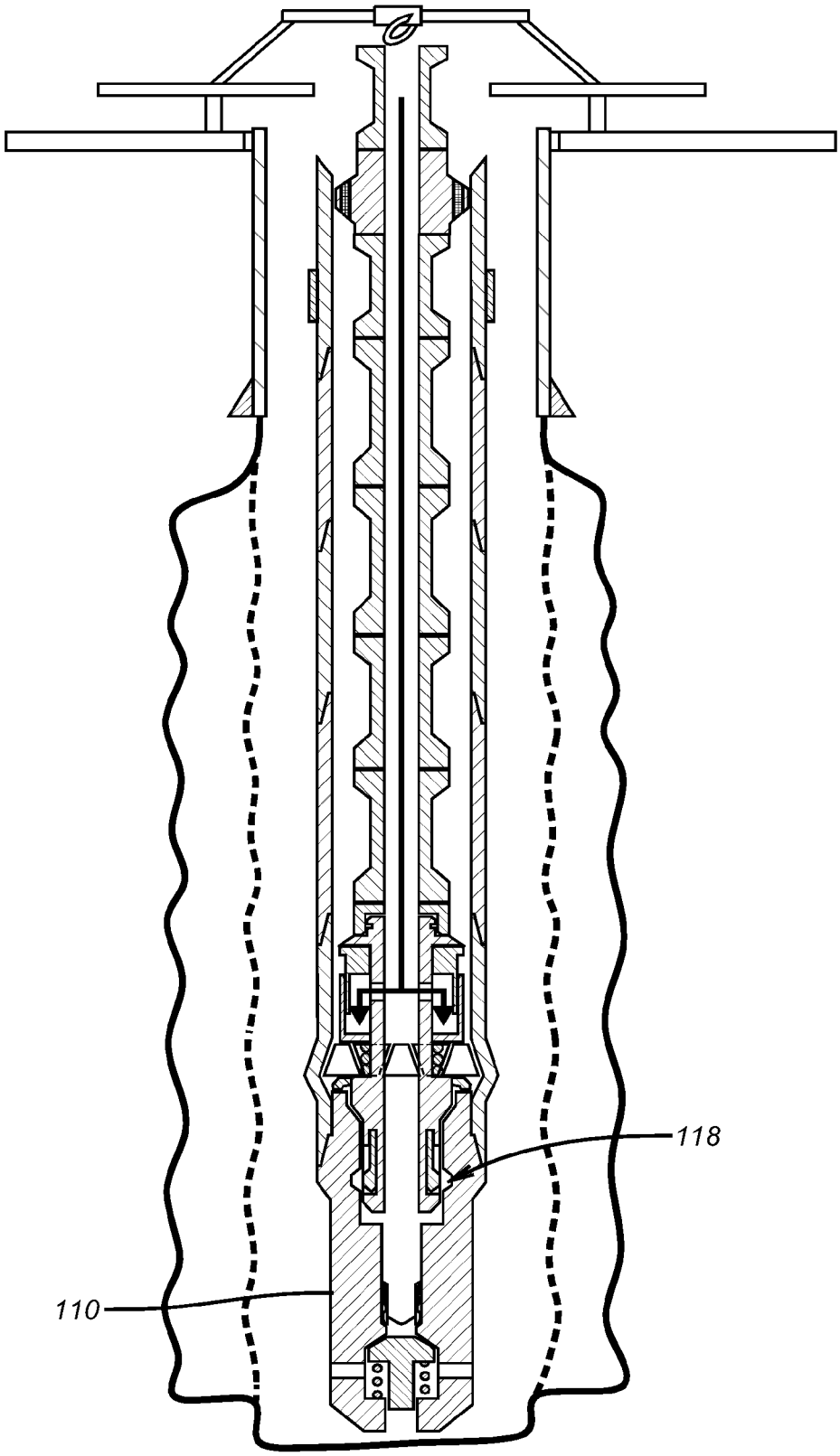
FIG. 17 is the view of FIG. 16 with the swage assembly pressure released from the float shoe and ready to move uphole.

FIG. 16 shows that circulation has stopped and a plug 138 has been landed on seat 116 to allow pressure built up in string 128 to reach the piston assembly 122 so that its movement causes the swage assembly 120 move out to a larger dimension putting a bump out 142 in liner 106. Further pressure buildup as shown in FIG. 17 releases the latch connection 118 to the float shoe 110.

Figure 18:
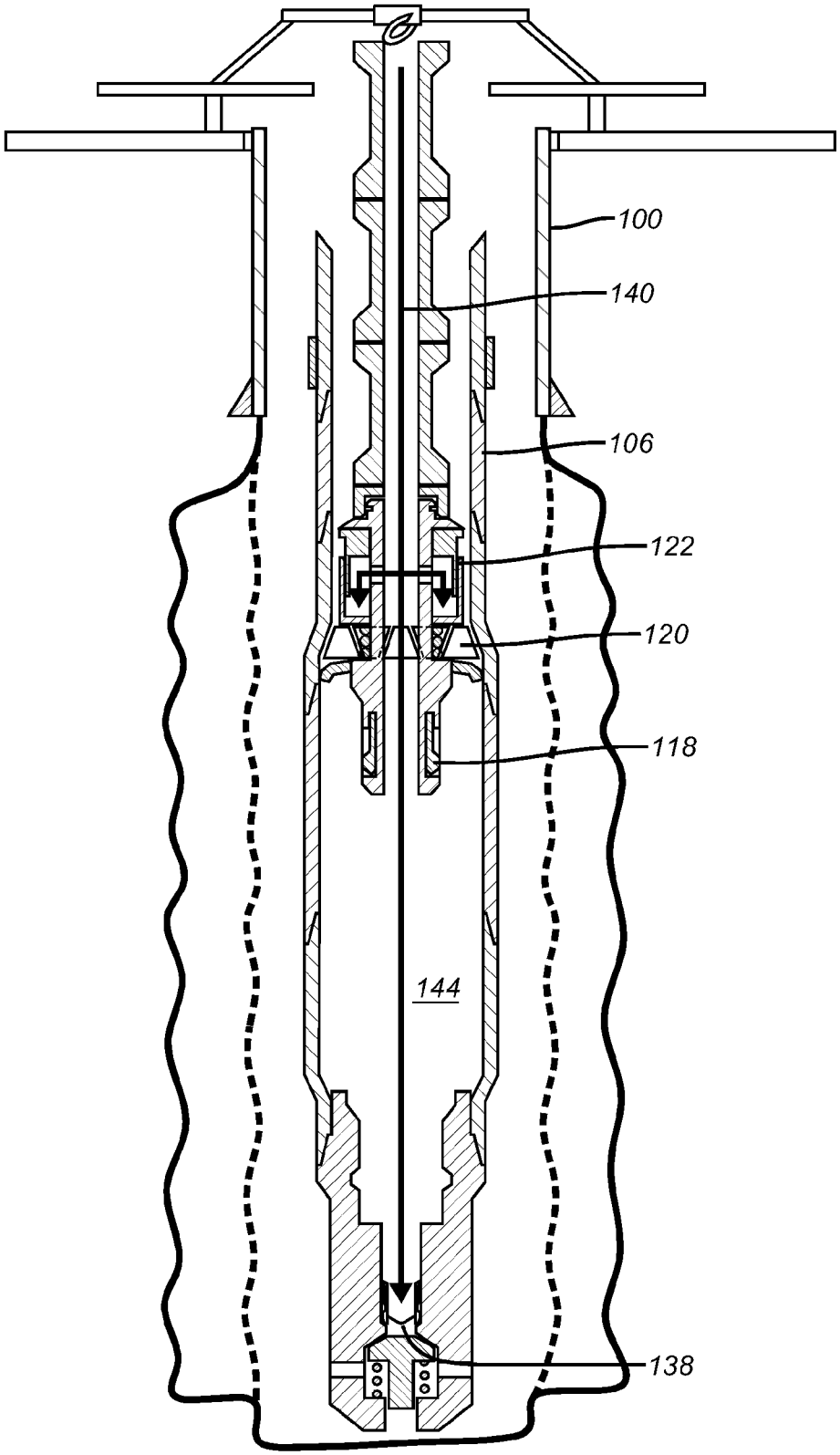
FIG. 18 is the view of FIG. 17 with the swage assembly driven uphole.

FIG. 18 shows pressure buildup against the plug 138 increasing the volume of chamber 144 as the swage assembly 120 continues to hold its enlarged dimension by virtue of continuous pressure on the piston assembly 122 schematically represented by arrow 140. The uphole expansion is allowed to continue to a point below the bottom of the casing 100 but leaves the liner 106 expanded over substantially its entire length.

Figure 19:
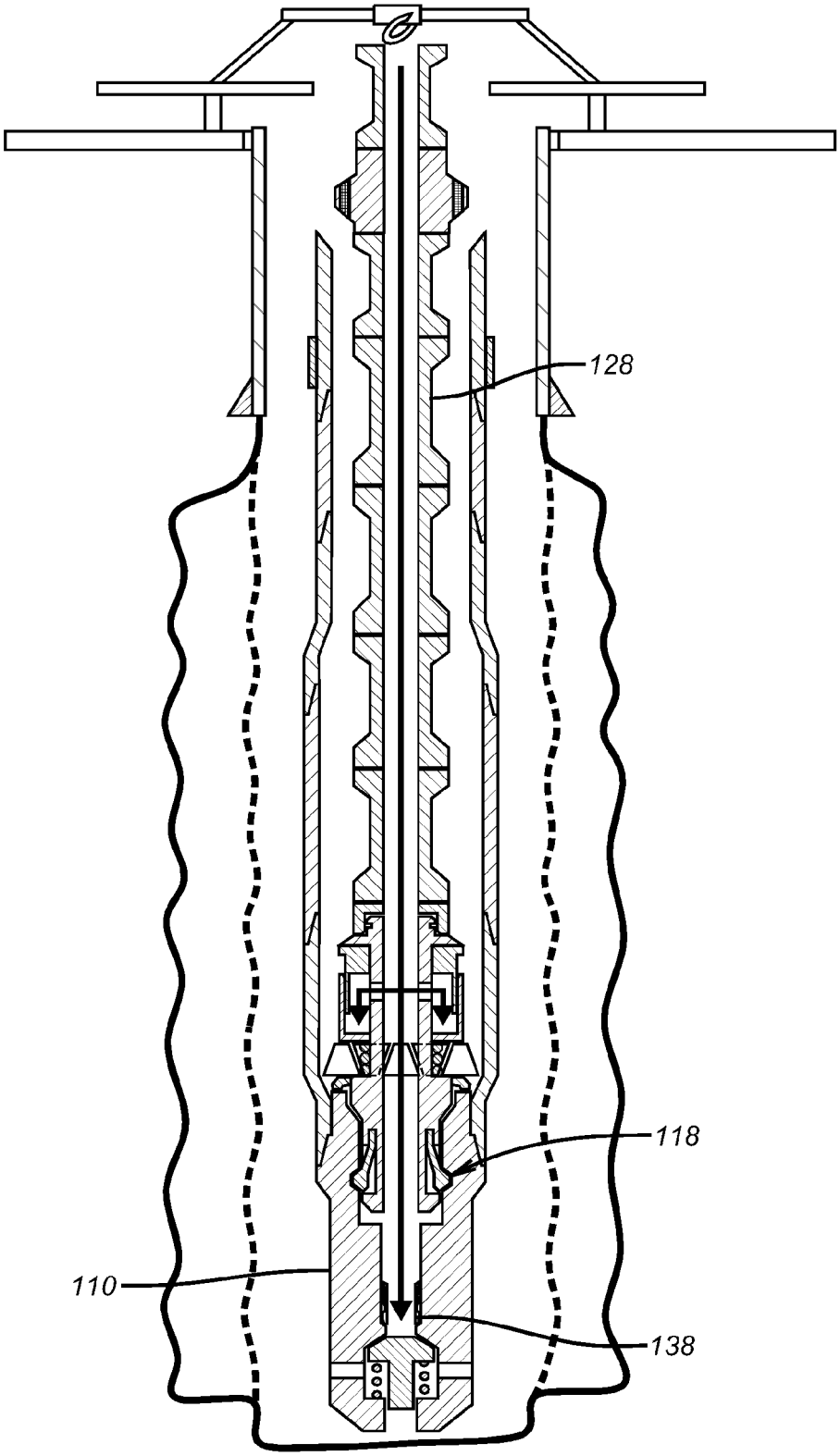
FIG. 19 is the view of FIG. 18 with the swage assembly again engaged to the float show after initial expansion.
Figure 20:
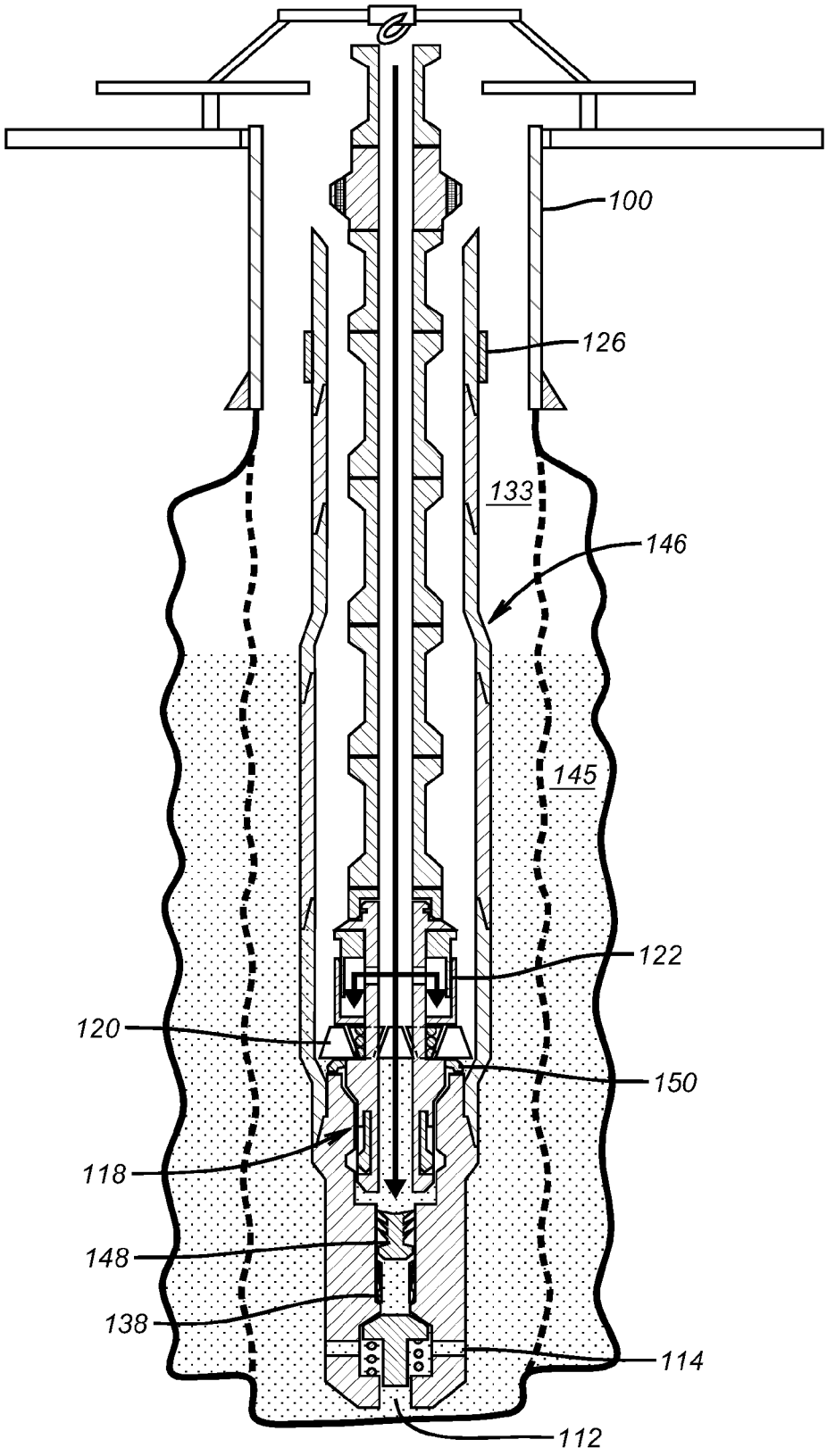
FIG. 20 is the view of FIG. 19 with the annulus around the expanded portion of the liner being cemented.

FIG. 19 shows the string 128 lowered so that latch 118 is back inside float shoe 110 and secured and a follow on pressure buildup blows a passage through the plug 138 so that the assembly is ready for cementing as shown in FIG. 20. In FIG. 20 cement 145 is delivered through passages 112 and 114 at a pressure that keeps the piston assembly 122 ports closed. After cement 145 is delivered to annulus 133 up to location 146 on the liner 106 representing where expansion stopped, a wiper plug 148 is landed on the now opened plug 138. Optionally some cement 145 can be pumped above plug 148 to ease subsequent drill out as shown in FIG. 20.

Figure 21:
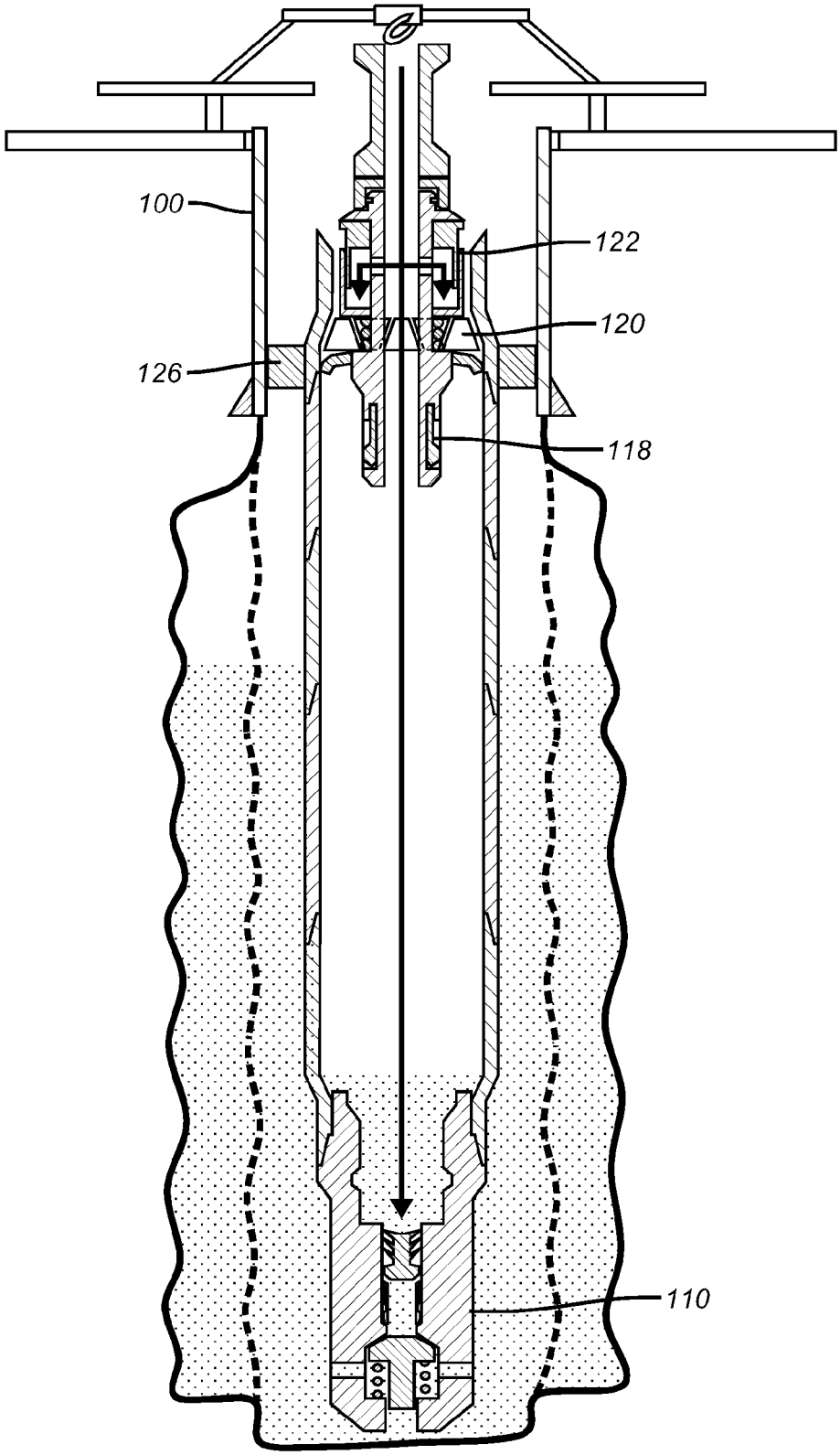
FIG. 21 is the view of FIG. 20 with the swage assembly driven up to complete the expansion above the cemented zone and engage the hanger on the liner to the casing.
Figure 22:
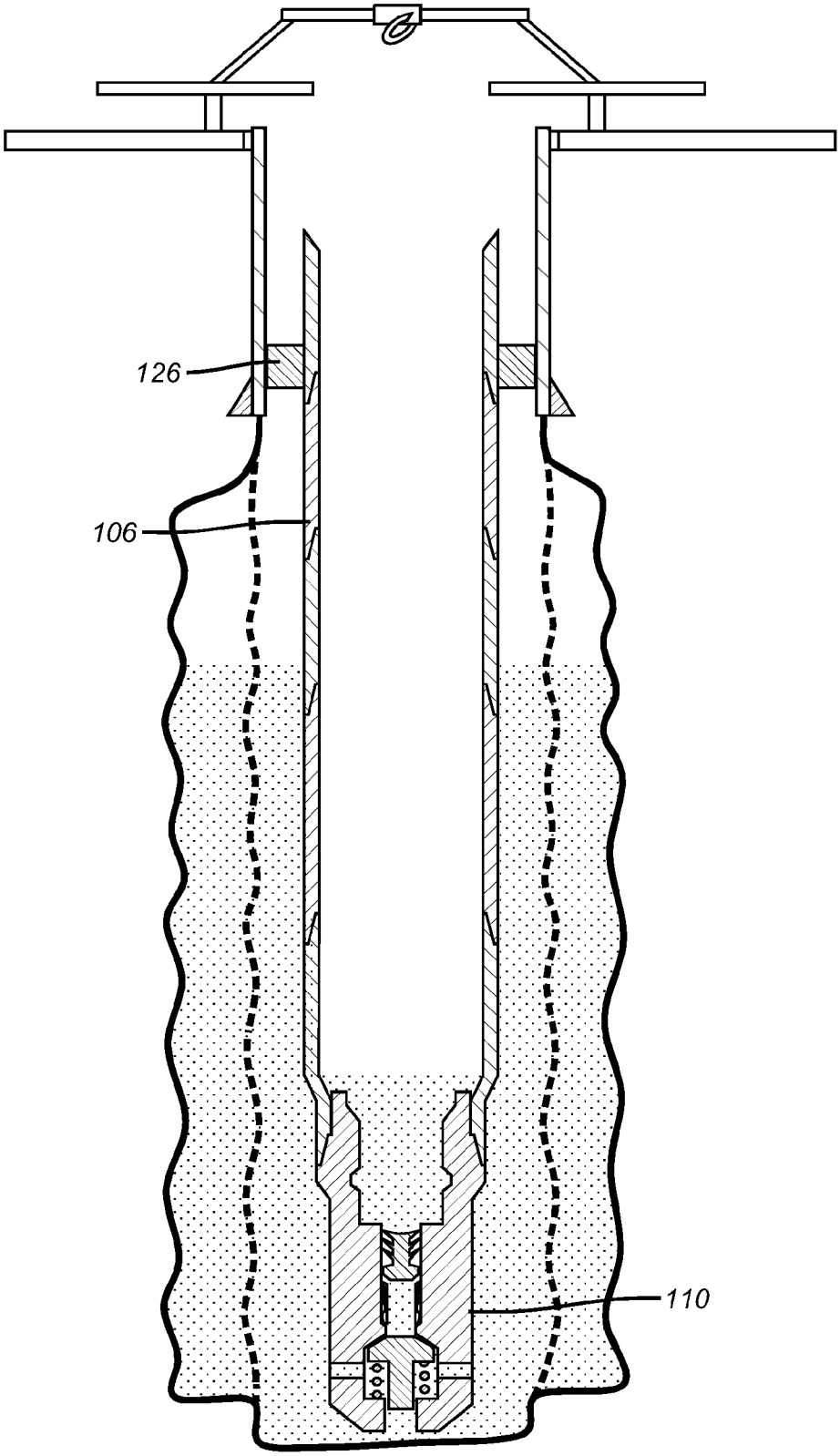
FIG. 22 is the view of FIG. 21 with the swage assembly removed from the liner.

Once again pressure is built up from the FIG. 20 position to cause latch 118 to release and to allow the swage assembly 120 held extended by piston assembly 122 that is now under pressure to be driven up through the already expanded portion to location 146 and then further up to the top of the liner 106. The swage assembly 120 can optionally have a backup seal like a swab cup 150 shown in FIG. 20 so that it can keep a seal while driven up to the location 146 where expansion will continue until the hanger/packer 126 is against the casing 100, as shown in FIG. 21, and for continued movement until the entire liner 106 is expanded and all the expansion equipment is removed as shown in FIG. 22. At that point the float shoe 110 can be milled out.

Figure 23:
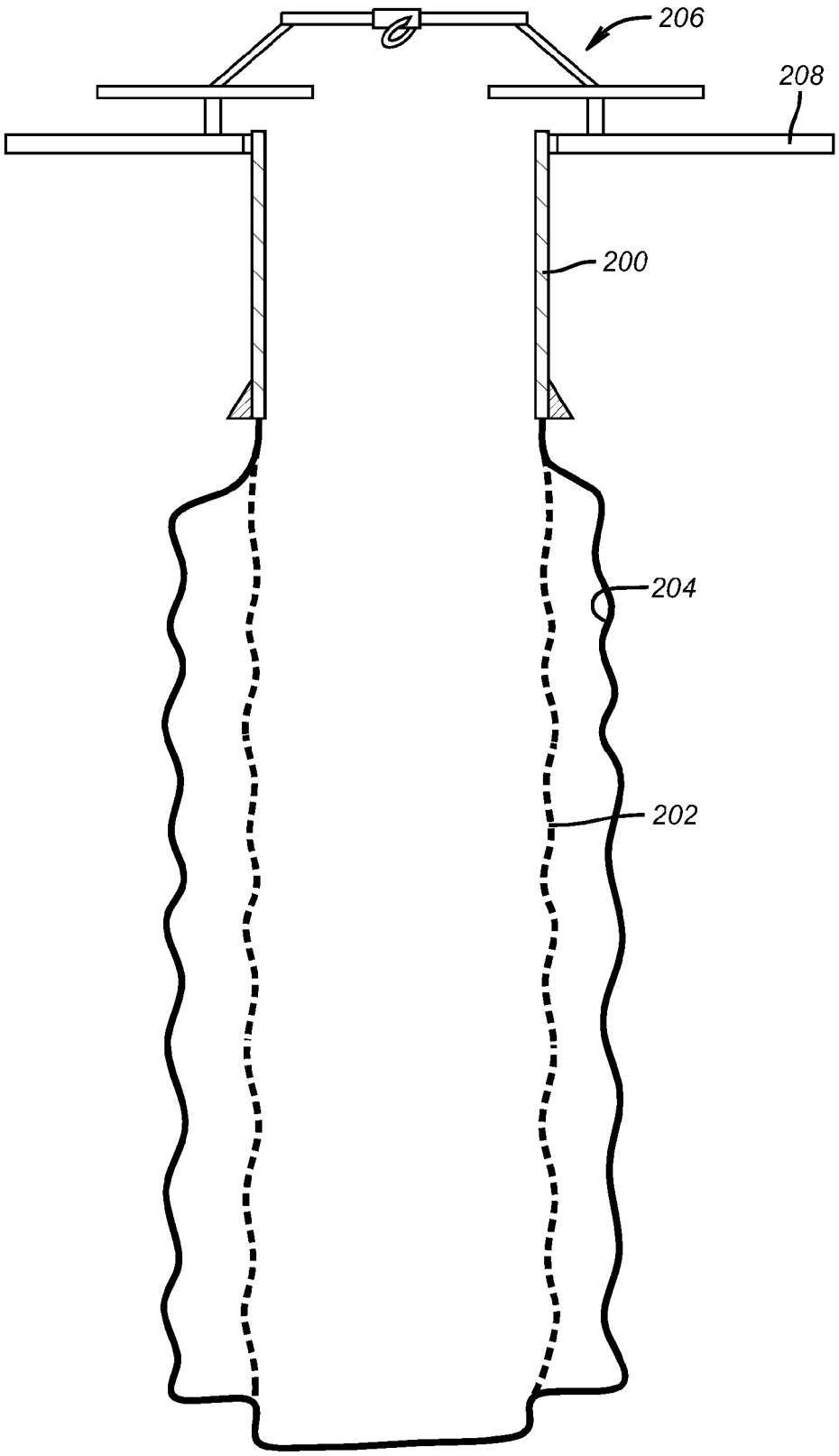
FIG. 23 is another view of FIG. 1 for an alternative embodiment without cementing the liner.
Figure 24:
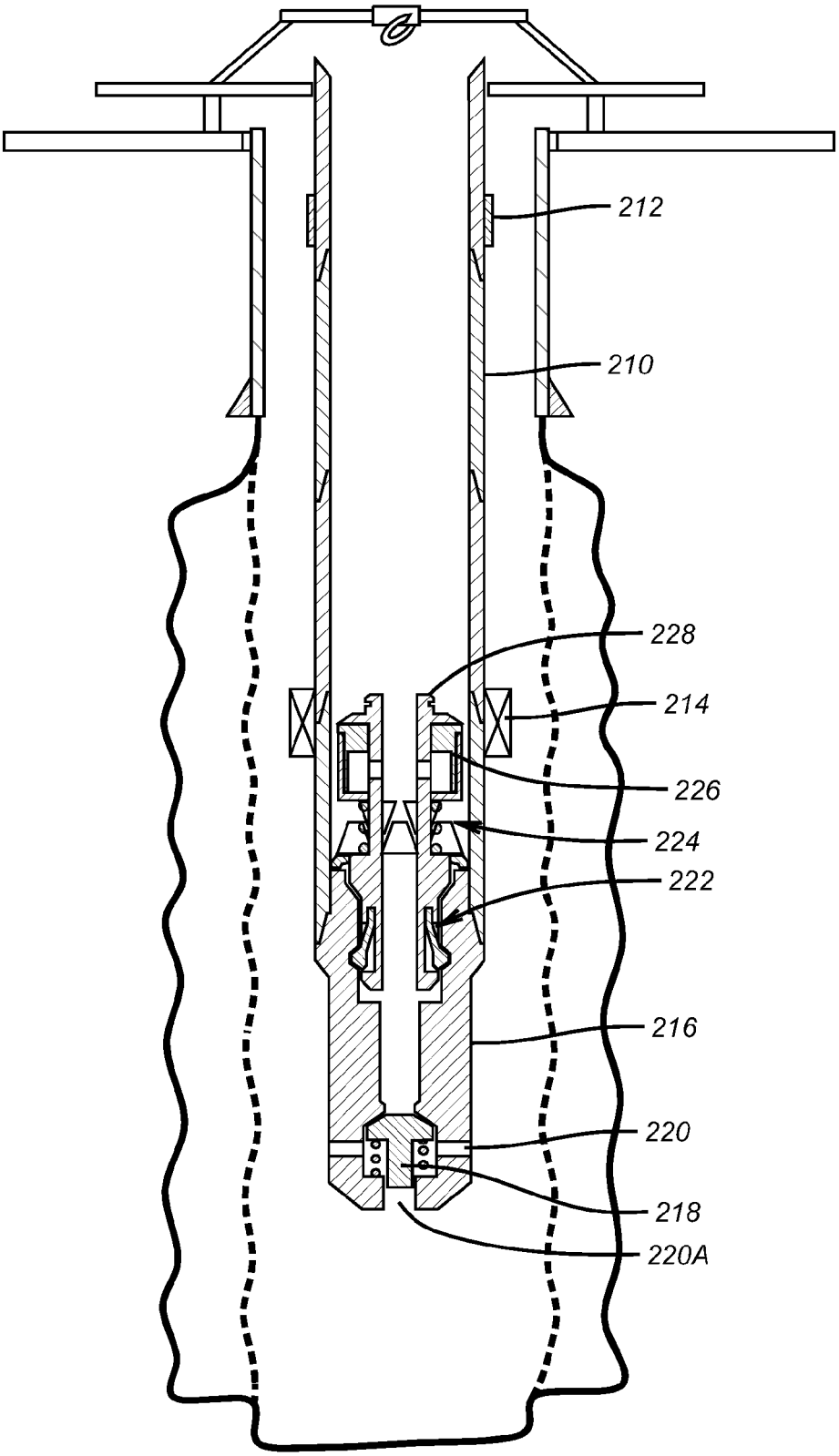
FIG. 24 is the view of FIG. 23 with the liner in the hole and suspended from the surface with an open hole packer outside the liner.
Figure 25:
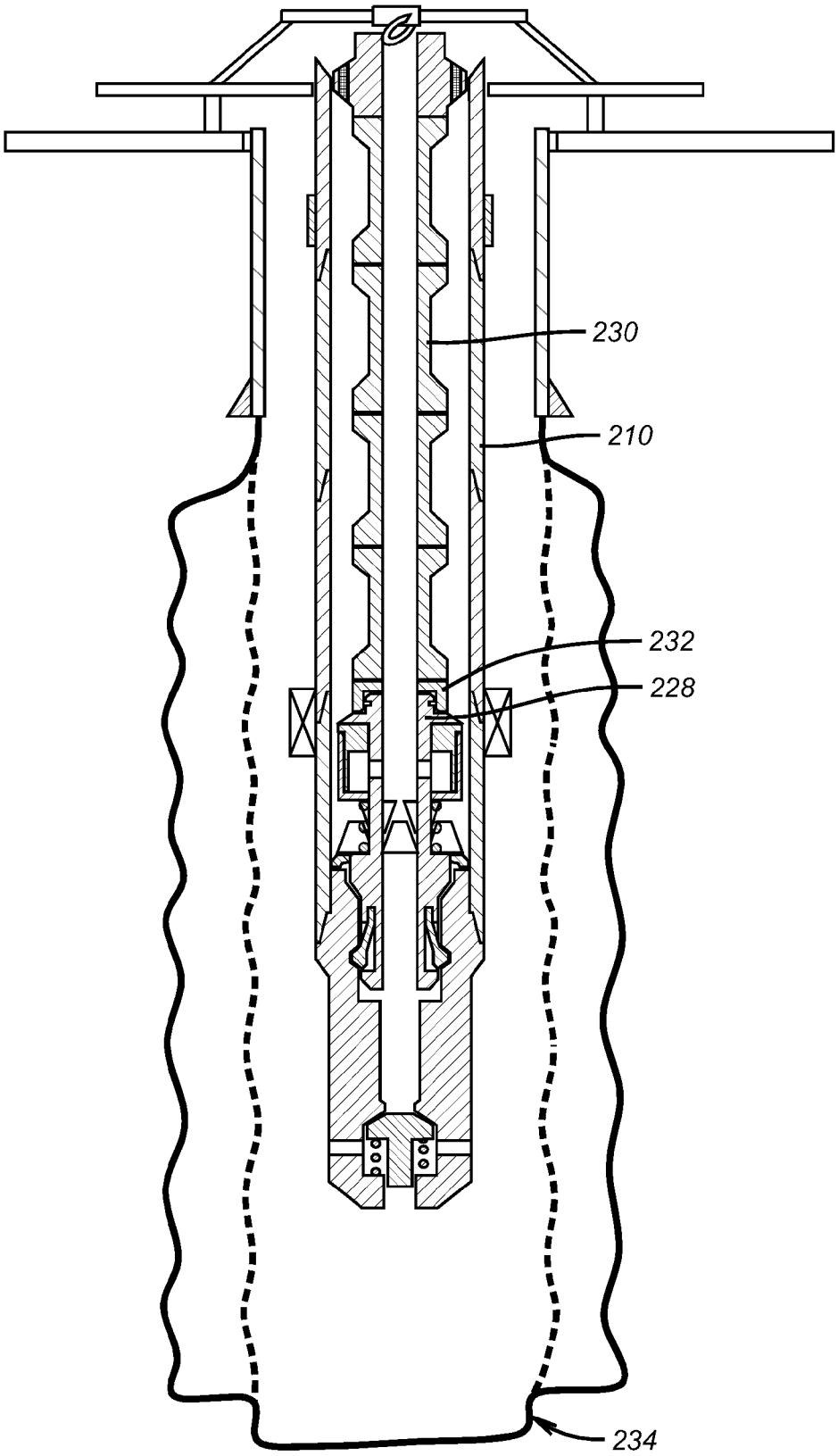
FIG. 25 is the view of FIG. 24 with the string latched into the swage assembly that is supported at the float shoe.
Figure 26:
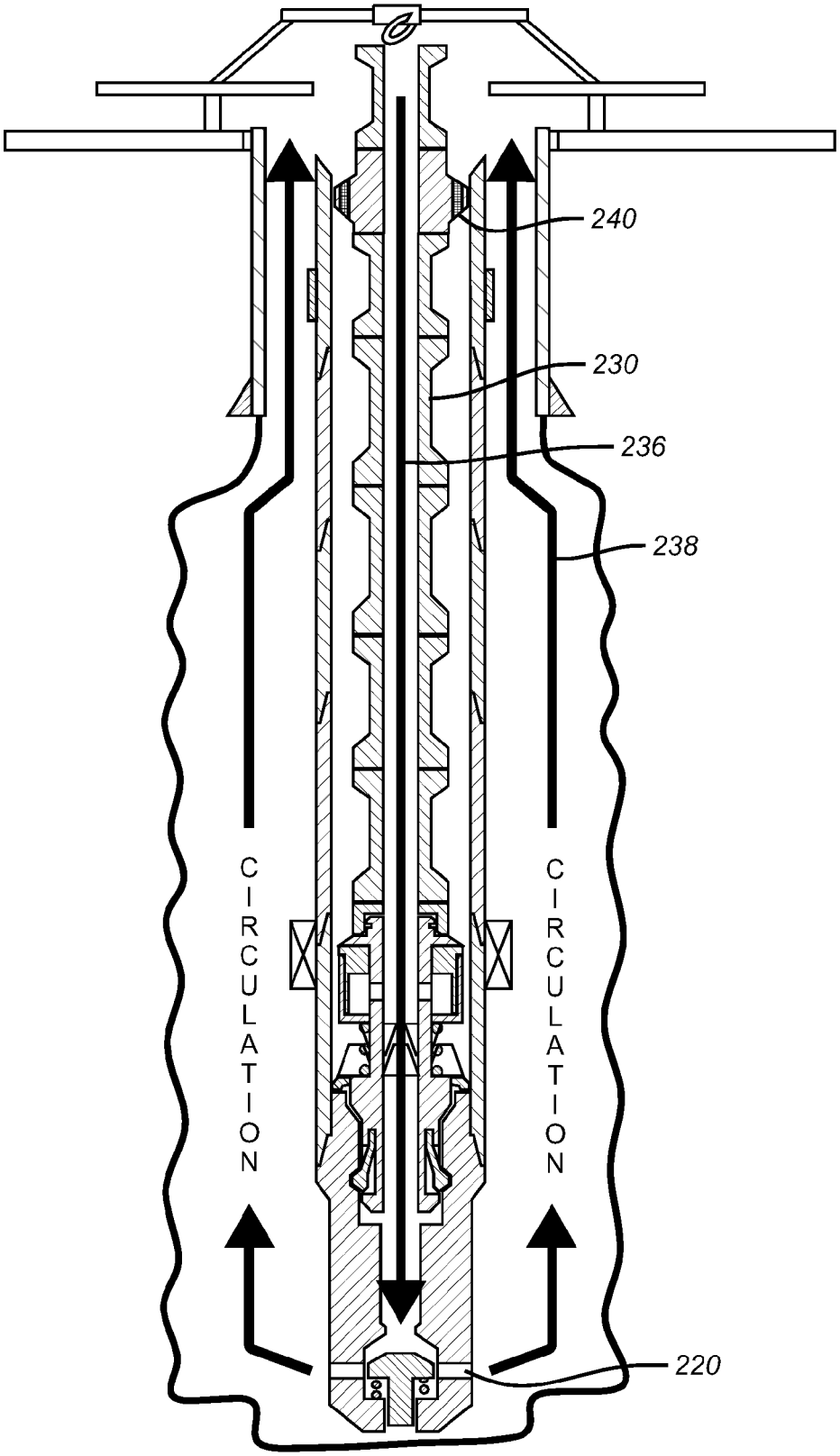
FIG. 26 is the view of FIG. 25 with the circulation established for running in the liner.

FIG. 23 starts an embodiment that tracks the previous embodiment only without cementing and instead using an open hole packer to seal the annulus around the expanded liner. As before a casing 200 is above an open hole 202 that is drilled or 204 if it is under-reamed. A rig 206 is at the surface 208. As shown in FIG. 24, the liner string 210 has a hanger/packer 212 for eventual support and sealing contact with the casing 200 and one or more external open hole packers 214 such as for example FORMpac® or REPacker® sold by Baker Oil Tools. At the lower end of the liner 210 is a float shoe 216 with a one way valve 218 and side outlets 220 and a lower port 220A. A latch assembly 222 is latched into the float shoe 216 for ultimate support of the liner 210 as will be explained below. Going uphole there is an adjustable swage assembly 224 with a piston operating assembly 226 and a connector profile 228. FIG. 25 illustrates a running string 230 with a connector 232 at its lower end adapted to contact connector profile 228 for a supporting and sealed connection to allow running in the liner 210 to the pilot hole 234 as shown in FIG. 26. As stated before for an alternative, the assembly that is above the float shoe 216 can be run into the liner 210 after the liner is assembled in the wellbore 202 or 204. In FIG. 26, string 230 is used to lower liner 210 while circulation represented by arrows 236 and 238 flowing through lateral outlets 220 and lower port 220A facilitate the advancement of the liner 210. A debris barrier 240 prevents debris from entering the liner 210 during circulation as it is advanced into the wellbore.

Figure 27:
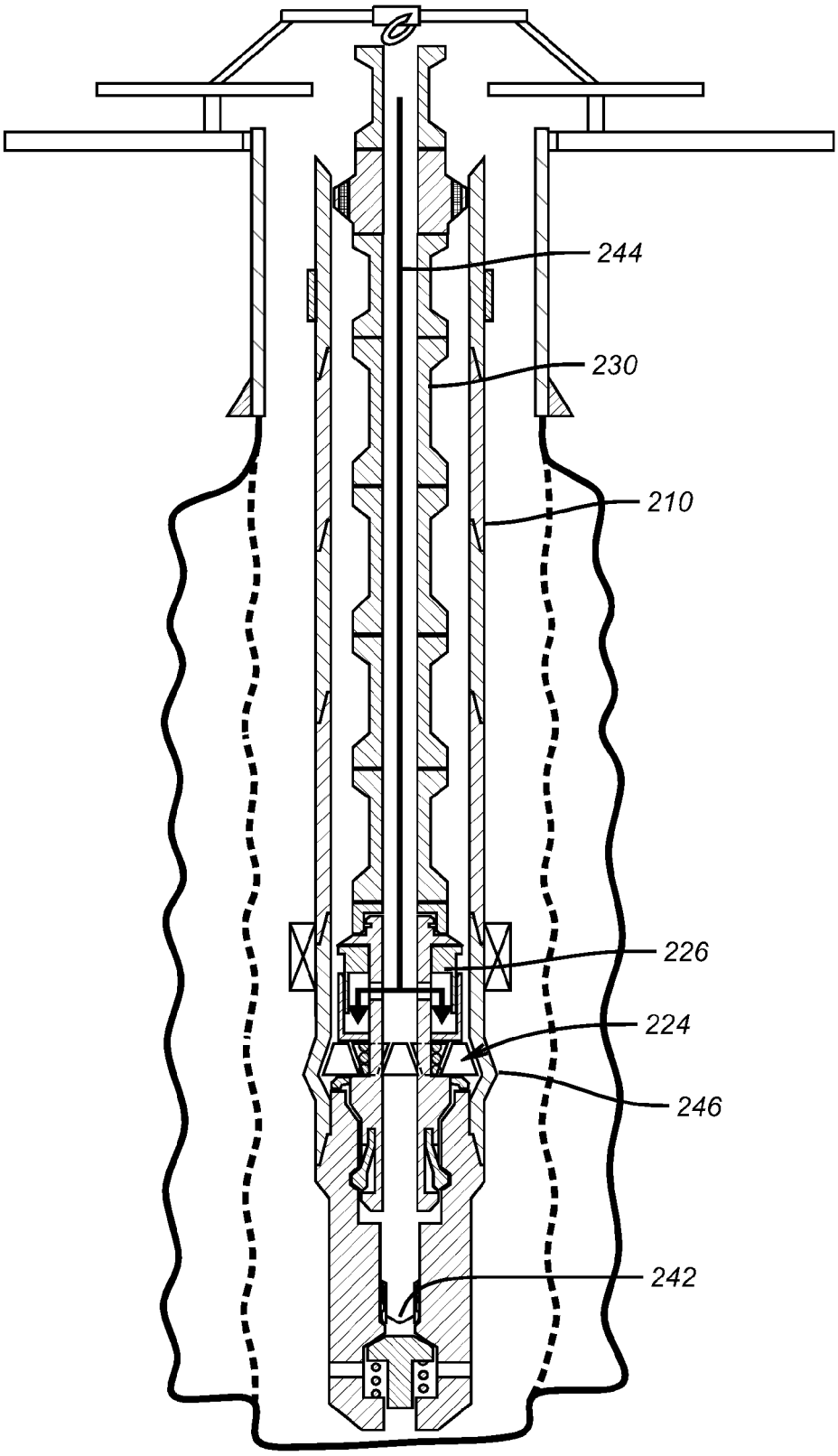
FIG. 27 is the view of FIG. 26 with the swage assembly expanded.
Figure 28:
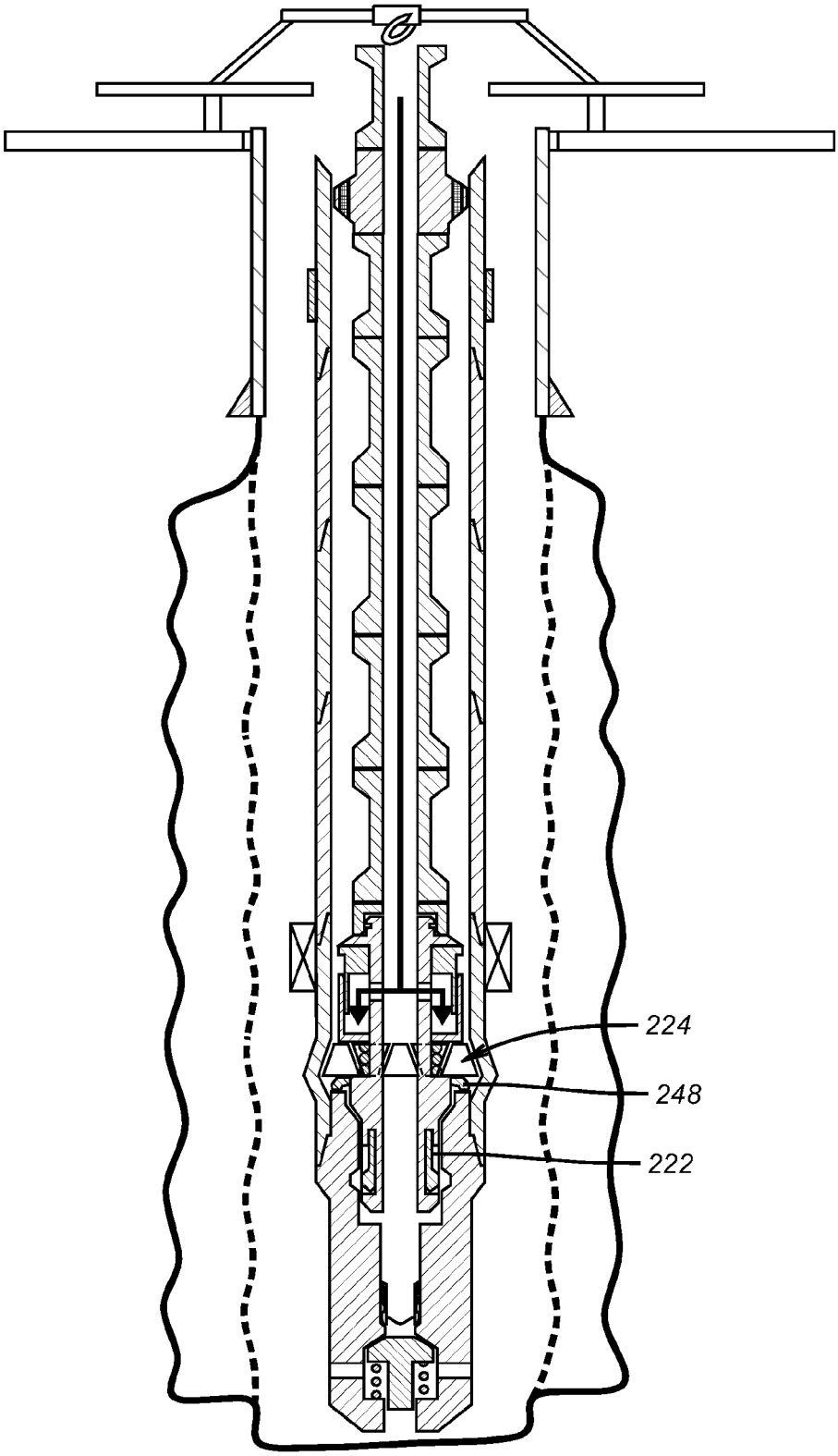
FIG. 28 is the view of FIG. 27 with the swage assembly released to move uphole from the float shoe.
Figure 29:
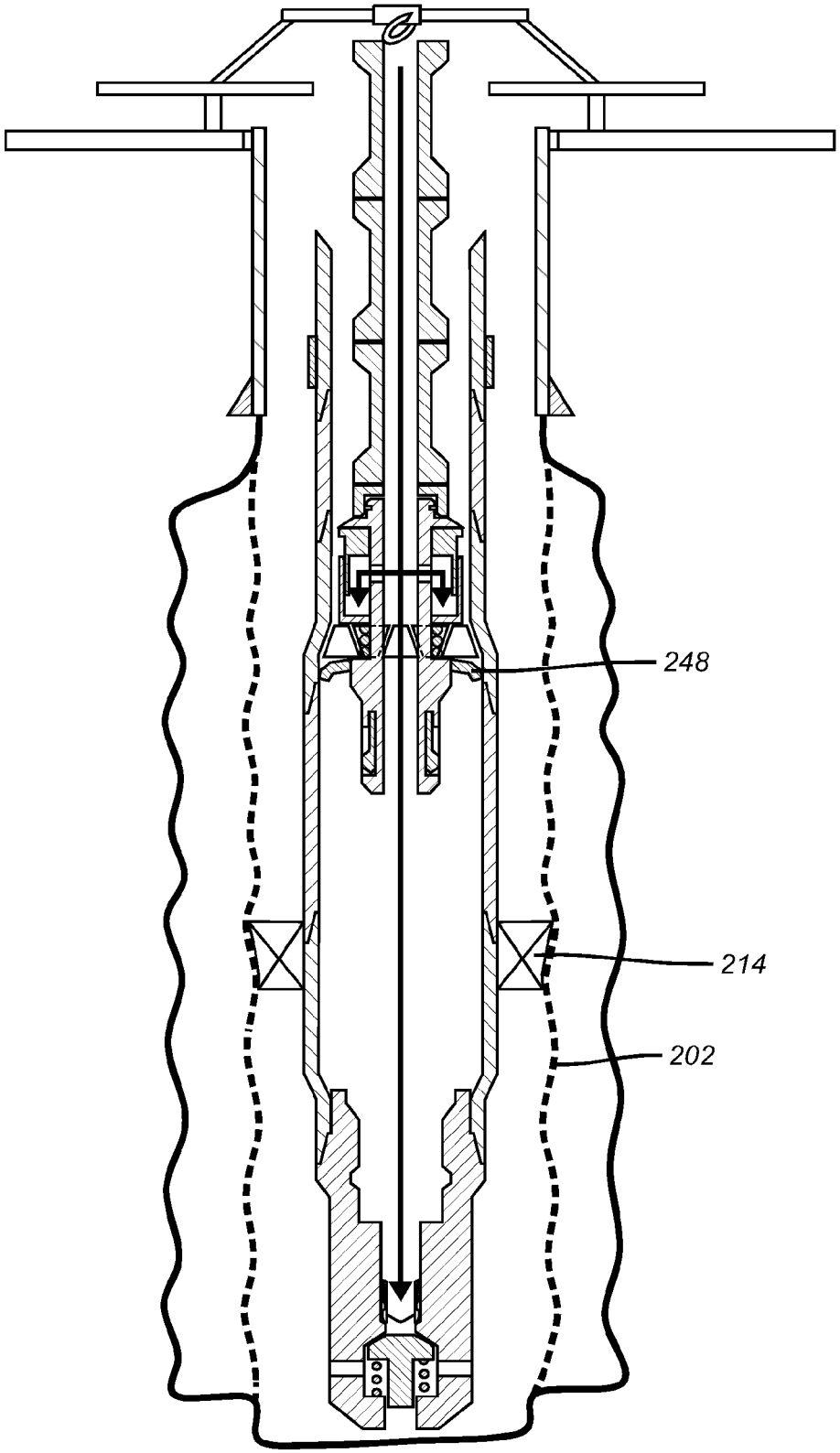
FIG. 29 is the view of FIG. 28 with the liner expanded and the open hole packer set.
Figure 30:
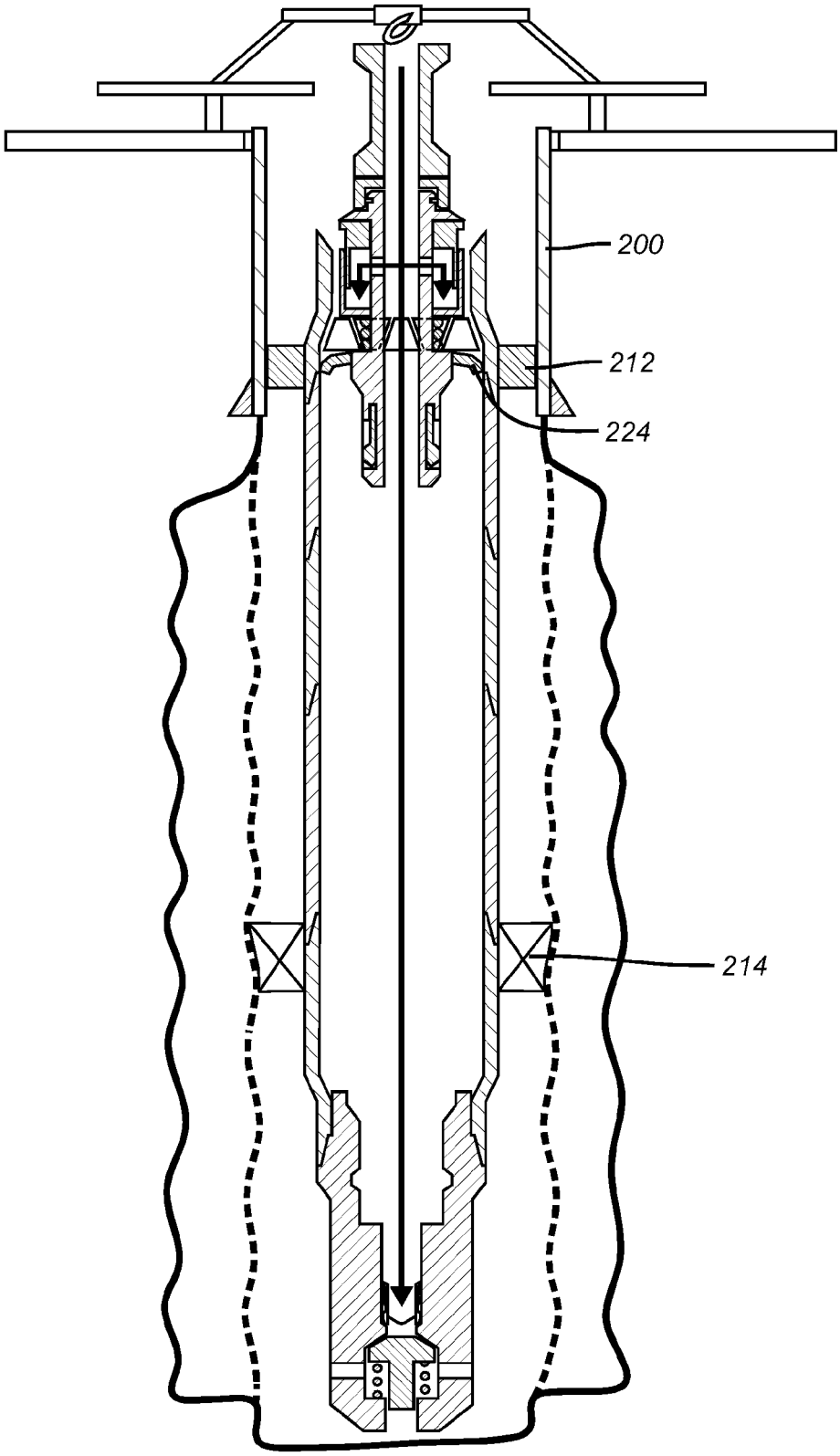
FIG. 30 is the view of FIG. 29 with the swage expanding the hanger on the liner into contact with the casing.
Figure 31:
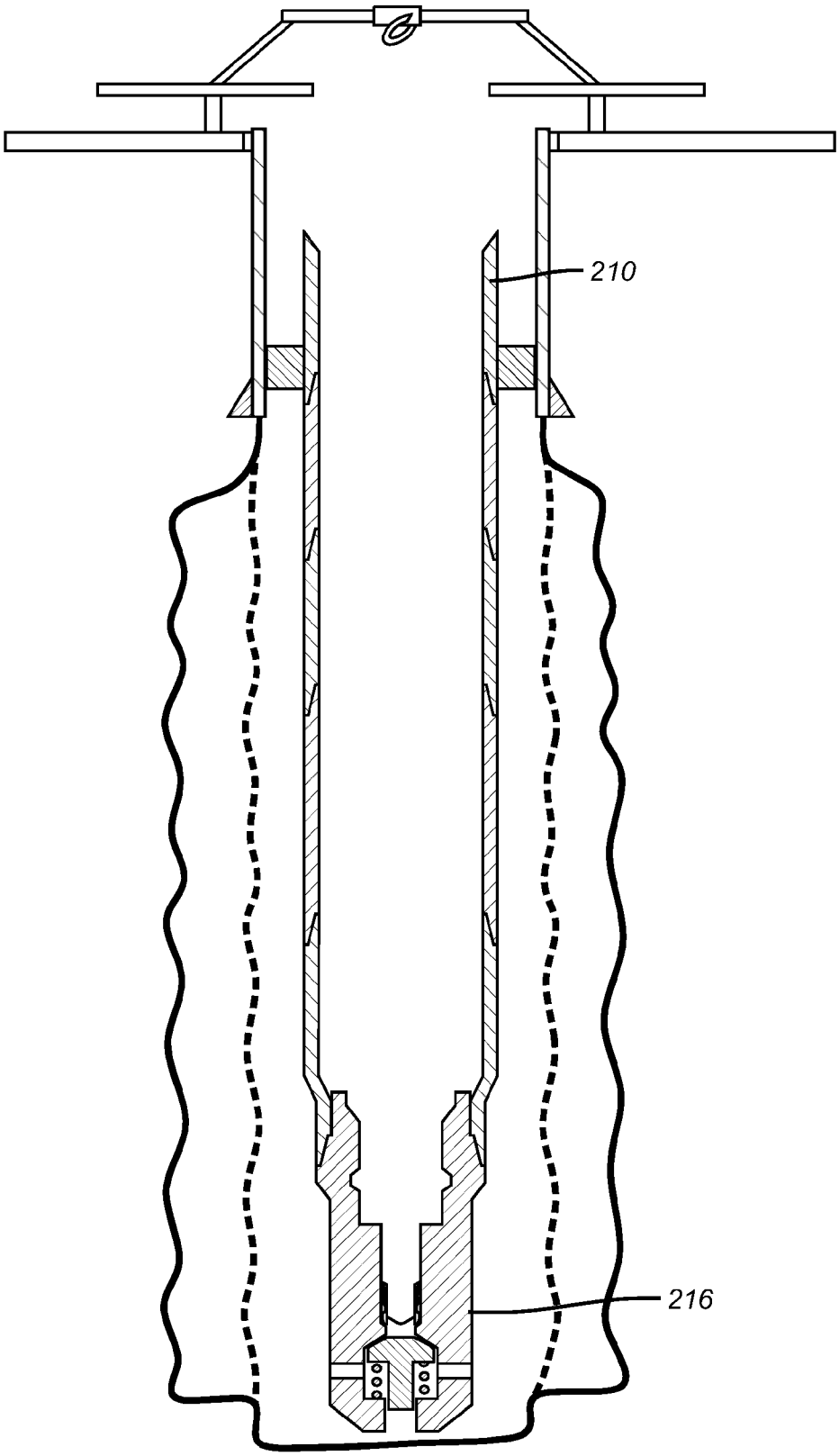
FIG. 31 is the view of FIG. 30 with the swage assembly out of the liner and the float shoe ready to be drilled out or retrieved to the surface.

In FIG. 27 a plug 242 is landed to allow pressure buildup in the string that is represented by arrow 244, This pressure actuates the piston assembly 226 to increase the size of the swage assembly 224 and to create a bump out 246 in the liner 210. As shown in FIG. 28 further pressure increase and set down weight releases the latch assembly 222 so that the swage assembly 224 start being powered uphole with pressure and/or overpull. An optional seal such as a swab cup 248 could be used with the swage assembly 224 in the event that the swage assembly itself will not sufficiently seal against the liner it is trying to expand as better illustrated in FIG. 29. Also in FIG. 29 the swage assembly is moved up the substantial length of the liner 210 with the result being that the open hole packer 214 is sealed against the open hole 202. Multiple open hole packers can be run. Because there is no cementing in this embodiment, the swage assembly can be driven continuously until the hanger/packer is set against the casing 200 as shown in FIG. 30. The expansion equipment is removed as shown in FIG. 31 out the top of the liner 210 and the float shoe 216 can be milled out.

Figure 32:
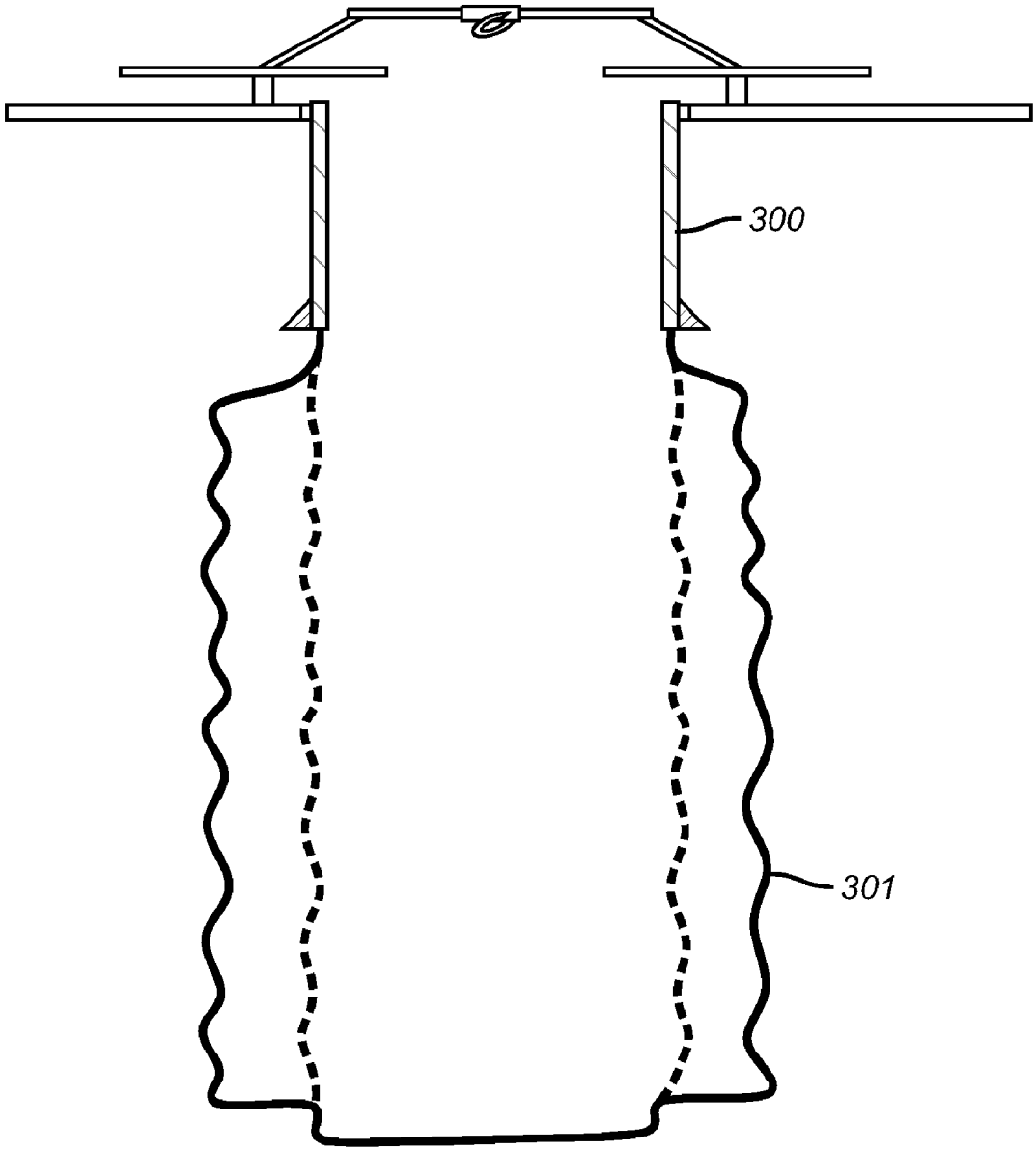
FIG. 32 shows an open hole that can be under reamed with respect to the cased hole above.

The remaining FIGS. focus on some applications of the techniques described above. FIG. 32 shows a parent casing 300 and more hole drilled that can include under reaming as represented by 301 or simply an extension of the hole that is the size of the parent casing 300 as represented by the dashed line in FIG. 32. This view was previously illustrated in other FIGS. discussed earlier.

Figure 33:
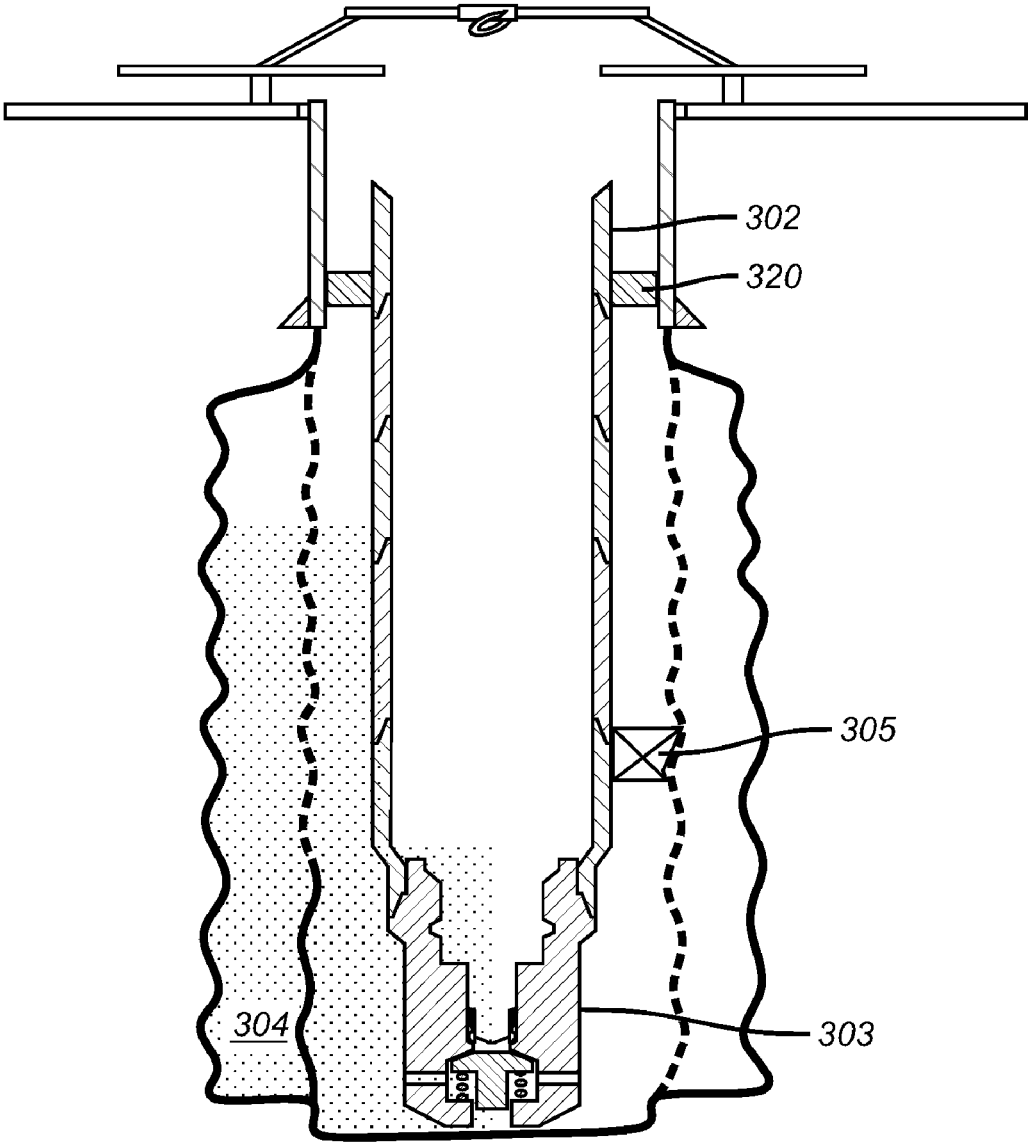
FIG. 33 shows a liner inserted and expanded to hang off the casing above with options to seal it with cement or external packers or both or neither.

FIG. 33 is a split view indication that liner 302 is hung off the casing 300 using a hanger/packer 320. At the lower end is a shoe 303. The view is split showing that liner 302 is sealed with cement 304 on the left or with an external packer or seal 305 on the right as an alternative. As another alternative the cement 304 and seal 305 can be used together. There can be one or more seals 305 employed. The packer 305 can seal either to the smaller or larger bore such as 301 depending on how the hole is drilled and which sealing device is used.

Figure 34:
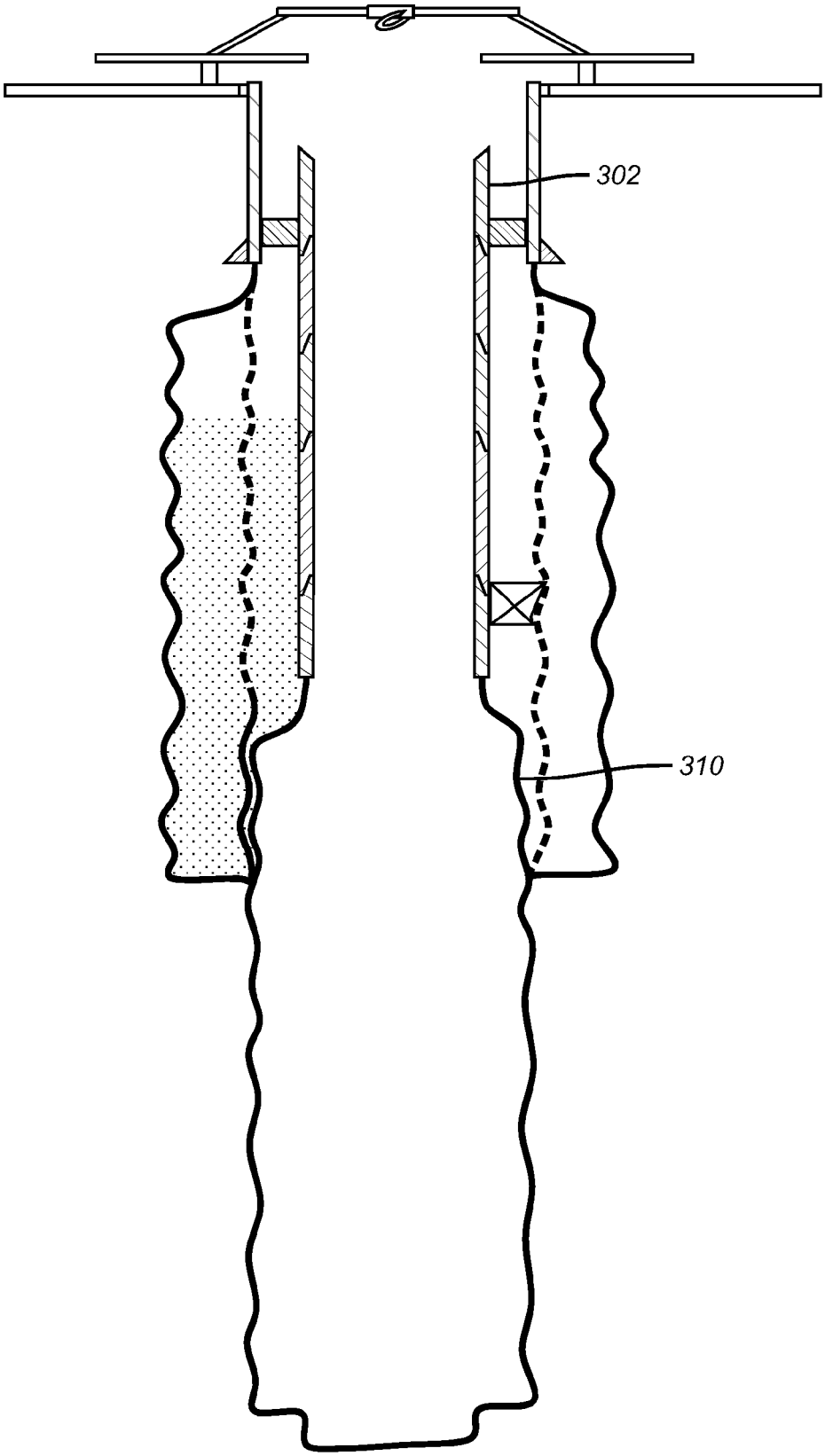
FIG. 34 shows an under reamed open hole below the already expanded and hung off liner.

FIG. 34 shows the liner 302 expanded and hung off the parent casing 300 and the shoe 303 drilled out with the annulus around the liner 302 isolated. More hole 310 is drilled which could be a straight bore or an under reamed bore as actually shown.

Figure 35:
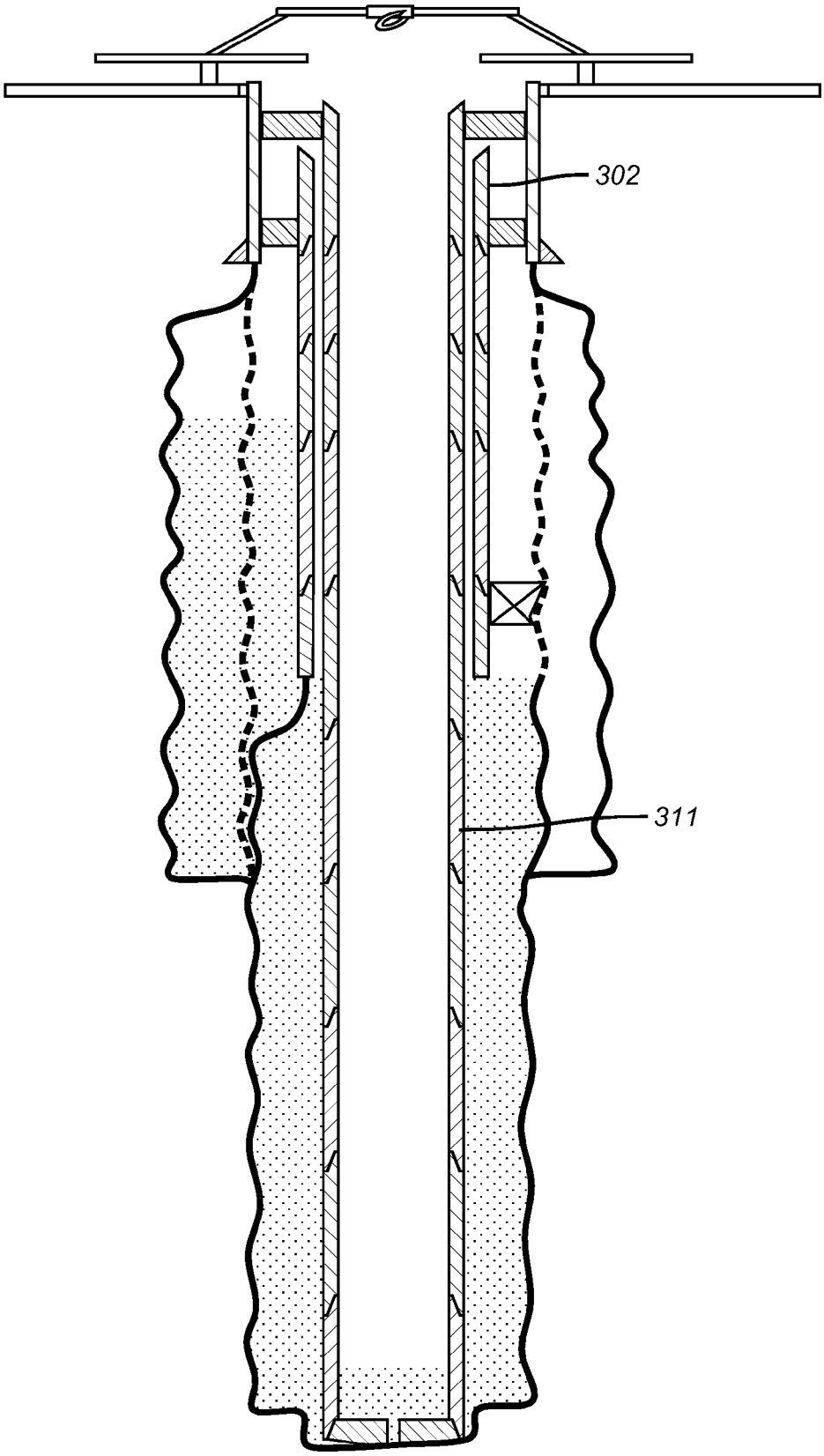
FIG. 35 shows a production string through the expanded liner and hung off the casing where the production string can be cemented or not as needed.

FIG. 35 shows a second liner 311 through the expanded liner 302 and hung off the parent casing 300. Although the liner 311 is shown cemented, it could also be in open hole without cement and it could be slotted. Alternatively it could be hung off liner 302 but hanging off the casing 300 allows a larger inside diameter for liner 311. Additionally, the hanging of liner 311 from casing 300 allows for subsequent flow to be isolated from the expanded liner 302 which might have not have the required pressure capacity or corrosion resistance. The extension bore if under reamed allows lower circulation pressure when cementing the production liner 311. The staging of the liners 302 and 311 allows different mud weights to be used to account for differing formation properties so as to avoid mud loss or formation damage during drilling and subsequent running of the string 311.

Figure 36:
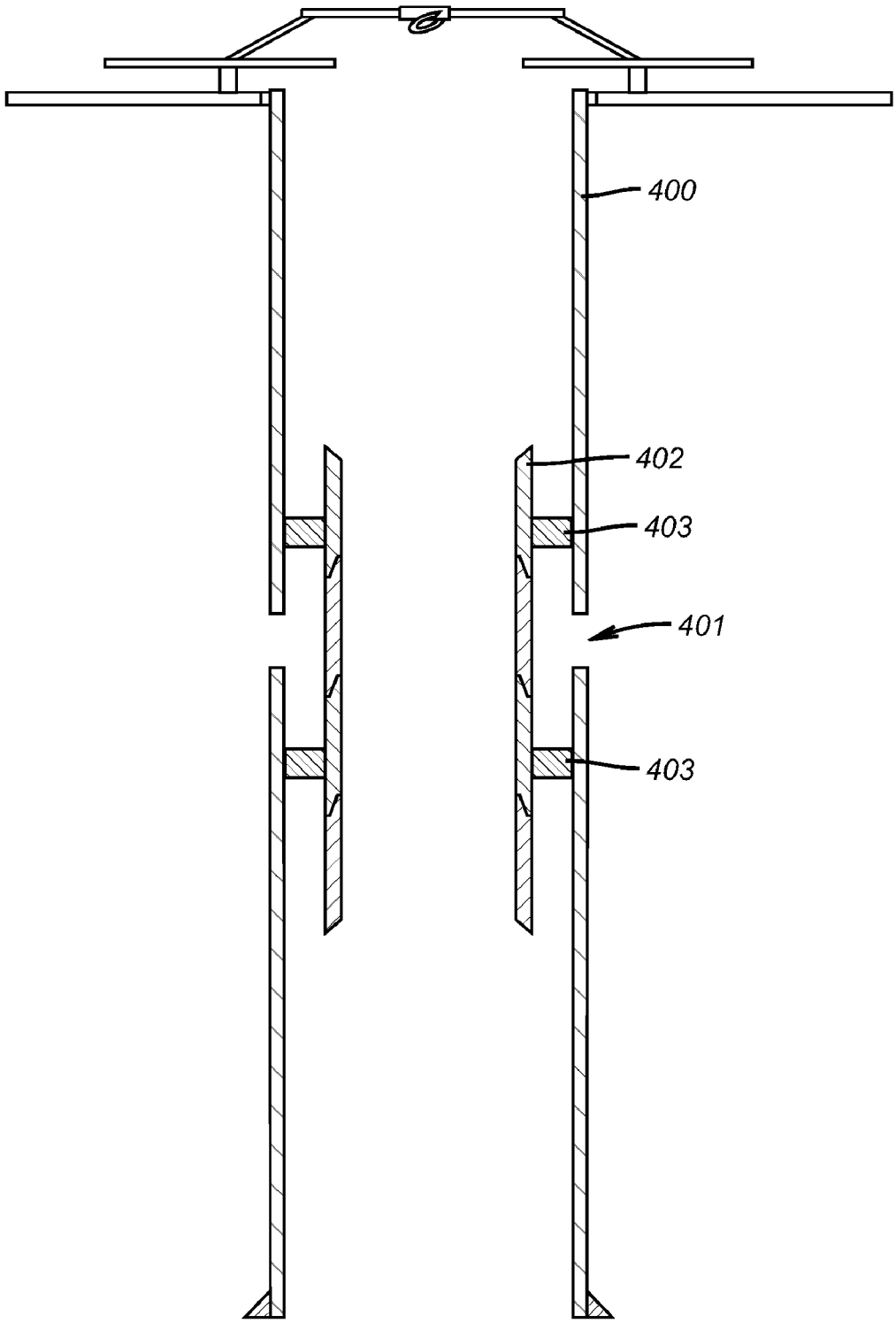
FIG. 36 shows a casing patch application using expansion.

FIG. 36 shows a casing patch application where the casing 400 has a break or a crack or is otherwise damaged 401 and a section of tubular 402 can be inserted into position and expanded by the techniques described above so that pair of straddling seals 403 are disposed on opposed sides of the break 401. Alternatively, longer continuous seals can be expanded to cover the damaged sections in place of straddling. Alternatively, the tubular 402 can be expanded into the inside wall of the casing 400 without seals such as 403 and simple expansion results in a tight seal that can be metal to metal.

Figure 37:
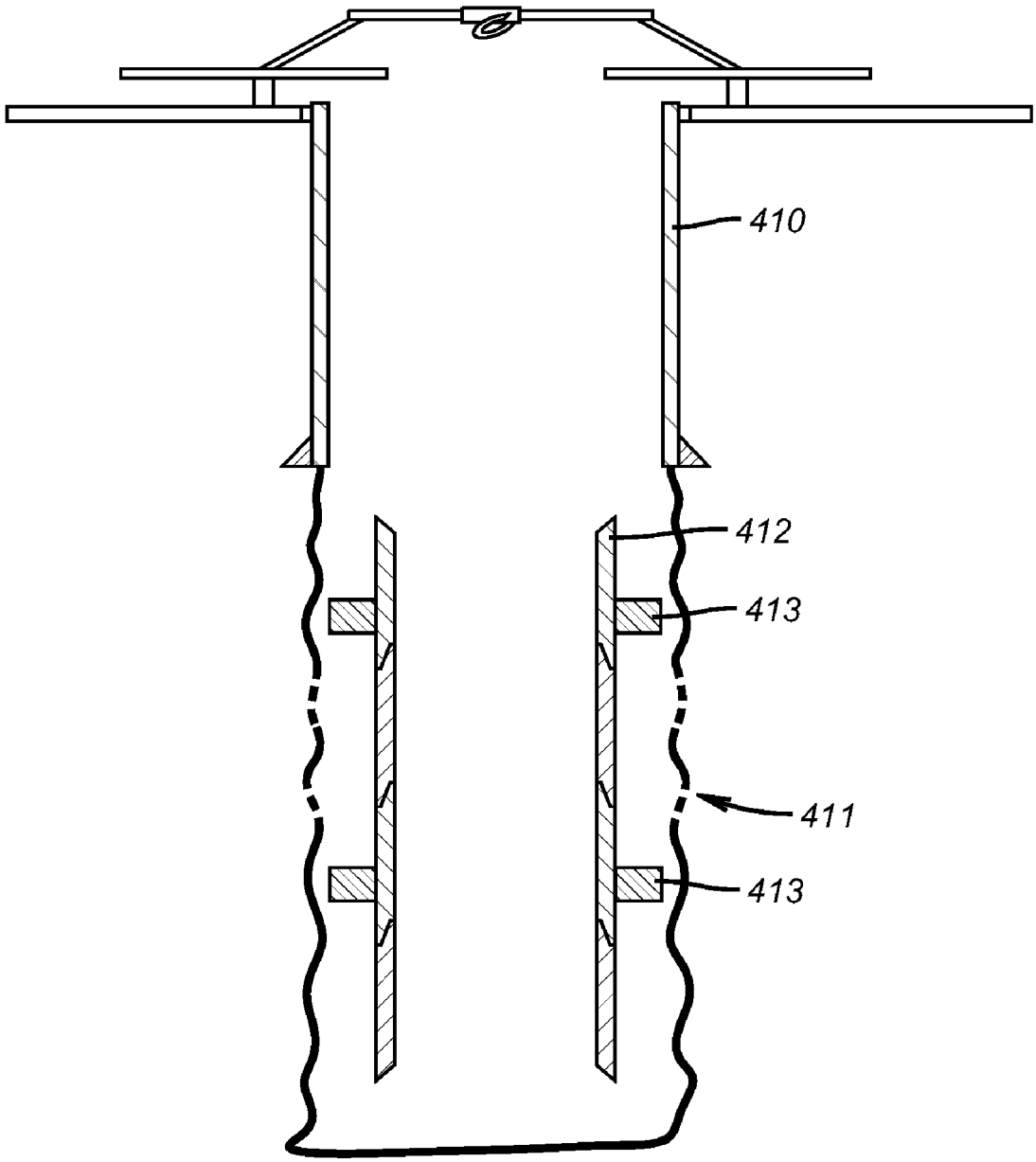
FIG. 37 shows an open hole patch using expansion.
Figure 38:
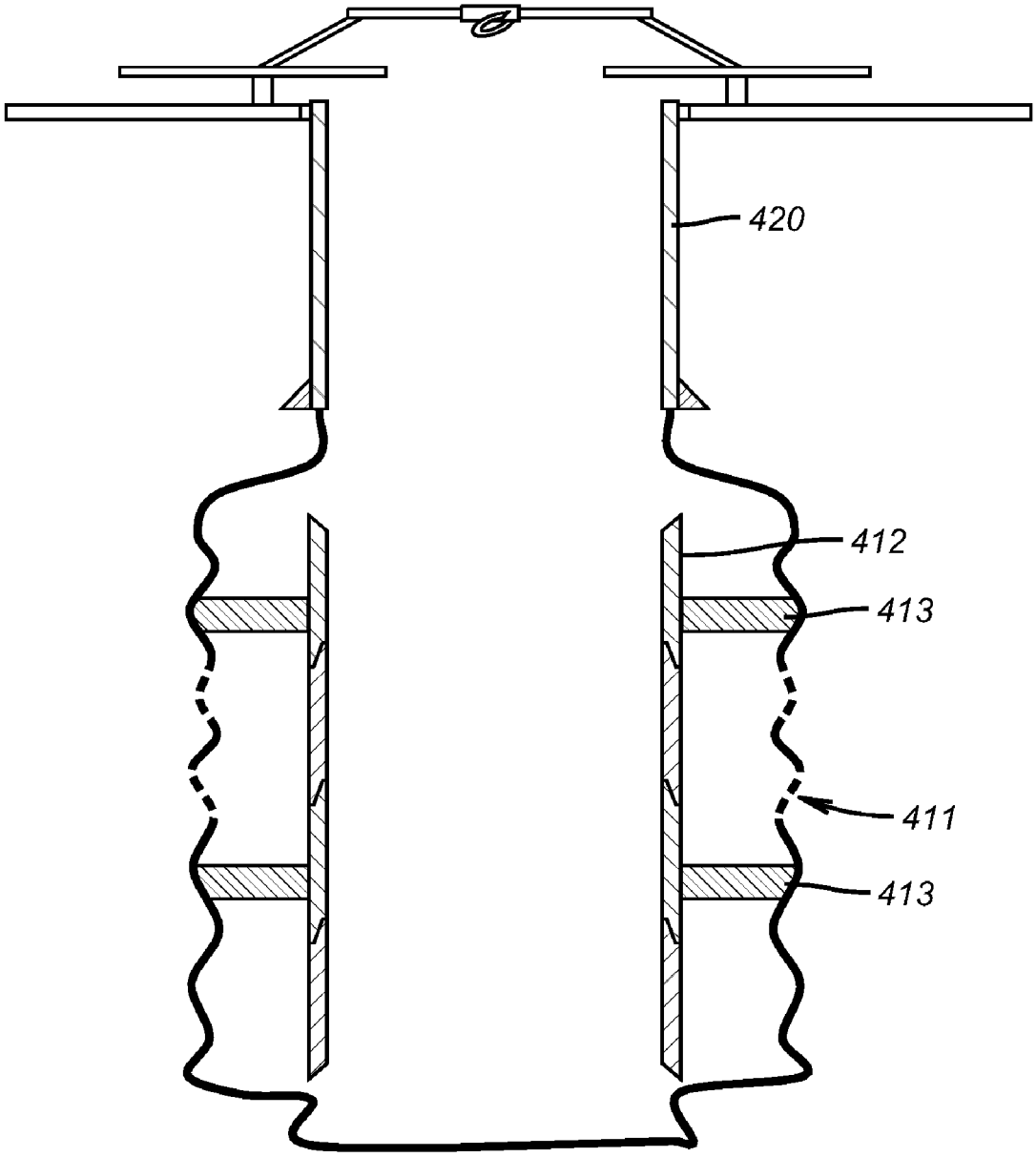
FIG. 38 shows an open hole patch in an under reamed hole.

FIG. 37 illustrates an open hole patch application where additional hole 411 has been drilled past the casing 410 and in the open hole region there is a fluid loss zone, water or other undesirable fluid is being produced into the wellbore, and/or sloughing formation. The tubular patch 412 can be run in and expanded in the manner shown before with the use of external packers 413 to straddle the zone where the losses or unwanted inflow or sloughing is occurring. Alternatively, longer continuous seals can be expanded to cover the damaged sections in place of straddling. It should be noted that there may be a reduction in the drift diameter in the patch 412 as compared to the drift diameter of the casing 420 which will restrict the passage of bit and drill string assemblies, possibly leading to a smaller open hold being drilled below the open hole patch. However, FIG. 38 is the same view as FIG. 37 with the drilled hole 411 having been under reamed in the troublesome zone so that after expansion of the patch 412 to engage the seals 413 the drift diameter of the patch is at least as large as the drift diameter in the casing 420 and maintains the bit passage diameter for continuous drilling of the hole further.

Figure 39:
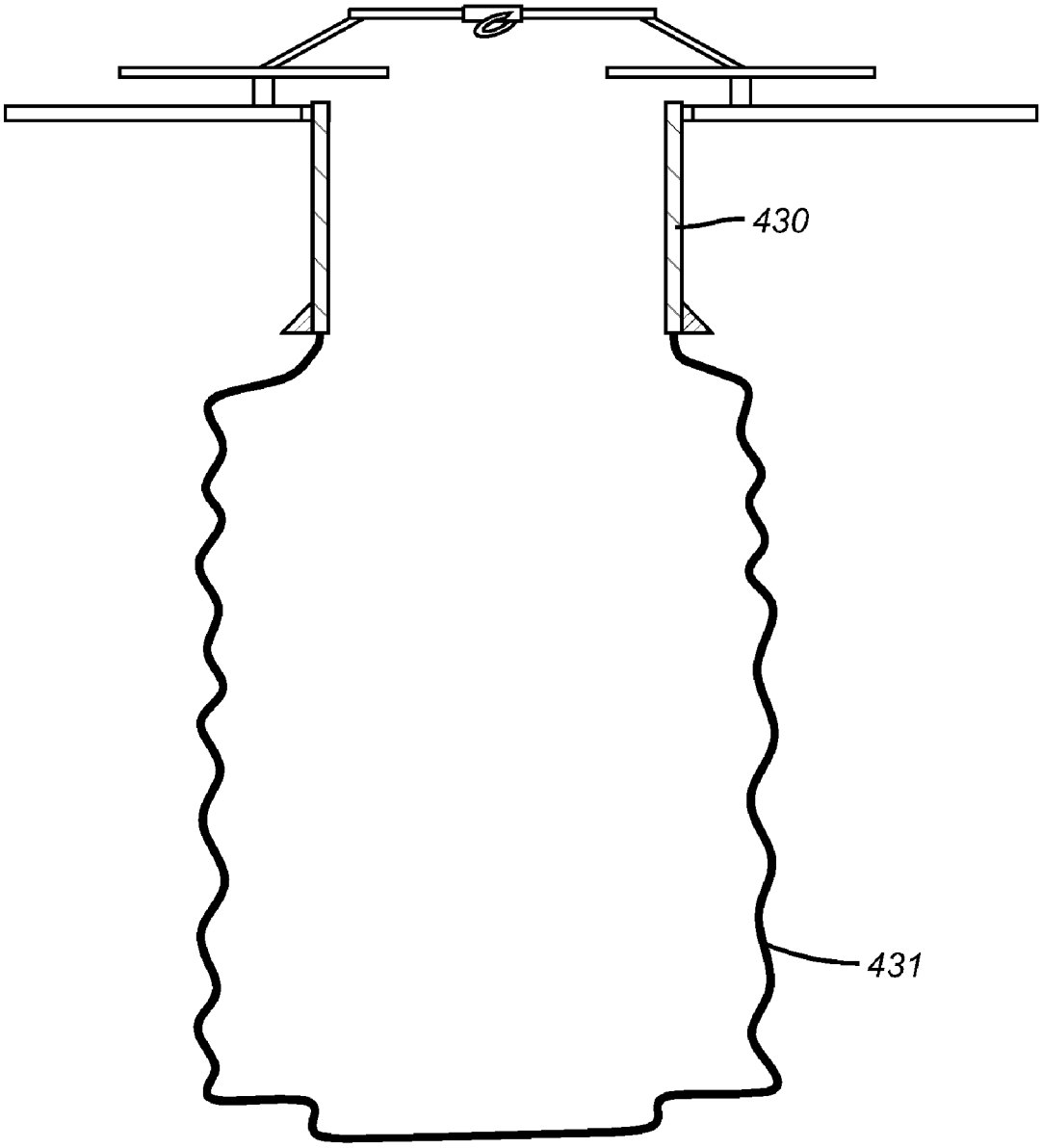
FIG. 39 shows an under reamed open hole below a cased hole.
Figure 40:
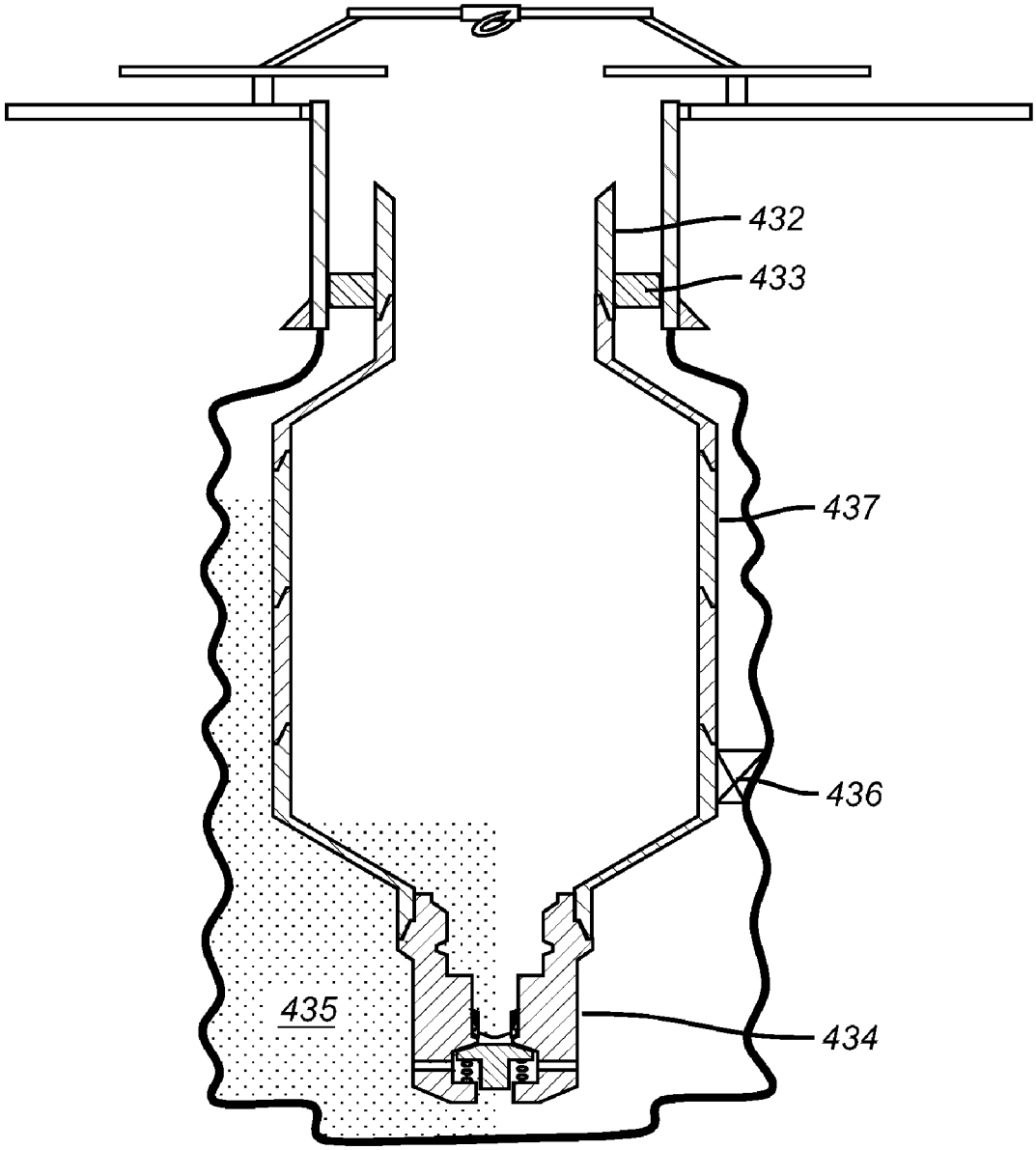
FIG. 40 is the view of FIG. 39 with a liner inserted and expanded to create a lower bell in the under reamed portion of the well.
Figure 41:
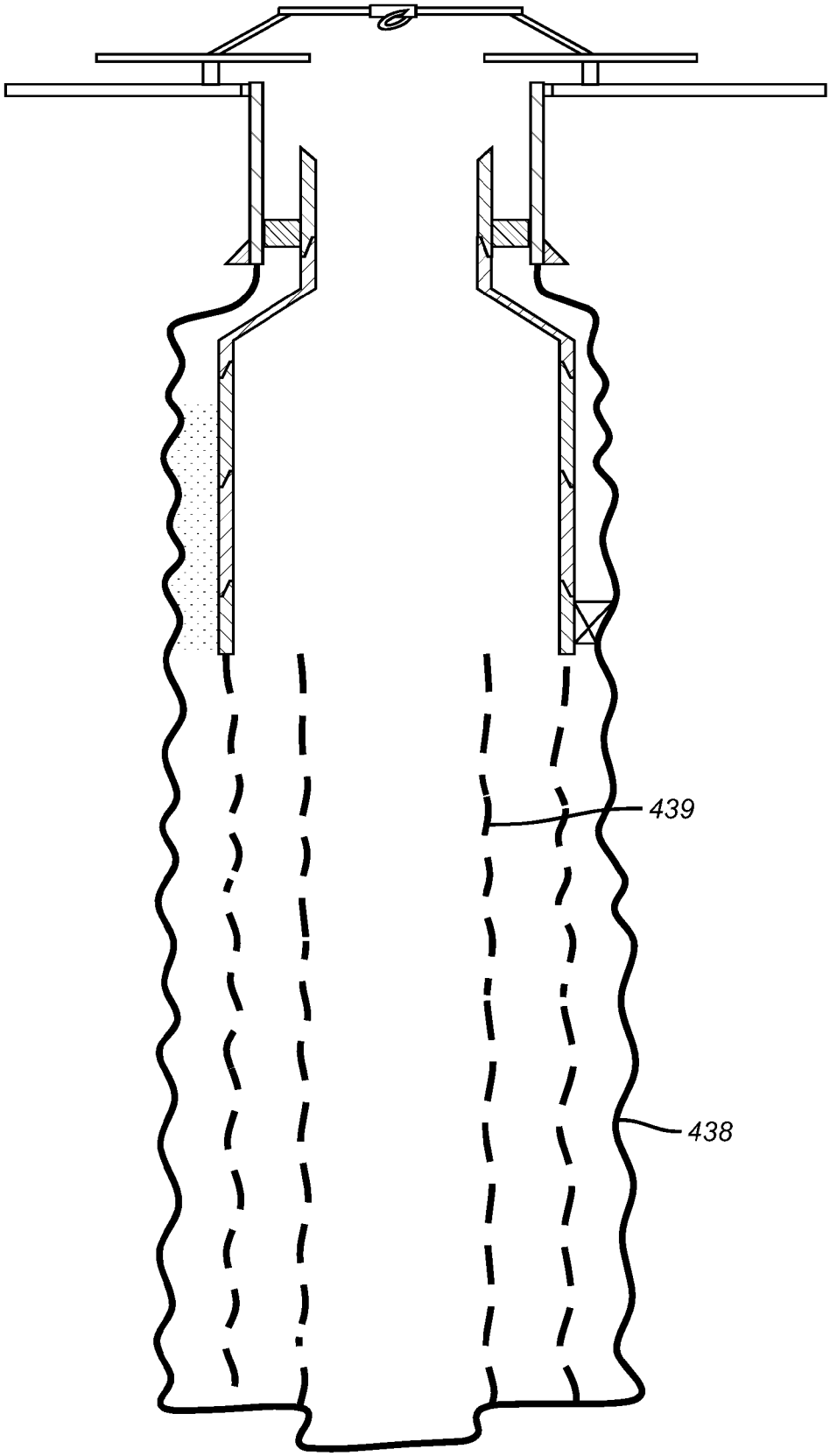
FIG. 41 is the view of FIG. 40 with the shoe drilled out of the bottom of the expanded liner and further showing a variety of sizes of new hole to be drilled deeper.
Figure 42:
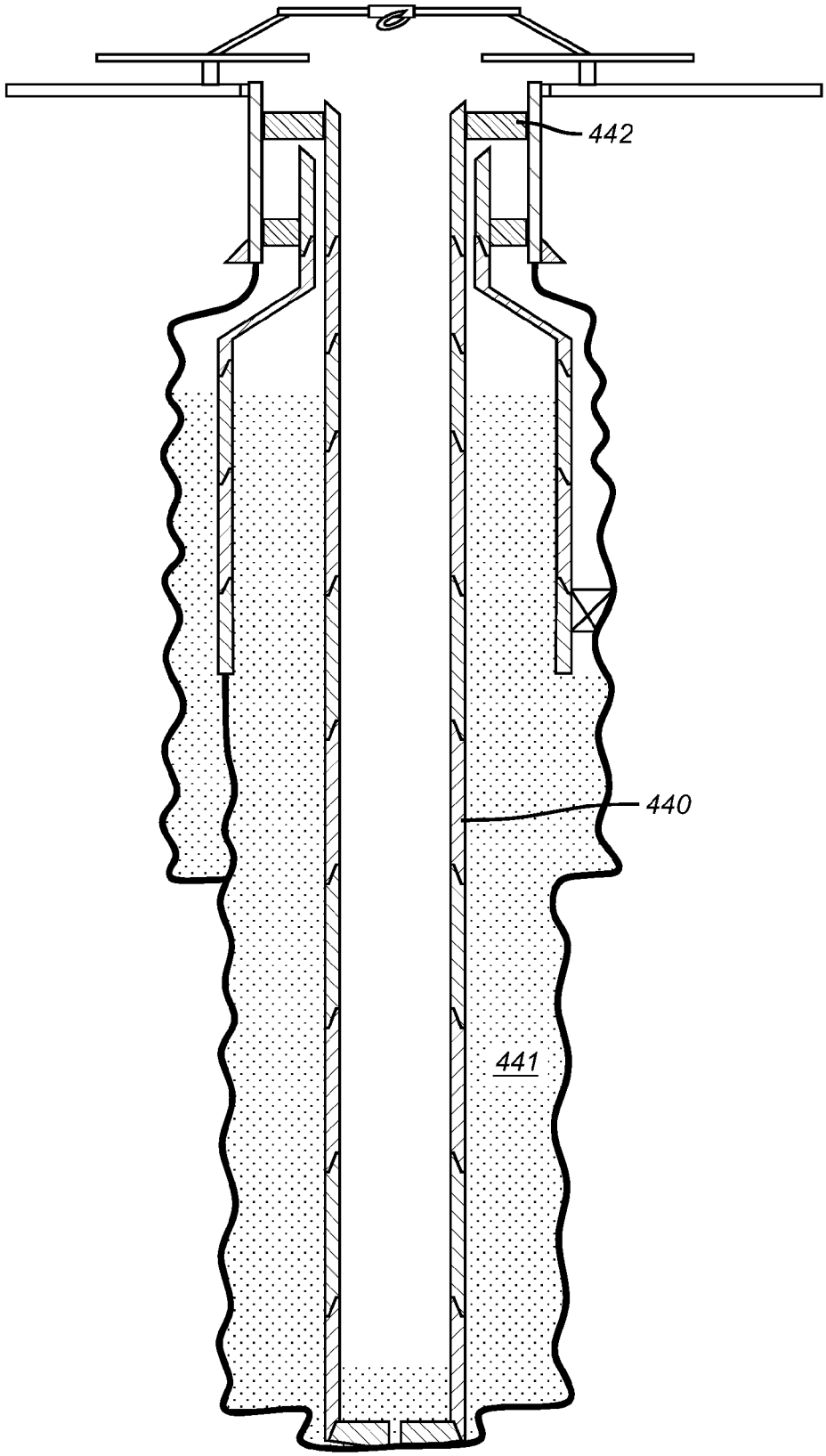
FIG. 42 is the view of FIG. 41 with a production string run in and hung off the casing and optionally cemented.
Figure 43:
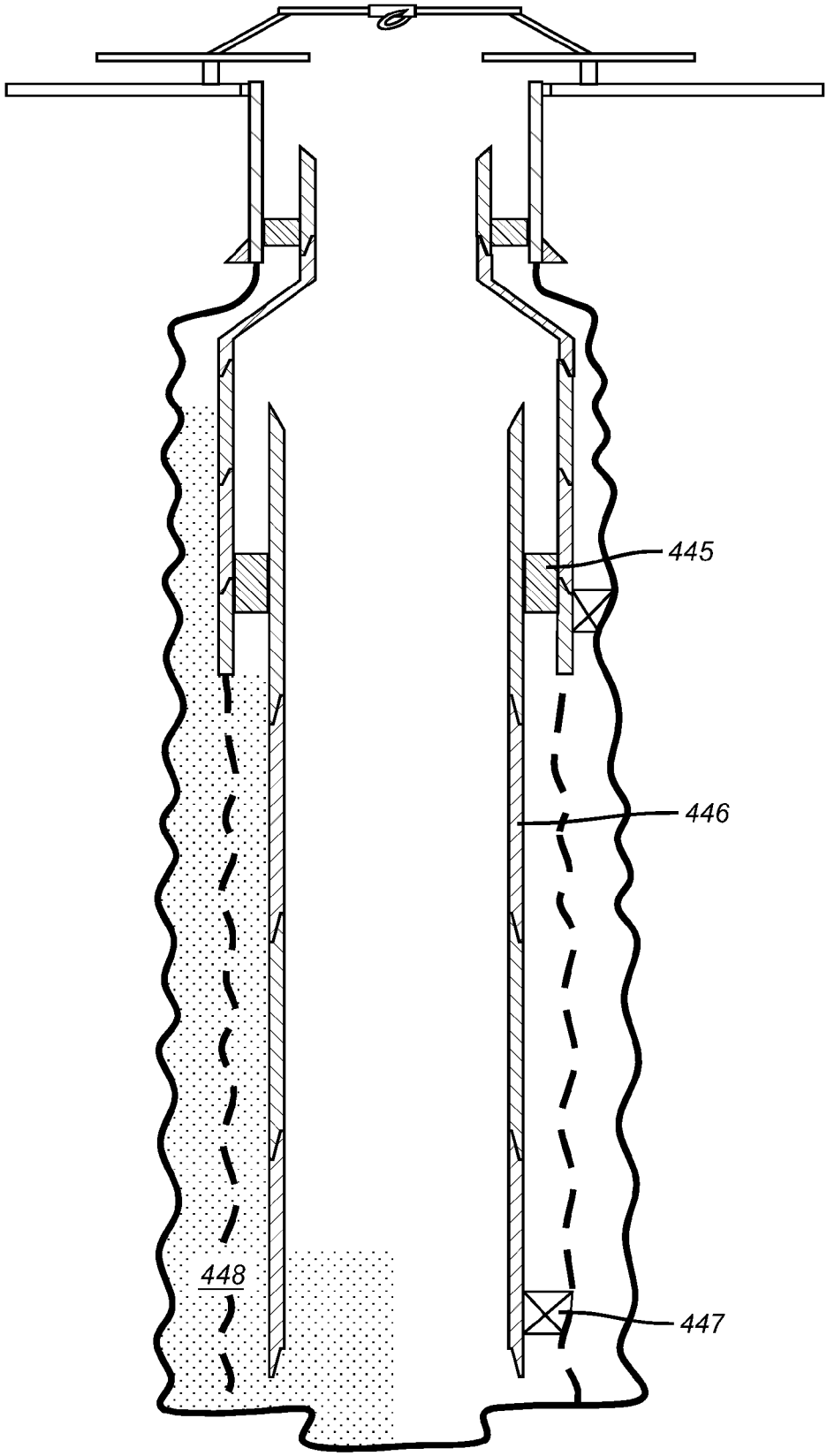
FIG. 43 is the view of FIG. 41 with a second liner hung off from the bell of the liner above and optionally externally sealed with cement or/and one or more packers pr neither.

FIG. 39 starts another sequence of views with a cased hole 430 and an under reamed open hole 431 below it. In FIG. 40 a liner 432 has been inserted and expanded to two diameters or possibly more diameters depending on the cone capabilities. The smaller diameter is in casing 433 and the larger diameter is in the under reamed open hole 431 below. As covered before, a shoe 434 can be run if cement 435 is the option selected or if the alternative of external packers 436 is used. In either even the shoe provides a seat as a part of the expansion process previously discussed. The inside dimension of the liner 437 in the open hole is at least as large as its inside diameter inside the casing 433. In FIG. 41 the shoe 434 is drilled out and additional hole 438 is drilled with a possible variation of the degree of under reaming which accounts for the dashed and solid line in the FIG. The innermost dashed line 439 represents the hole that would be made with the largest bit to fit through the top of the liner 432 while the next series of dashed lines represent under reaming to get the inside dimension of the lower end 437 of the same liner that had previously been expanded into an under reamed portion of the well above. The solid line represents a continuation of the bore size above. FIG. 42 shows another tubular 440 which can be the production string inserted and optionally cemented with cement 441 although it could be left in open hole without cement. Essentially what will pass through the top 432 of the liner above can be used. Again the lower bore size depends on formation conditions and whether cementing is to be done. In FIG. 42 the hole is under reamed to be about the size of the expanded portion 437 of the liner above. The string 440 is hung and/or sealed off inside the casing 442 but could optionally be hung off the bell portion 437 of the upper liner. The latter is illustrated in FIG. 43 where the second liner 446 is expanded and hung and/or sealed off at 445 to the already expanded liner above and in the enlarged bell portion. The string 446 can be cemented 448 or sealed with external packers 447. At the top, it can be hung from the bell of the previously expanded liner above using a hanger/packer 445. Note that there is no reduction in drift size as between the smallest dimension of the liner above 432 and the expanded dimension of the string 446. This is due to the lower string 446 being hung off in the bell of the liner above at hanger/packer 445.

Figure 44:
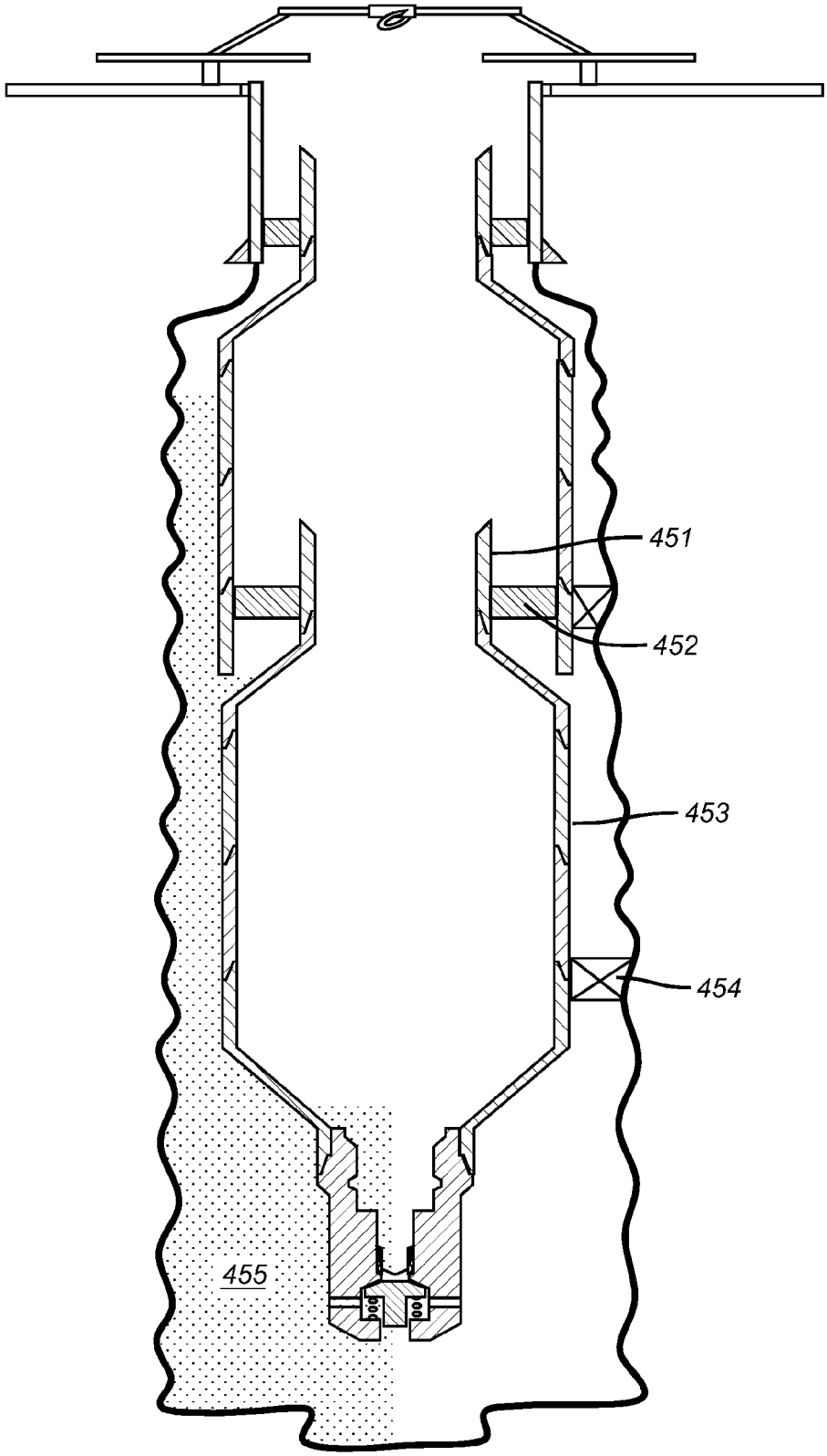
FIG. 44 is the view of FIG. 43 with the lower liner expanded in two dimensions to create a lower bell.

In FIG. 44 the upper and lower liners are expanded to two or more different dimensions. The lower liner is hung with hanger packer 452 in the bell of the liner above it. The lower portion 453 of the lower liner is flared out so that the choke points for flow are at the hanging areas of both liners and in each case there is no reduction of drift regardless how many strings are run and sequentially hung from the string above. Here again the option of cementing 455 or using an external packer or packers 454 is also illustrated. The process can be repeated to add additional expandable liners until depth is reached. Open hole production can be another option.

Figure 45:
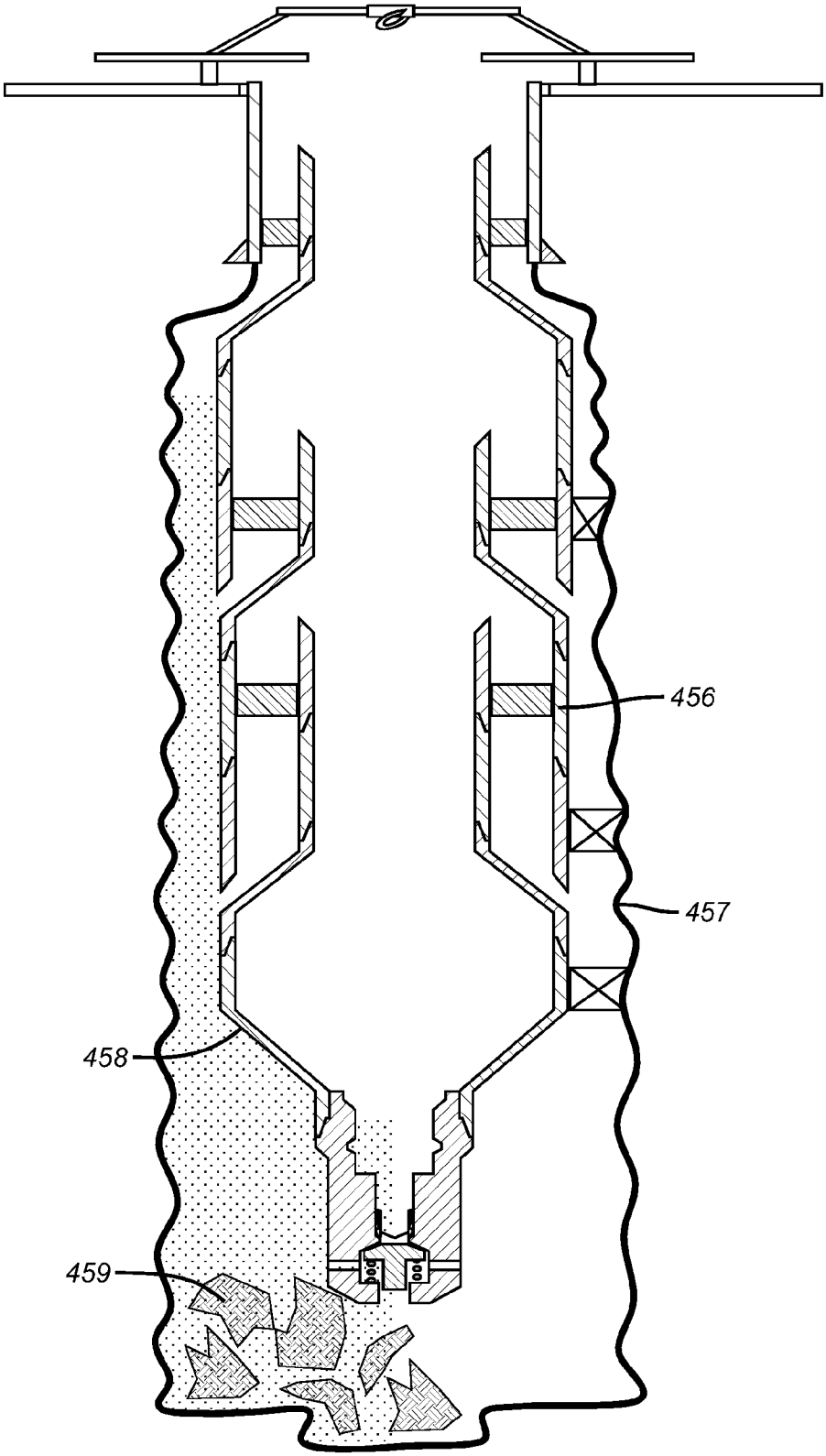
FIG. 45 is the view of FIG. 44 with the length of the liner below the liner lap expanded to allow for high setting a subsequent liner in the event of a hole collapse.

FIG. 45 shows a progression of FIG. 44 where the second liner 456 has been drilled out and the open hole 457 has been under reamed to accommodate another expandable liner. The third liner 458 is shown off bottom due to a collapse of the open hole 459. Alternatively, the liner could become stuck in the open hole for a variety of reasons including differential sticking and fill. Although the third liner 458 did not reach its targeted depth, it is still able to be expanded in two or more dimensions, maintaining flexibility for further wellbore construction. The extended recess section length of the previous liner 456 accommodates the length that the third liner 458 is set high by means of a longer liner lap. It can therefore be seen that the extended recess diameter section of the previous liner increases the flexibility of operations and mitigates risk beyond that of a shorter recess length. If a shorter recess length were present in the second liner 456, then the third liner 458 would not have been able to be expanded without restricting the pass through diameter.

Figure 46:
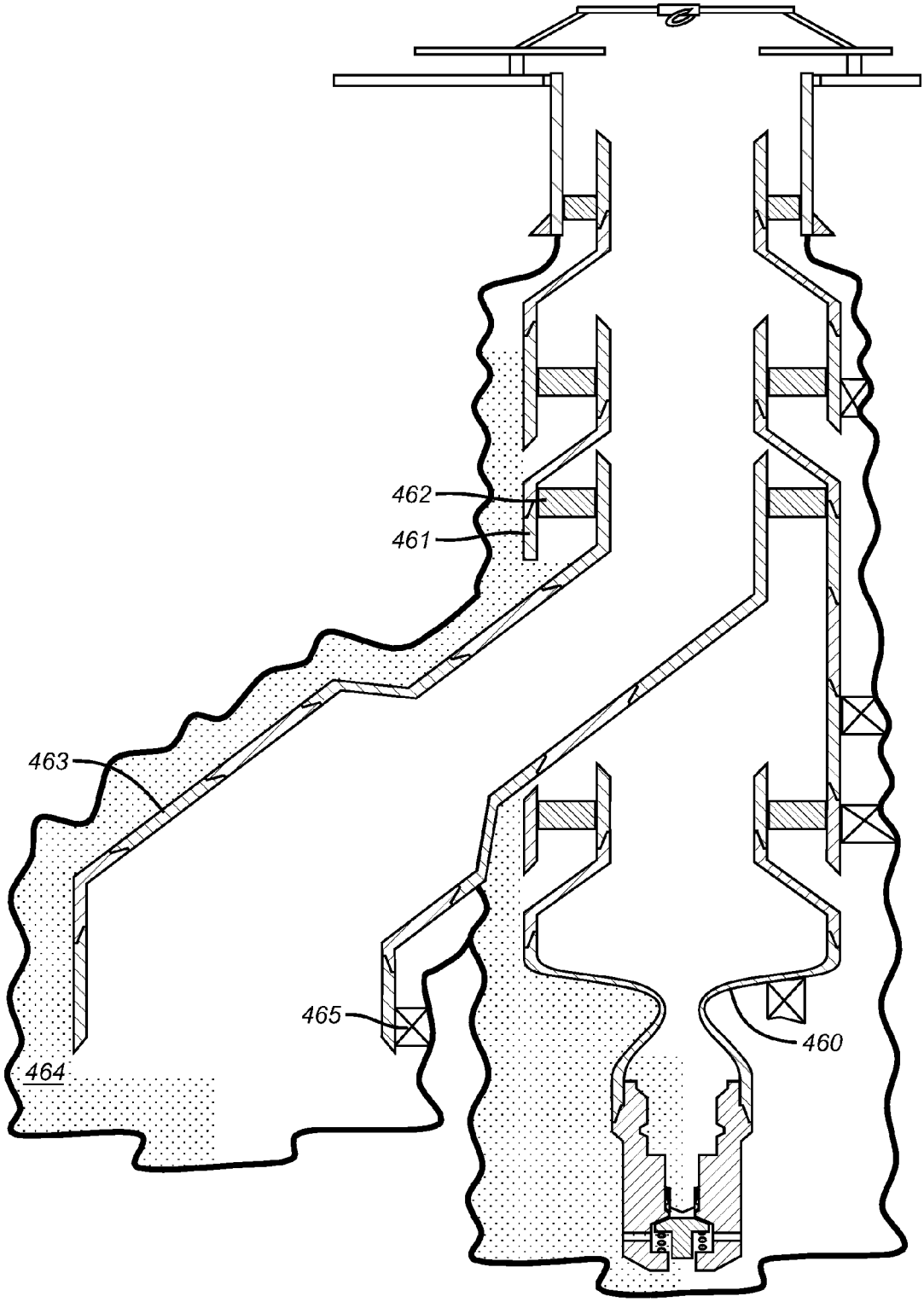
FIG. 46 shows a sequence of liners allowing the sidetrack exit while maintaining bore size.

FIG. 46 is a further embodiment of the operational flexibility and risk mitigation provided by the extended recess diameter length. A third liner 460 has been installed into the wellbore below a second expandable liner 461. The third liner 460 is shown in a no longer useable form as collapsed. Alternatively, the third liner could be leaking, not fully expanded, or otherwise damaged. Alternatively, the open hole below an undamaged third liner 460 could render the third liner unusable if for example the open hole stopped producing hydrocarbons, started producing water, or opened up for fluid losses. The sidetrack technique is then employed above the third liner 460 milling a window out of the side of the second liner 461 in a section that has been expanded to the recess diameter. After the window is milled the open hole section is further drilled and under reamed as required to accommodate running in a fourth liner 463 out of the window. The fourth liner is expanded in two or more dimensions and a hanger packer 462 is hung and/or sealed off in the recess diameter section of the second liner 461. The section of the fourth liner 463 outside of the milled window in the second liner 461 is able to be expanded to the recess diameter. Open hole isolation for the fourth liner 463 is accomplished with cement 464 and/or the use of open hole packer or packers 465. The bottom of the fourth liner 463 has been drilled out for further wellbore construction. All of the operational flexibility and risk mitigation provided by the two or more dimension expansion of the fourth liner and the recess resulting can be utilized in further wellbore construction such as: several additional Monobore liners are able to be run, ability to perform additional sidetracks, ability to set subsequent liners off of bottom, and running production strings of pipe to produce reservoirs without reducing the size of these production strings due to restricted pass through.

Figure 47:
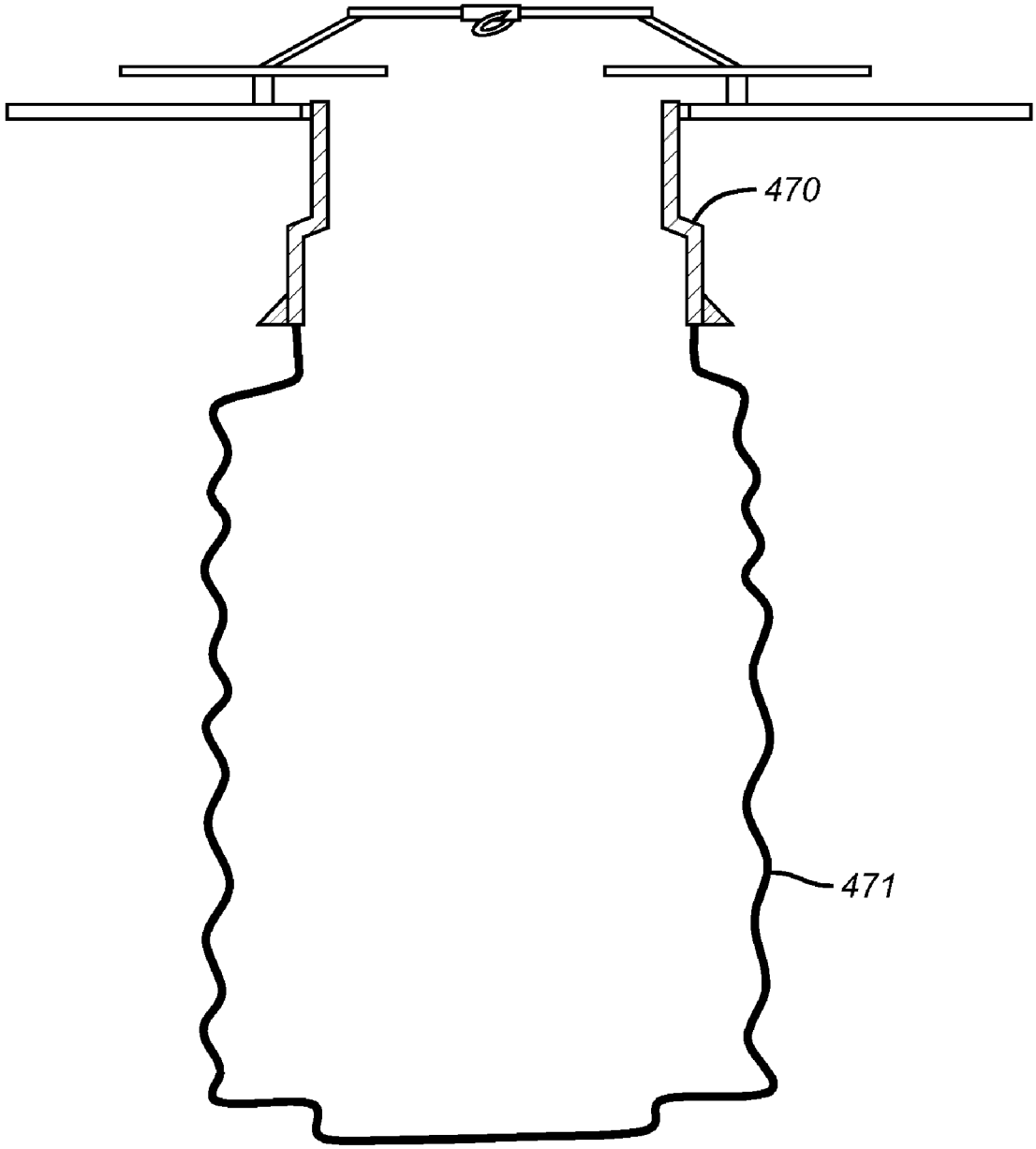
FIG. 47 shows a cased hole with a bell on the lower end of the casing that can be there for run in or created with expansion of a subsequent liner and an under reamed open hole below.
Figure 48:
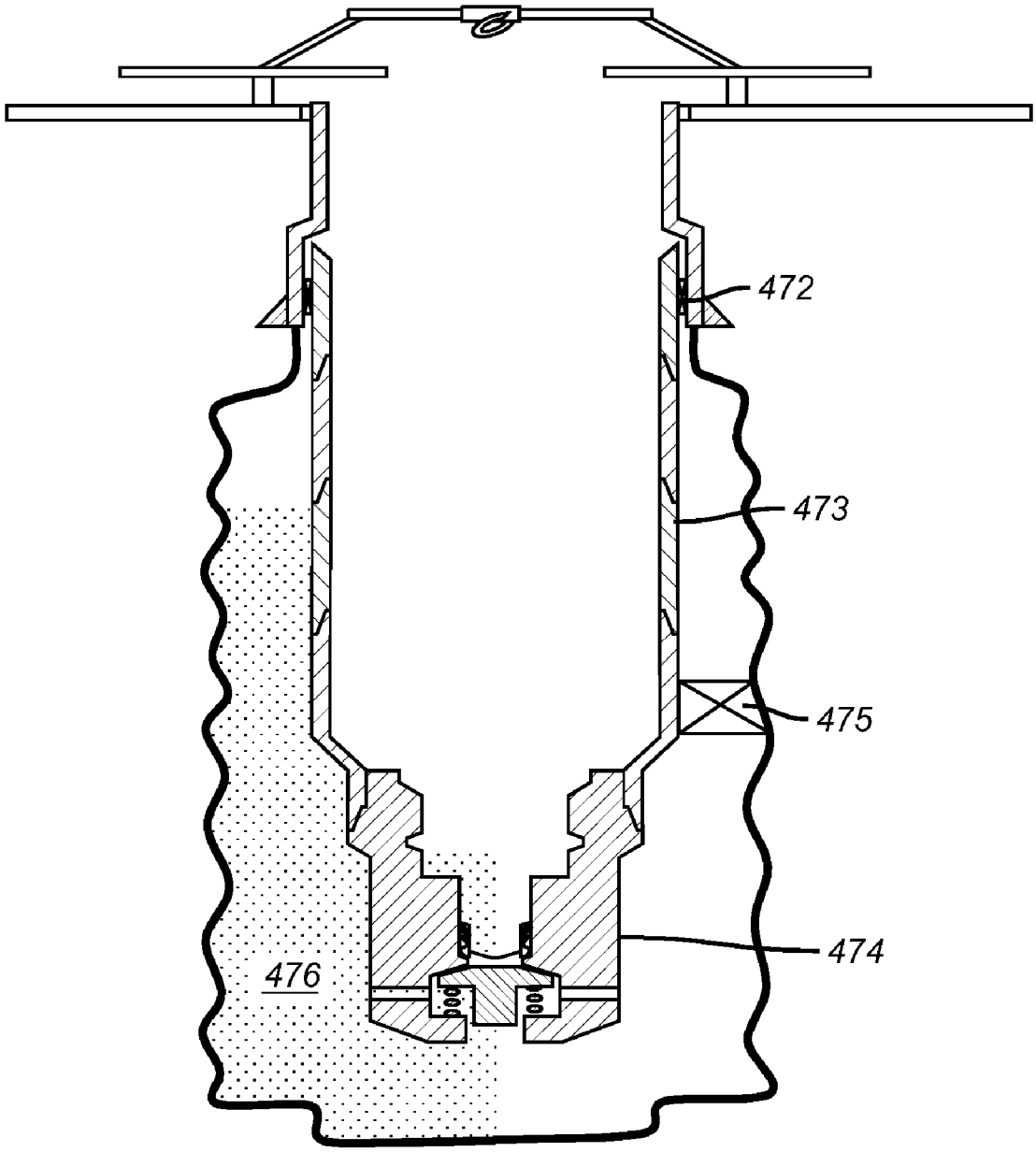
FIG. 48 is the view of FIG. 45 with a liner run in and hung off in the casing bell and optionally sealed with cement or/and one or more external packers or neither.
Figure 49:
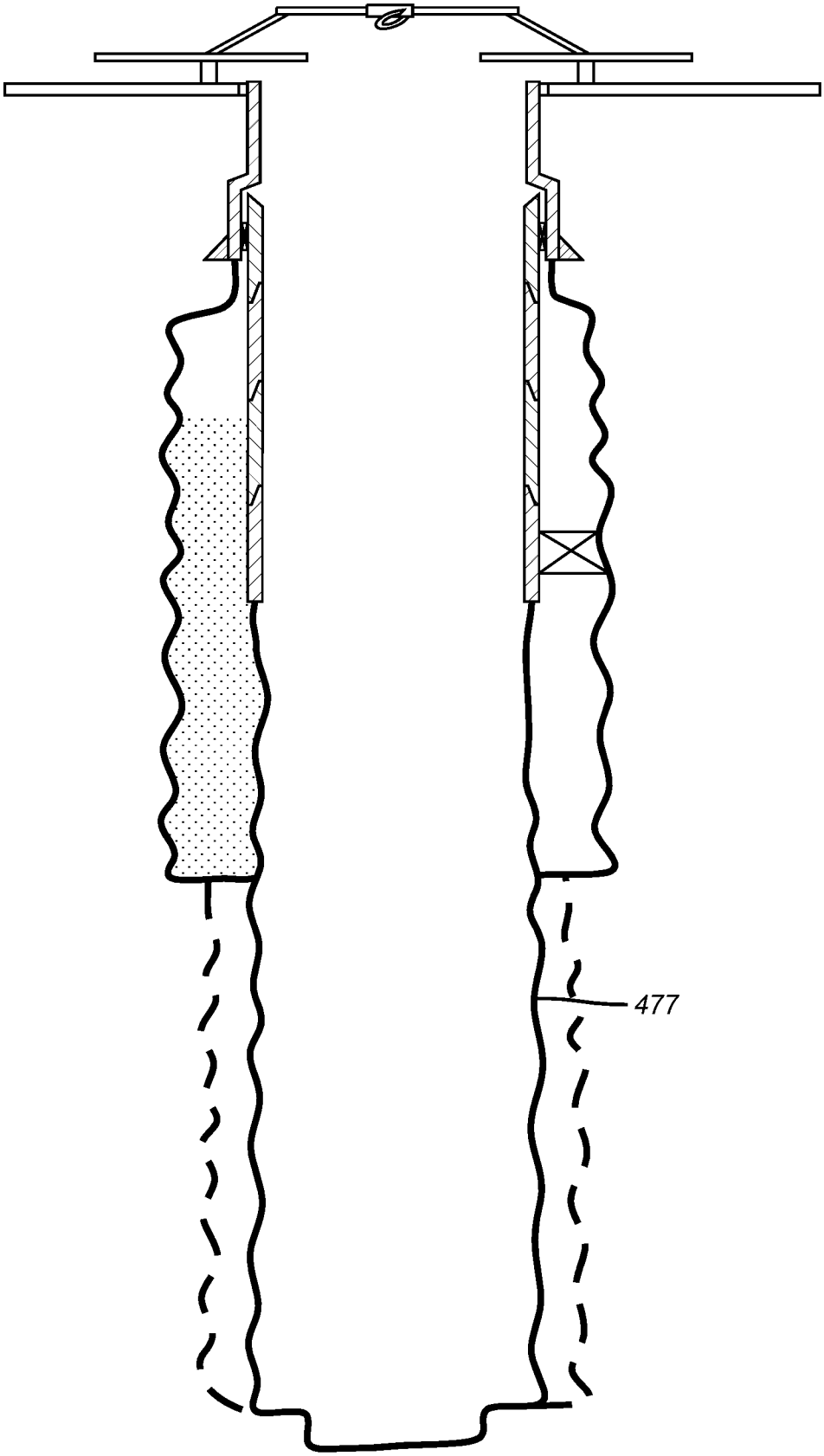
FIG. 49 shows a casing with a lower bell and an upper liner hung from the bell with an open hole below the size of the expanded liner or under reamed.
Figure 50:
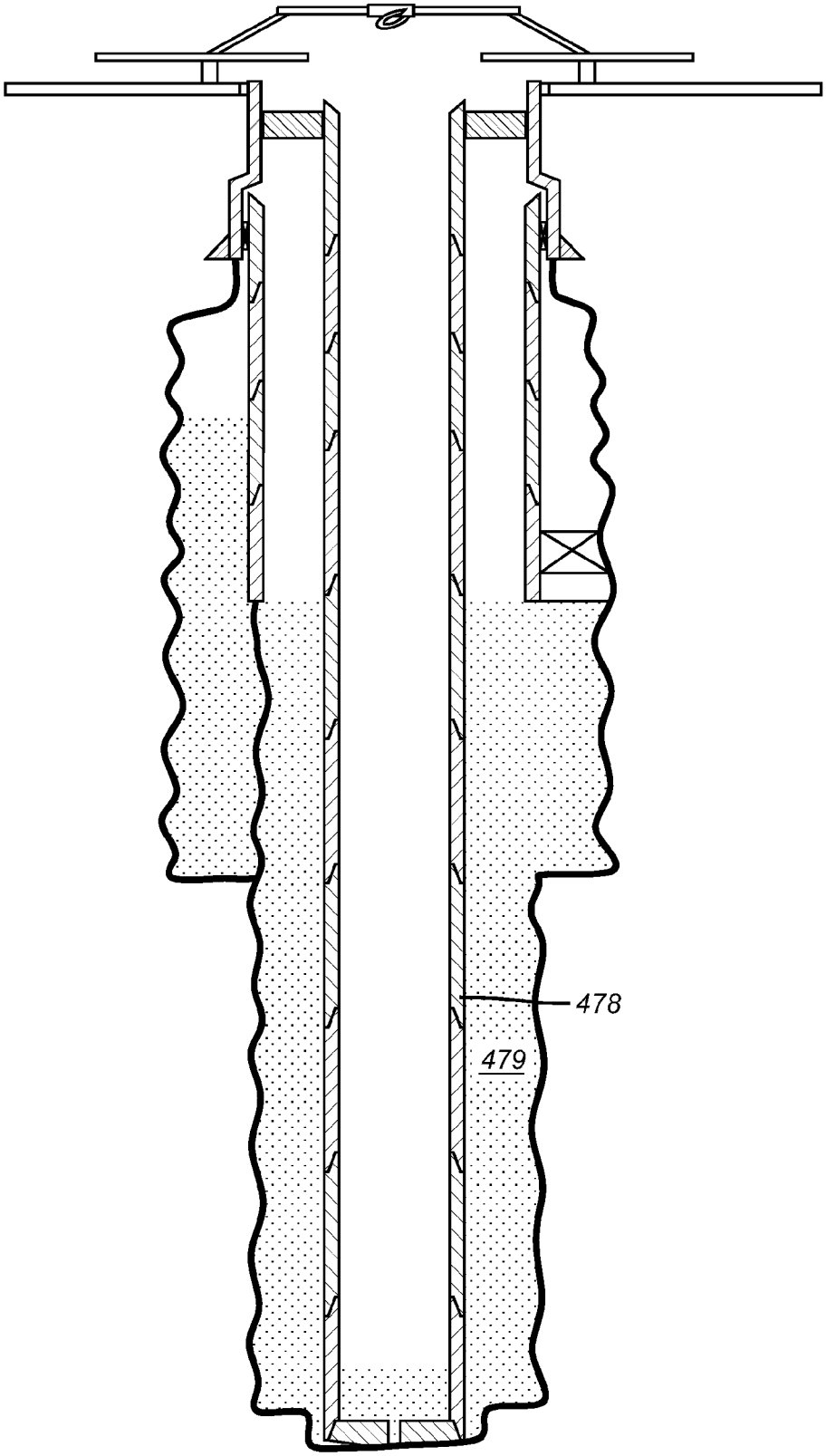
FIG. 50 is the view of FIG. 47 with a production liner inserted through the expanded liner above it and the production liner hung from above the bell in the casing.

FIG. 47 shows and upper casing 470 that has a bell at the lower end either in the condition installed or due to expansion into it of the first liner to be hung. In FIG. 45 there is no liner in the hole but the FIG. is intended to be schematic of both ways a bell can be formed. FIG. 48 shows a liner 473 hung with hanger/packer 472 in the bell of casing 470. Again the shoe is used to expand the string 473 and to facilitate cementing 476 or use of an external packer or packers 475 or both or neither if production will occur from open hole. FIG. 49 shows the shoe 474 drilled out and the hole 477 extended to the diameter of the expanded liner above. It can be under reamed to make it even larger should the formation characteristics and the cement delivery pressure be an issue. Running clearance could also be an issue that would warrant under reaming for running in of the liner 478 shown in FIG. 50. The production liner 478 can be cemented 479 or it can be in open hole without cement or sealed with external packers. The string 478 is hung off the smaller dimension of the casing above the bell where the upper liner is supported. As a result of two dimension expansion of the upper liner with the upper end in the bell of the casing and the upper wellbore under reamed, the resulting internal dimension to depth is not reduced and the use of the upper liner for staged completion of the well does not narrow the size of the production liner 478 which is dictated by the casing size where the production liner 478 is shown to be supported in FIG. 50.

Figure 51:
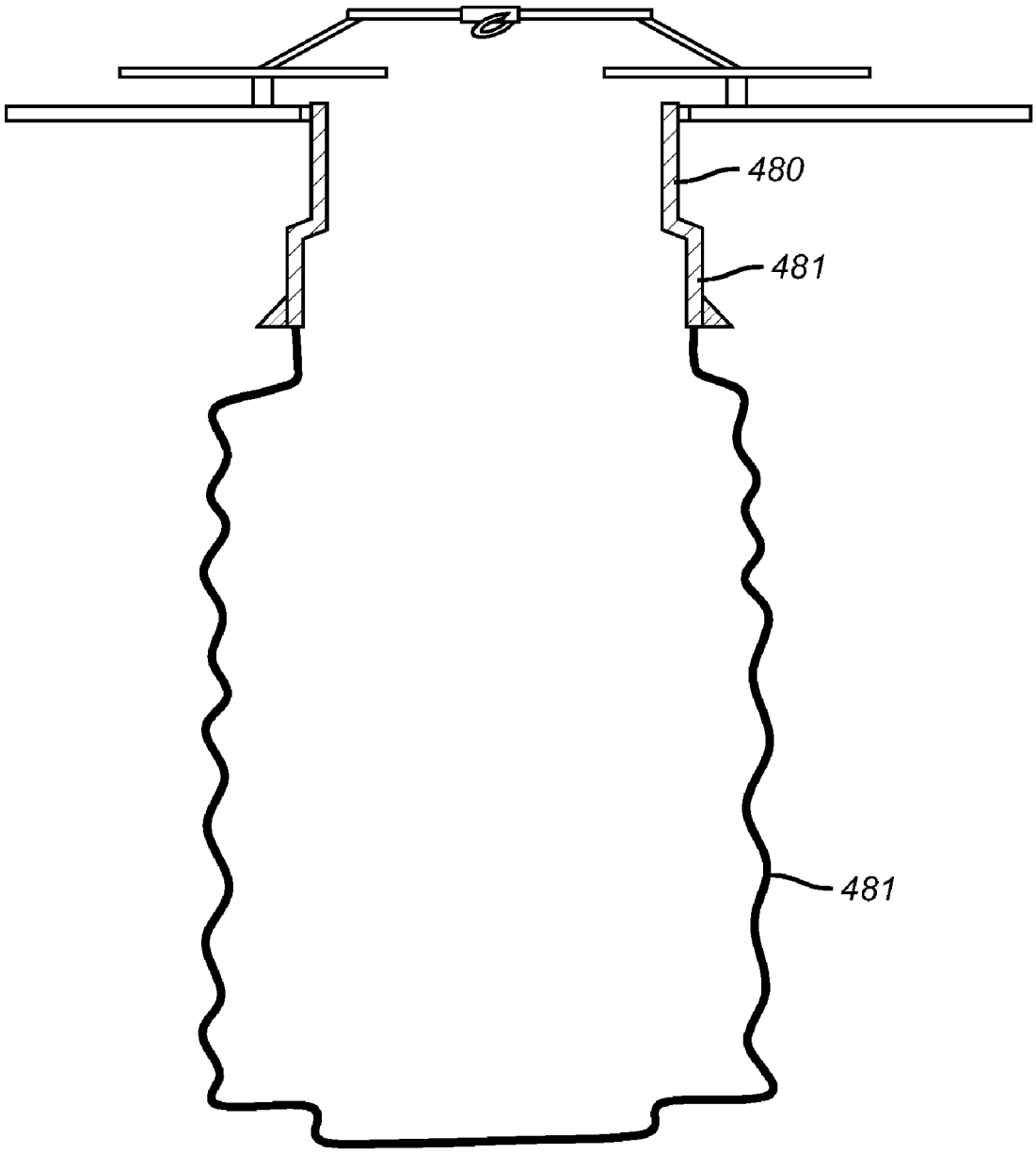
FIG. 51 shows a cased hole with a bell on the lower end of the casing that can be there for run in or created with expansion of a subsequent liner and an under reamed open hole below.
Figure 52:
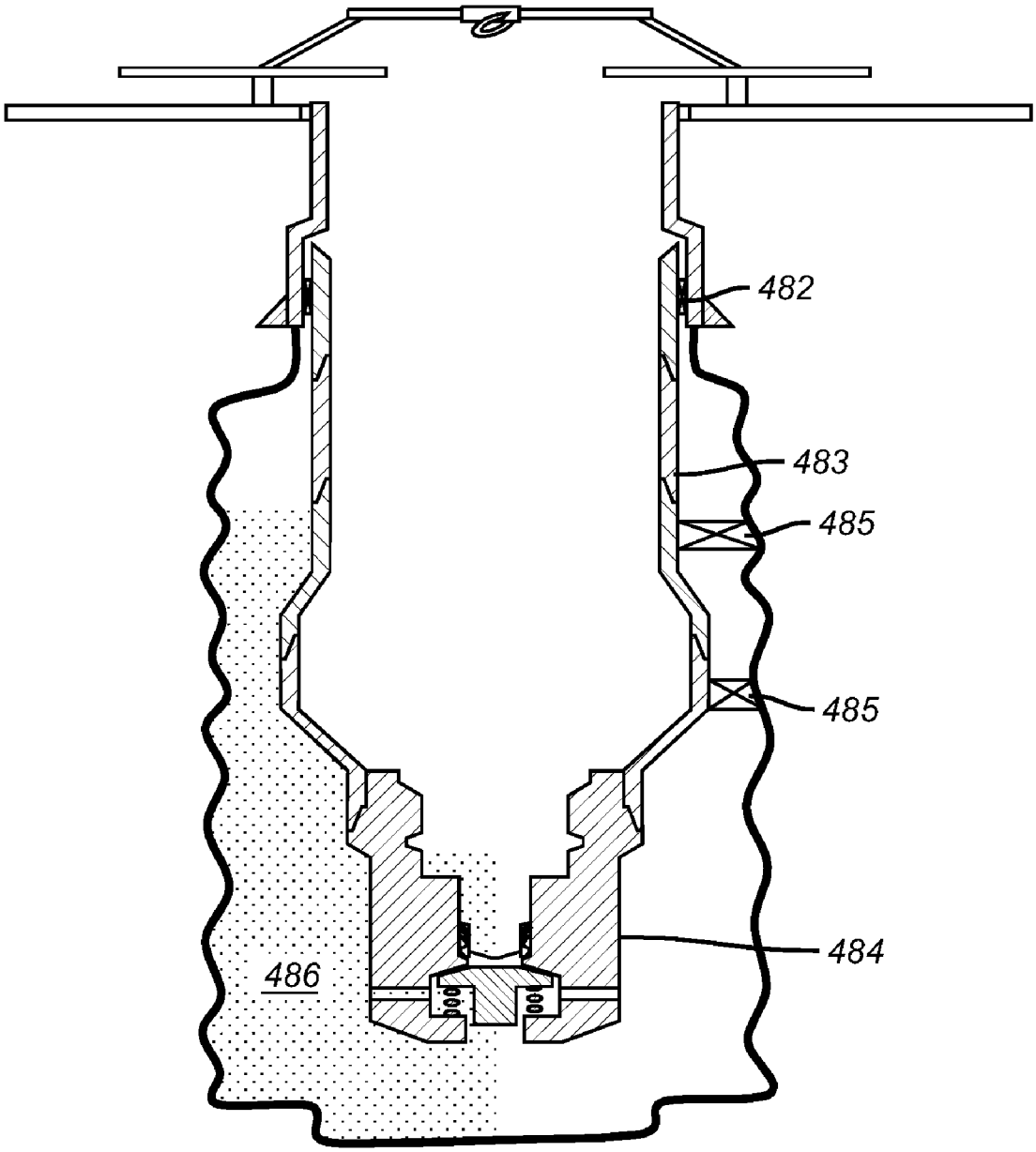
FIG. 52 is the view of FIG. 51 with a liner run in and hung off in the casing bell with a second casing bell positioned at the bottom that can be created upon expansion of the liner or created with expansion of a subsequent liner and is optionally sealed with cement and/or one or more external packers or neither.
Figure 53:
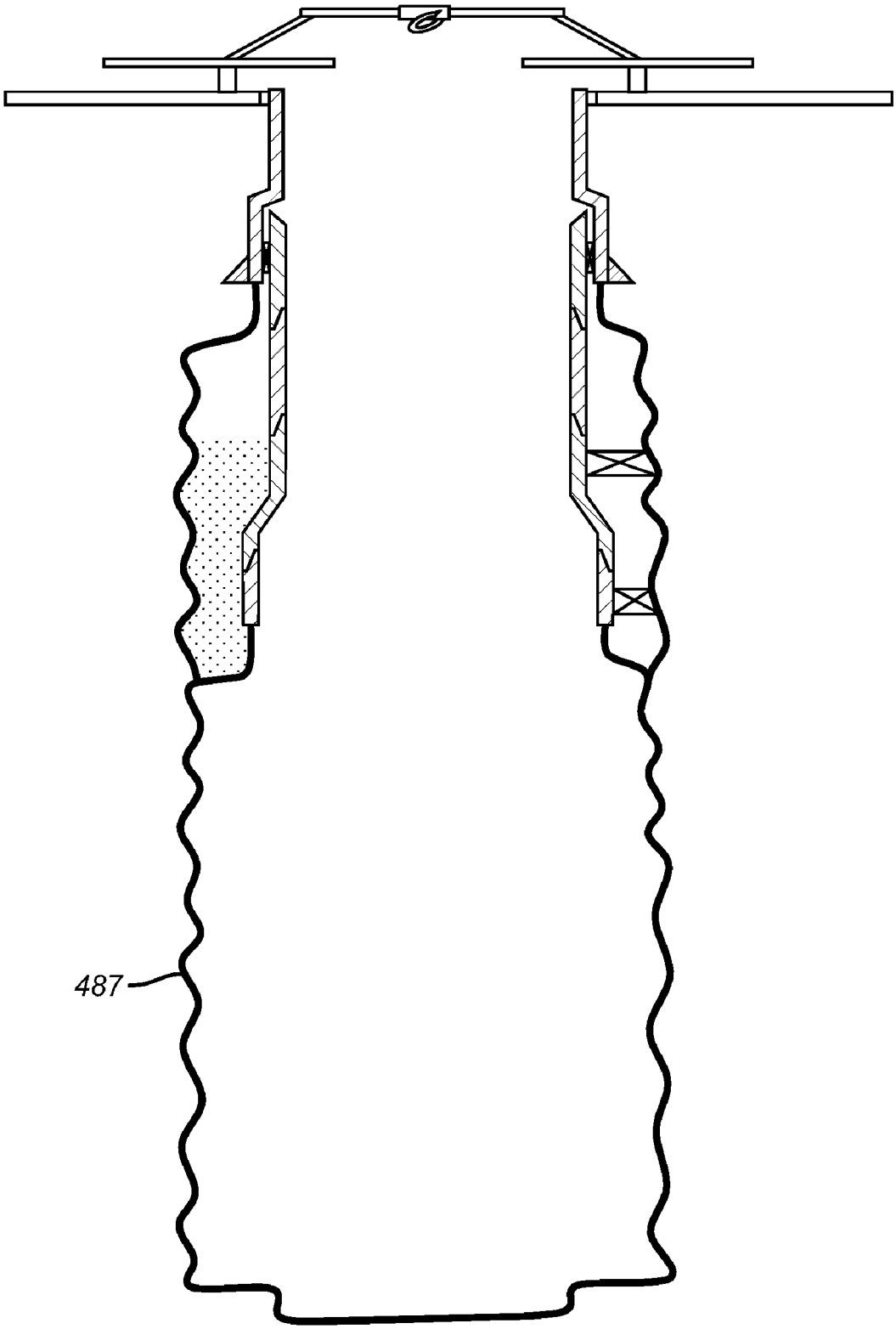
FIG. 53 is the view of FIG. 52 with the shoe drilled out and the open hole below under reamed to accommodate a subsequent liner.
Figure 54:
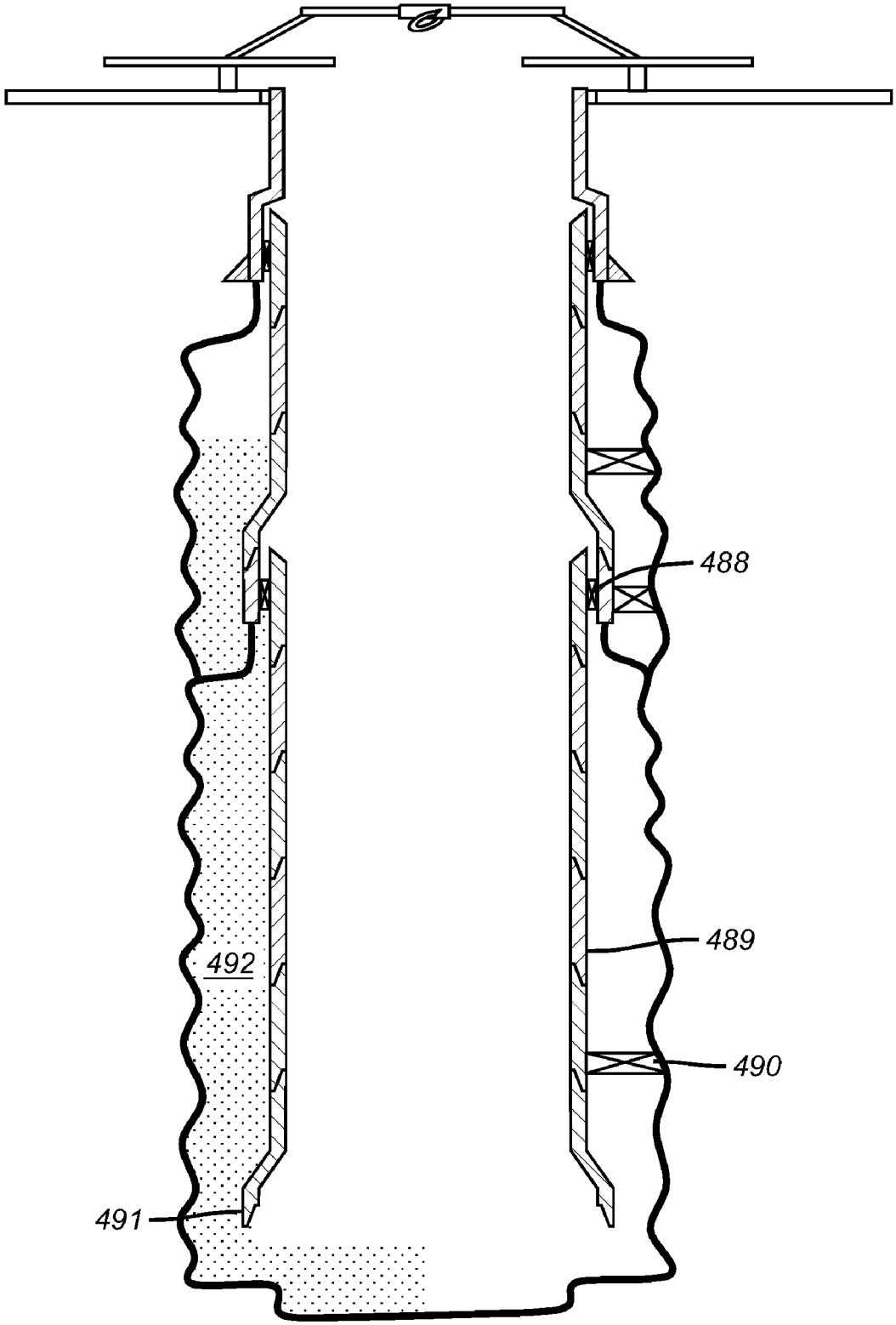
FIG. 54 is the view of FIG. 53 with an additional liner shown run in and hung off as the one above it and as subsequent liners can also be installed.

FIGS. 51-54 show a progression of the wellbore construction concepts shown in FIGS. 47-50 in which the subsequent liner also contains a bell for the sake of being able to repeat the process multiple times without restriction of pass through. FIG. 51 shows and upper casing 480 that has a bell 481 at the lower end either in the condition installed or due to expansion into it of the first liner to be hung. In FIG. 51 there is no liner in the hole but the FIG. is intended to be schematic of both ways a bell can be formed. FIG. 52 shows a liner 483 hung with hanger/packer 482 in the bell 481 of casing 480. Again the shoe 484 is used to expand the string 483 and to facilitate cementing 486 or use of an external packer or packers 485 or both or neither. FIG. 52 shows a bell section at the bottom of the liner 483 that is created either as a part of the process of expansion of this string or upon the installation of subsequent liner. FIG. 53 shows the shoe 484 drilled out and the hole 487 drilled out and under reamed as above. FIG. 54 shows the installation of a second liner 489 hung with a hanger/packer 488 in the bell of the previous liner. Zonal isolation is shown to be performed either with cement 492, one or more open hole packers 490, or both or neither. The second liner 489 contains a bell section 491 as the previous liner that can be used to hang off subsequent liners without restricting the wellbore.

Those skilled in the art will appreciate that the various embodiments offer many advantages that include improved circulation from the lateral ports in the float shoe and a fast drill out from using soft materials for the float shoe. There is an ability to transmit torque through the liner string as it is being advanced right down to the float shoe. Using an adjustable swage removes the need for a bell portion in the liner assembly reducing surge/swab effects. The liner is substantially expanded prior to cementing making for a smaller volume to cement with shorter pump times and earlier compressive strength. The balance of the expansion to tie the liner to the casing is not done against cement. The adjustable swage also allows removal through the liner at any time should the full expansion of the liner become impossible for some reason.

The above description is illustrative of the preferred embodiment and many modifications may be made by those skilled in the art without departing from the invention whose scope is to be determined from the literal and equivalent scope of the claims below.

We claim:

1. A method of installing downhole at least a second tubular string for support from an opening in a first tubular string, comprising:

supporting a second tubular string on a work string, said second tubular string further comprising a shoe fixedly mounted thereto and a swage assembly releasably mounted to said shoe for flow communication therebetween when said swage assembly and said shoe are connected and said work string is engaged to said swage;

inserting said second tubular string through an opening in said first tubular string;

expanding a portion of said second tubular string that extends beyond said opening in said first tubular string in an uphole direction by initially releasing said swage from said shoe which closes off flow through said shoe to allow driving said swage assembly with pressure delivered through said work string;

sealing an annular space around said expanded portion of said second tubular string after said expansion in said uphole direction by engaging said swage assembly to said shoe with said work string;

supporting said second tubular string to said first tubular string after said sealing.

2. The method of claim 1, comprising: using further expansion of said second tubular string that had not been expanded prior to said sealing to accomplish said supporting of said second tubular string to said first tubular string.

3. The method of claim 1, comprising: landing said second tubular string on a wellbore support before said moving said swage uphole with said work string.

4. The method of claim 1, comprising: landing said second tubular string on the wellbore bottom before said moving said swage uphole with said work string.

5. The method of claim 1, comprising: using an adjustable swage as said swage; building said swage to a larger dimension within said second tubular string with pressure delivered through said work string.

6. The method of claim 5, comprising: blocking said work string beyond said adjustable swage; providing a seal on said adjustable swage that contacts said second tubular string in its expanded dimension; using pressure in said blocked work string and said seal on said swage to force said adjustable swage uphole.

7. The method of claim 6, comprising: providing a piston assembly to selectively build said adjustable swage between a smaller and a larger dimension; using pressure in said blocked work string to actuate said piston assembly to build said adjustable swage between said dimensions.

8. The method of claim 7, comprising: retaining pressure on said piston assembly to hold force on said adjustable swage to remain in its larger dimension as said adjustable swage is driven uphole with pressure through said work string.

9. The method of claim 8, comprising: blocking said shoe; releasing said adjustable swage from said shoe with pressure in said blocked work string against said blocked shoe.

10. The method of claim 9, comprising: unblocking said shoe after initial uphole expansion of a portion of said second tubular string; setting down weight on said work string to bring said adjustable swage back to said shoe; delivering a sealing material through said work string and said adjustable swage and said shoe when said adjustable swage is on said shoe.

11. The method of claim 10, comprising: delivering a sealing material in quantities sufficient to fill an annular space around the portion of said second tubular string that has already been expanded.

12. The method of claim 11, comprising: blocking said shoe after delivering said sealing material; providing pressure through said work string after delivering said sealing material to build and drive said swage to a portion of said second tubular string that has yet to be expanded while not further expanding the portion of said second tubular string having sealing material around it.

13. The method of claim 12, comprising: expanding a hanger packer on said second tubular string into said first tubular string for a supporting seal between them accomplished by said adjustable swage exiting the top of said second tubular string.

14. The method of claim 12, comprising: delivering additional sealing material on top of said blocking in said shoe that followed said sealing material to ease subsequent drill out of said shoe.

15. The method of claim 1, comprising: using at least one packer mounted to said second tubular string for said sealing.

16. The method of claim 15, comprising: setting said packer with said uphole expanding of said second tubular string.

17. The method of claim 16, comprising: supporting said second tubular string to said first tubular string with a continuous uphole movement of a variable swage that also sets said packer.

18. The method of claim 17, comprising: blocking a lower end of said second tubular string; using a piston assembly to build and drive said variable swage in said second tubular string with pressure delivered through said blocked work string to said piston and a seal associated with said variable swage.

19. The method of claim 1, comprising: placing said opening in said first tubular string at the lower end of said first tubular string.

20. The method of claim 1, comprising: placing said opening in said first tubular string as a window in the wall of said first tubular string.

21. The method of claim 1, comprising: using cement for said sealing.

22. The method of claim 1, comprising: using an open hole packer for said sealing.

* * * * *